US005449592A

United States Patent [19]

Yoshizawa et al.

[11] Patent Number: 5,449,592

[45] Date of Patent: Sep. 12, 1995

[54] SILVER HALIDE COLOR PHOTOGRAPHIC LIGHT SENSITIVE MATERIAL FOR COLOR PROOF AND METHOD FOR PREPARING COLOR PROOF USING THE SAME

[75] Inventors: Tomomi Yoshizawa; Keiji Ogi; Nariko Kimura; Shigeto Hirabayashi, all of Hino, Japan

[73] Assignee: Konica Corporation, Tokyo, Japan

[21] Appl. No.: 275,330

[22] Filed: Jul. 14, 1994

Related U.S. Application Data

[63] Continuation of Ser. No. 32,433, Mar. 15, 1993, abandoned, which is a continuation of Ser. No. 782,896, Oct. 23, 1991, abandoned, which is a continuation of Ser. No. 517,407, Apr. 27, 1990, abandoned, which is a continuation-in-part of Ser. No. 321,955, Mar. 9, 1989, abandoned.

[30] Foreign Application Priority Data

Mar. 14, 1988 [JP] Japan ..... 63-60734
Dec. 2, 1988 [JP] Japan ..... 63-306569

[51] Int. Cl.[6] ..... G03C 7/00

[52] U.S. Cl. ..... 430/358; 430/367; 430/505; 430/544; 430/545; 430/546; 430/549; 430/556; 430/557; 430/558

[58] Field of Search ..... 430/358, 367, 505, 544–546, 430/549, 556–558

[56] References Cited

U.S. PATENT DOCUMENTS

| | | | |
|---|---|---|---|
| 3,958,993 | 5/1976 | Fujiwhara et al. | 430/443 |
| 4,095,984 | 6/1978 | Sueyoshi et al. | 430/554 |
| 4,540,654 | 9/1985 | Sato et al. | 430/381 |
| 4,596,764 | 6/1986 | Ishimaru | 430/393 |
| 4,680,253 | 7/1987 | Shibahara et al. | 430/504 |
| 4,833,070 | 5/1989 | Kunitz et al. | 430/505 |
| 4,840,880 | 6/1989 | Ohlschlager et al. | 430/505 |
| 4,853,322 | 8/1989 | Makino et al. | 430/567 |
| 4,857,444 | 8/1989 | Hirose et al. | 430/505 |
| 4,874,689 | 10/1989 | Yamanouchi et al. | 430/556 |

FOREIGN PATENT DOCUMENTS

| | | | |
|---|---|---|---|
| 0277647 | 8/1988 | European Pat. Off. | 430/503 |
| 56-104335 | 8/1981 | Japan . | |

OTHER PUBLICATIONS

Research Disclosure 17643, Dec. 1978.

*Primary Examiner*—Janet C. Baxter
*Attorney, Agent, or Firm*—Frishauf, Holtz, Goodman, Langer & Chick

[57] ABSTRACT

A silver halide color photographic light-sensitive material for making a color proof and a method for making the color proof using the light-sensitive material. Halftone color proofs having a similar color tone of small dots and large dots can be obtained by the light-sensitive material and the method using it. The silver halide color photographic light-sensitive material comprises a yellow image forming light-sensitive layers, a magenta image foming light-sensitive layer and a cyan image forming light-sensitive layer which are different from each other in spectral sensitivity, and the magenta image forming layer contains a magenta coupler and an yellow coupler. The color proof is prepared by a method comprising steps of sequentially exposing the above-mentioned silver halide color photographic material to each of light having different spectral distribution through each of a plurality of black-and-white halftone images prepared by color separation of a color original, respectively, and developing the silver halide color photographic material with a color developer.

59 Claims, No Drawings

SILVER HALIDE COLOR PHOTOGRAPHIC LIGHT SENSITIVE MATERIAL FOR COLOR PROOF AND METHOD FOR PREPARING COLOR PROOF USING THE SAME

This application is a Continuation of application Ser. No. 08/032,433, filed Mar. 15, 1993, now abandoned, which is a continuation of Ser. No. 07/782,896 filed Oct. 23, 1991, now abandoned, which is a continuation of Ser. No. 07/517,407 filed Apr. 27, 1990, now abandoned, which is a continuation-in-part of Ser. No. 07/321,955 filed Mar. 9, 1989, now abandoned.

FIELD OF THE INVENTION

The present invention relates to a color photographic light sensitive material with an improved color tone, specifically a silver halide color photographic light sensitive material used to produce color images for proof or color proof from more than one black-and-white dotted images or halftone images obtained by color separation and dotted image conversion in color photomechanical and printing processes.

BACKGROUND OF THE INVENTION

Traditionally, to obtain color proof from a plurality of black-and-white halftone images obtained by color separation and dot image conversion by photomechanical processes, the overlay method and the surprint method have been used, which both use photo polymers or diazo compounds to form color images.

The overlay method is advantageous in that it is very simple, it is low cost, and it allows use to prepare a proof simply by overlaying four film sheets of respective colors, subtractive primaries and black; however, it is faulty in that overlaying the film sheets results in surface gloss, leading to a texture different from that of printed matter.

The surprint method, in which colored images are superposed on a single support, is exemplified by the method described in U.S. Pat. Nos. 3,582,327, 3,607,264 and 3,620,726, in which colored images are obtained by toner developing using the adhesion of photopolymerized materials.

Also, Japanese Patent Examined Publication No. 27441/1972 and Japanese Patent O.P.I. Publication No. 501217/1981 disclose a method in which color proof is prepared by forming images by transfer to support using a light sensitive color sheet, followed by exposure and developing, and superposing another color sheet thereon, in repetition. Japanese Patent O.P.I. Publication No. 97140/1984 discloses a method in which colored images obtained by exposing and developing color separation films corresponding to light sensitive color sheets are transferred onto a single support. These methods are advantageous in that coloring materials similar to printing inks can be used as coloring agents for toners and color sheets used to form such images; therefore, the obtained color proof has a tone resembling that of printed matter.

However, these methods are faulty in that much time is required and cost is high because images must be superposed or transferred during the color proof preparation process.

A method using a silver salt color photographic light sensitive material having a white support to prepare color proof, free of these drawbacks, is disclosed in Japanese Patent O.P.I. Publication Nos. 113139/1981 and 104335/1981; however, it is very difficult to reproduce colors of printing inks since the color of each of the yellow, magenta and cyan layers obtained by color separation, exposure and developing of the silver salt color photographic light sensitive material is different from the yellow, magenta or cyan color of printing inks.

In light of this drawback, when using a negative color photographic light sensitive material among the subtractive full-color photographic light sensitive materials as the color proof material, the best tone can be obtained by controlling the wavelength component of exposure light using a filter etc. and properly mixing the yellow, magenta and cyan of the color photographic light sensitive material for a halftone image to approximate the color of each of the dotted yellow, magenta and cyan images to that of printing inks; this method is disclosed in U.S. Pat. No. 4,188,111.

However, it is found by the present inventors that this method is faulty in that when it is used to prepare a color proof, the color of the dots fluctuates increasingly widely as the size of dots decreases.

Among the methods in which a color proof is prepared by exposure and transfer of white-and-black halftone positive images to a positive color photographic light sensitive material, the method in which exposure light wavelength component is controlled is faulty in that it is difficult to obtain a color approximate to that of printing inks by controlling the forming ratio of the yellow, magenta and cyan color in the color photographic light sensitive material, and thus much time is required to control the tone.

SUMMARY OF THE INVENTION

A purpose of the present invention is to provide a silver halide color photographic light sensitive material used to prepare color proofs from a plurality of black-and-white halftone images obtained by color separation and dotted image conversion that allows us to obtain similar colors in large and small dots.

Another purpose of the invention is to provide a silver halide color photographic light sensitive material that makes it possible to obtain with simple procedures color proofs of excellent color reproducibility and a method for preparing a color proof using a silver halide color photographic light sensitive material.

The purposes of the invention can be accomplished by a silver halide color photographic light-sensitive material comprising a yellow image forming light-sensitive layers, a magenta image forming light-sensitive layer and a cyan image forming light-sensitive layer which are different from each other in spectral sensitivity, wherein the magenta image forming layer contains a magenta coupler and a yellow coupler, and a method for making a color proof comprising steps of sequentially exposing the above-mentioned silver halide color photographic material to each of light having different spectral distribution through each of a plurality of black-and-white halftone images prepared by color separation of a color original, respectively, and developing the silver halide color photographic material with a color developer.

The above-mentioned yellow coupler is represented by the following formula (Y-1);

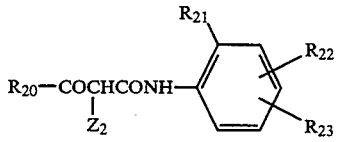

(Y-1)

wherein $R_{20}$ is an alkyl group or a phenyl group; $R_{21}$ is a halogen atom or an alkoxy group; $R_{22}$ is a hydrogen atom. a halogen atom or an alkoxy group which is allowed to have a substituent; $R_{23}$ is an acylamino group, an alkoxycarbonyl group, a carbamoyl group, an alkylsulfamoyl group, an arylsulfamoyl group, an arylsulfonamido group, an alkylureido group, an arylureido group, a succinimido group, an alkoxy group or a aryloxy group, provided that these groups are allowed to have a substituent; $Z_2$ is a hydrogen atom, a halogen atom or a substituent wich is capable of splitting off upon reaction with the oxidation product of a color developing agent and substantially does not inhibit color development after split off from the coupler.

The preferable modes of embodiment of the present invention are as follows:

(a) A silver halide color photographic light sensitive material of the present invention wherein the couplers produce dyes by the reaction with the oxidized product of an aromatic primary amine-type color developing agent.

(b) A silver halide color photographic light sensitive material of the present invention wherein pKa1 and pKa2, the values of pKa respectively of the magenta coupler and cyan coupler ranking highest in molar content among contained in the magenta image forming silver halide emulsion layer and/or a light-sensitive layer having the same spectral sensitivity as the magenta color forming emulsion layer, satisfy Expression (1) shown below.

$$-2.0<(pKa_1-pKa_2<+2.0 \quad (1)$$

(c) A silver halide color photographic light sensitive material of the present invention wherein the magenta coupler in the magenta image forming layer is represented by the following formula (M-I):

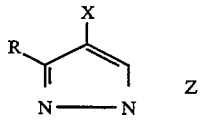

Formula (M-I)

wherein Z represents a group of non-metal atoms necessary for the formation of a nitrogen-containing ehterocycle that may have a substituent.

X represents a hydrogen atom, or a group capable of splitting off by the reaction with the oxidation product of a color developing agent.

R represents a hydrogen atom or substituent.

The effect of the present invention is enhanced by embodying the above-mentioned preferable modes.

DETAILED DESCRIPTION OF THE INVENTION

The present invention is hereinunder described in detail.

The silver halide color photographic light sensitive material of the present invention includes all that comprise at least three light sensitive layers of different spectral sensitivities, which respectively correspond to the yellow, magenta and cyan image forming layers, and that use silver halide as the main light sensitive agent. Such light sensitive materials include those containing couplers which couple with the oxidized product of a p-phenylenediamine-based color developing agent to form dyes.

Of such light sensitive materials, are more preferable those directly using a positive silver halide emulsion and a reverasllight sensitive material, since simple exposure is ensured.

The most preferable light sensitive materials are those directly using a positive silver halide emulsion, which most enhance the effect of the present invention.

The difference of color between large and small dots in dotted images, in cases where a single dot is formed by superposing the colors of the two light sensitive layers, is partly attributable to fluctuation of the balance of color densities of the two layers for small dots, due to layer-to-layer differences of the degree of image unsharpness arising from irradiation and halation in the light sensitive layers.

Another possible cause is the difference of layer interaction of small and large dots in color developing.

The dye-forming compounds to be contained in the color image forming layers of the silver halide color photographic light sensitive material of the present invention are those (couplers) which react with the oxidized product of a p-phenylenediamine-based color developing agent to form dyes. The use of couplers as such dye forming compounds is described below.

In the present invention, the yellow coupler used for magenta image formation may be contained in a single layer together with the magenta coupler and/or in different layer having substantially the same sensitivity as the magenta coupler containing layer.

As above-mentioned, the magenta image forming layer of the invention may include a silver halide layer containg a magenta coupler and another emulsion layer having a spectral sensitivity substantially the same as the magenta coupler containing layer containing an yellow coupler.

The above silver halide emulsion layers having the same spectral sensitivity of the present invention mean a combination of silver halide emulsion layers between which the difference of λ max spectral sensitivity is less than 10 nm or a single silver halide emulsion layer with such a value of λ max difference.

The at least one magenta coupler and one yellow coupler contained in the magenta image forming layer of the present invention mean a combination of compounds between which the difference of max spectral absorption of methanol solutions of the dyes formed by respective couplers is over 10 nm, preferable a combination of couplers with a value of max difference of over 30 nm, more preferable a combination of couplers with a value of max difference of over 60 nm.

Of the at least one magenta coupler and one yellow coupler contained in magenta image forming layer having the substantially same spectral sensitivity of the present invention, the coupler contained in largest amount is preferably be magenta coupler. Among the magenta and yellow couplers, the difference of pKa values between a magenta coupler ($pKa_1$) and an yellow coupler ($pKa_2$) each contained in the largest amount in the magenta image forming layer should preferably be not more than 2, more preferably $-1.5 < pKa_1 - pKa_2 < 1.5$.

Also, it is preferable that the coupler of less content of the above two couplers be a yellow coupler.

Now, an acid-dissociation constant, pKa, of couplers applicable to this invention and the measurement method thereof will be detailed below.

In this invention, a pKa value means a common logarithmic value of the reciprocal of a proton-dissociation equilibrium constant K at the active site of a coupler.

As described in, for example, J.C.S., Perkin I, 809(1973) and 1768(1973), J. Phot. Sci., 22,49(1974), E. Pelizzrtti(3M, Italia), C. Saini(Toino Vniv.) and J. Phot. Sci., 13,248(1985) B. P. Brand (ICI), a pKa value can be measured in a spectrophotometric method or a neutralization-titration mehtod, using a suitable solvent such as a mixture of water and organic solvent.

In the spectrophotometric method, a pka value of coupler is regarded as a pH value obtained in correspondence with the inflection point of a rerational curve obtained between the pH and absorbance of a coupler solution, utilizing the fact that there is a difference in absorbance between the coupler itself and the anion thereof.

To be more concrete, the above-mentioned coupler solution is prepared by the use of a mixture of 2-butoxyethanol and water (30:70) as a solvent. The concentration of the coupler solution is adjusted to the order of $1\times10^{-5}$ to $1\times10^{-2}$ M so that pKa values can readily be measured. The coupler solution is added with anhydrous potassium carbonate in an amount of 3 g per liter, and is further adjusted to be various pH values by adding hydrochloric acid and potassium hydroxide correspondingly. The spectral absorbance of each solution is then measured so as to obtain a relational curve made between the pH value and the spectral absorbance of each solution.

In the neutralization-titration method, a pKa value of coupler is regarded as a pH value obtained at the inflection point of a titration curve obtained through the process that the coupler is dissolved in an alkali-added solvent and the resulted solution is back-titrated with an acid.

Certain of couplers have plural dissociable protons. In those cases, plural pKa values may be obtained. Among those values, however, each pKa value of this invention means a value measured in relation to making anionic the nucleus of a coupler capable of forming a dye upon coupling reaction with the oxidized product of a color developing agent.

Either of the above-described two measurement methods may be so selected out as to meet the characteristics of a coupler subjected to a measurement. When measuring one and the same coupler in the two methods, respectively, there are some differences between the resulted pKa values. Howerer, the difference in pKa value between a magenta coupler and yellow coupler used in the invention, i.e., a value of pKa 1 − pKa 2, can be applied to the invention, provided that both of the $pKa_1$ and $pKa_2$ values are measured in one and the same method of the two.

The preferable magenta dye forming couplers to be contained in the magenta image forming layer of the silver halide color photographic light sensitive material of the present invention are pyrazolazole couplers, which are represented by the following formula (M-I):

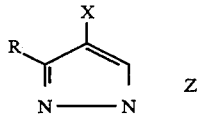

Formula (M-I)

wherein Z represents a group of non-metal atoms necessary for the formation of a nitrogen-containing heterocycle that may have a substituent.

X represents a hydrogen atom, or a group capable of splitting off upon reaction with the oxidized product of a color developing agent.

R represents a hydrogen atom or substituent.

Although there is no particular limitation on the choice of a substituent for R, representative examples of the substituent include groups such as alkyl, aryl, anilino, acylamino, sulfonamido, alkylthio, arylthio, alkenyl and cycloalkyl. The examples further include halogen atoms, groups such as cycloalkenyl, alkynyl, heterocyclic rings, sulfonyl, sulfinyl, phosphonyl, acyl, carbamoyl, sulfamoyl, cyano, alkoxy, aryloxy, heterocyclic oxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclic thio, as well as spiro residues, bridged hydrocarbon residues and the like.

A preferred alkyl group represented by R is an alkyl group having 1 to 32 carbon atoms and may be straight-chained or branched.

A preferred aryl group represented by R is a phenyl group.

A preferred acylamino group represented by R is an alkylcarbonylamino group, an arylcarbonylamino group or the like.

A preferred sulfonamido group represented by R is an alkylsulfonylamino group, an arylsulfonylamino group or the like.

A preferred alkyl moiety or aryl moiety in the alkylthio or arylthio group represented by R is any one of the above alkyl or aryl groups represented by R.

A preferred alkenyl group represented by R is an alkenyl group having 2 to 32 carbon atoms. A preferred cycloalkyl group represented by R is a cycloalkyl group having 3 to 12, especially 5 to 7 carbon atoms. Such an alkenyl group may be straight-chained or branched.

A preferred cycloalkenyl group represented by R is a cycloalkenyl group having 3 to 12, especially 5 to 7 carbon atoms.

Examples of the sulfonyl group represented by R include alkylsulfonyl group and arylsulfonly groups;
examples of the sulfinyl group include alkylsulfinyl groups and arylsulfinyl groups;
examples of the phosphonyl group include alkylphosphonyl groups, alkoxyphosphonyl groups, aryloxyphosphonyl groups and arylphosphonyl groups;
example of the acyl group include alkylcarbonyl groups and arylcarbonyl groups;
examples of the carbomoyl group include alkylcarbamoyl groups and arylcarbomoyl groups;
examples of the sulfamoyl group include alkylsulfamoyl groups and arylsulfamoyl groups;
examples of the acyloxy group include alkylcarbonyloxy groups and arylcarbonyloxy groups;
examples of the carbamoyloxy group include alkylcarbamoyloxy groups and arylcarbamoyloxy groups;

examples of the ureido group include alkylureido groups and arylureido groups;

examples of the sulfamoylamino group include alkylsulfamoylamino groups and arylsulfamoylamino groups; the heterocyclic group should preferably be a 5- to 7-membered heterocyclic group, and examples include 2-furyl group, 2-thienyl group, 2-pyrimidinyl group and 2-benzothiazolyl group;

the heterocyclic oxy group should preferably be a 5- to 7-membered heterocyclic group, and examples include 3,4,5,6-tetrahydropyranyl-2-oxy group and 1-phenyltetrazol-5-oxy group;

the heterocyclic thio group should preferably have a 5- to 7-membered heterocycle, and examples include 2-pyridylthio group, 2-benzothiazolylthio group and 2,4-diphenoxy-1,3,5-triazole-6-thio group;

examples of the siloxy group include trimethylsiloxy group, triethylsiloxy group and dimethylbutylsiloxy group;

examples of the imido group include succinic imido group, 3-heptadecylsuccinic imido group, phthalic imido group and glutaric imido group;

examples of the spiro residue include spiro(3.3)heptan-1-yl;

examples of the bridged hydrocarbon residue include bicyclo(2.2.1)heptan-1-yl, tricyclo(3.3.1 1 3,7)decane-1-yl and 7,7-dimethyl-bicyclo(2.2.1)heptan-l-yl.

Examples of the group capable of splitting off by the reaction with the oxidized product of a color developing agent include halogen atoms (e.g. chlorine atom, bromine atom, fluorine atom) and groups such as alkoxy, aryloxy, heterocyclic oxy, acyloxy, sulfonyloxy, alkoxycarbonyloxy, aryloxycarbonyl, alkyloxalyloxy, alkoxyoxalyloxy, alkylthio, anylthio heterocyclic thio, alkyloxythiocarbonylthio, acylamino, sulfonamido, nitrogen-containing heterocycles bound via an N atom, alkyloxycarbonylamino, aryloxycarbonylamino, carboxyl, and

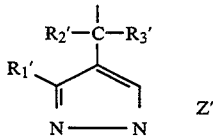

Z' wherein $R_1'$ is identical with the above defined R; Z' is identical with the above defined Z; $R_2'$ and $R_3'$ independently represent a hydrogen atom, aryl group, alkyl group or heterocyclic group. A preferred group is a halogen atom, particularly a chlorine atom.

Examples of the nitrogen-containing heterocycle formed by Z or Z' include pyrazole rings, imidazole rings, triazole rings, and tetrazole rings. Examples of the substituent which said heterocycle may have are identical with those mentioned above for R.

Compounds represented by Formula (M-I) are more specifically represented by the following formulas (M-II) through (M-VII):

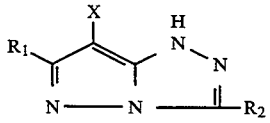

(M-II)

-continued

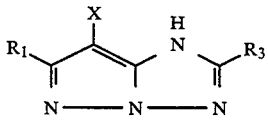

(M-III)

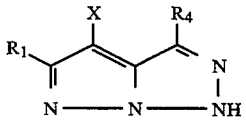

(M-IV)

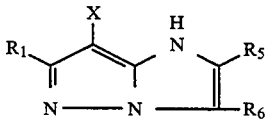

(M-V)

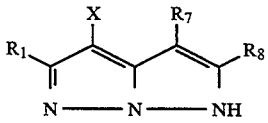

(M-VI)

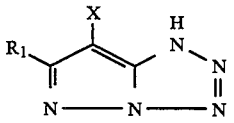

(M-VII)

$R_1$ through $R_8$ and X in the above formulas (M-II) through (M-VII) are identical with the above defined R and, X.

Of the compounds of Formula (M-I), those represented by the following formula (M-VIII) are preferable°

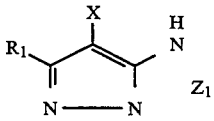

General formula (M-VIII)

wherein $R_1$, X and $Z_1$ are identical with R, X and Z in Formura (M-I).

Of the magenta couplers represented by Formulas (M-II) through (M-VII), those represented by Formula (M-II) or (M-III) are especially preferable.

Referring to the substituent on the heterocycle in Formulas (M-I) through (M-VIII) when the magenta coupler is used to form positive images, it is preferable that R in Formula (M-I) or $R_1$ in Formulas (M-II) through (M-VIII) satisfy the following condition 1, more preferably the following conditions 1 and 2, still more preferably the following conditions 1, 2 and 3.

Condition 1: The atom of R or $R_1$ which is bound directly to the heterocycle is a carbon atom.

Condition 2: No or one hydrogen atom is bound to said carbon atom.

Condition 3: The bonds between said carbon atom and adjoining atoms are all single bonds.

The most preferable substituents for R and $R_1$ that satisfy the above conditions are represented by the following formura (M-IX):

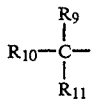

Formura (M-IX)

wherein $R_9$, $R_{10}$ and $R_{11}$ are each identical with the above defined R.

Two of the above $R_9$, $R_{10}$, and $R_{11}$, e.g. $R_9$ and $R_{10}$ may link together to form a saturated or unsaturated ring such as cycloalkane, cycloalkene, heterocycle, which may be linked with $R_{11}$ to configure a bridged hydrocarbon residue.

The preferable cases for Formula (M-IX) are (i) the case where at least two of $R_9$ through $R_{11}$ are alkyl groups, and (ii) the case where one of $R_9$ through $R_{11}$ e.g. $R_{11}$ is a hydrogen atom and the other two, i.e. $R_9$ and $R_{10}$ link together to form a cycloalkyl in cooperation with the carbon atom directly bound to the heterocyclic ring.

As to case (i), it is preferable that two of $R_9$ through $R_{11}$ are alkyl groups and the other one is a hydrogen atom or alkyl group.

For the substituent which the ring formed by Z in Formula (M-I) and the ring formed by $Z_1$ in Formula (M-VIII) may have, and for $R_2$ through $R_8$ in Formulas (M-II) through (M-VI), a substituent represented by the following formula (M-X) is preferable. Formula (M-X)

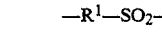

$$-R^1-SO_2-R^2$$

wherein $R^1$ represents an alkylene group; $R^2$ represents an alkyl group, cycloalkyl group or aryl group.

The alkylene group for $R^1$ should preferably have in its straight chain moiety two or more carbon atoms, more preferably 3 to 6 carbon atoms, and may be straight-chained or branched.

The cycloalkyl group for $R^2$ should preferably be a 5- or 6-membered cycloalkyl.

Referring to the substituent on the heterocycle in Formulas (M-I) through (M-VIII) when the magenta coupler is used to form negative images, it is preferable that R in Formula (M-I) or $R_1$ in Formulas (M-II) through (M-VIII) satisfy the following condition 1, more preferably the following conditions 1 and 2.

Condition 1: The atom of R or $R_1$ which is bound directly to the heterocycle is a carbon atom.

Condition 2: At least two hydrogen atoms are bound to said carbon atom.

The most preferable substituents for R and $R_1$ that satisfy the above conditions are represented by the following formula (M-XI): Formula (M-XI)

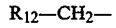

$$R_{12}-CH_2-$$

wherein $R_{12}$ is identical with the above difined R.

A preferable group for $R_{12}$ is a hydrogen atom or alkyl group.

Representative examples of the compound of the present invention are given below.

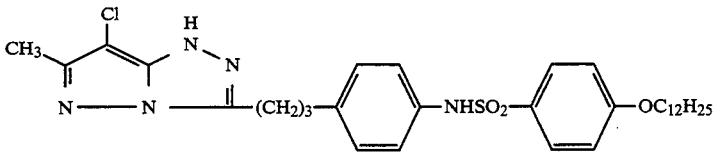

(M-1)

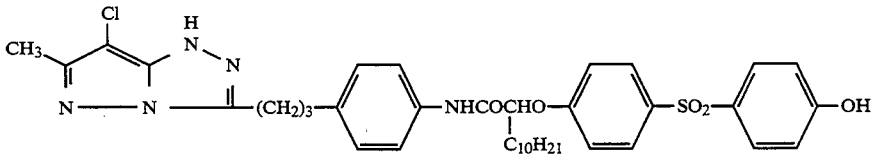

(M-2)

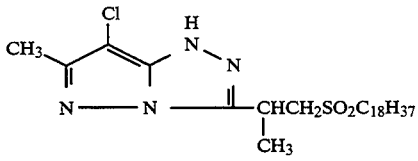

(M-3)

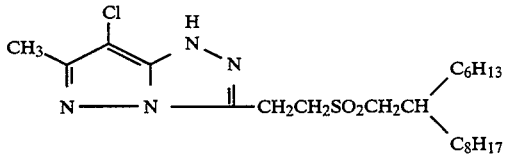

(M-4)

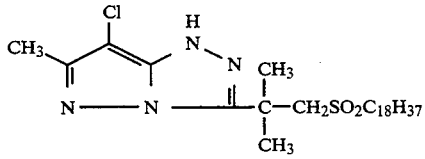

(M-5)

-continued
(M-6)
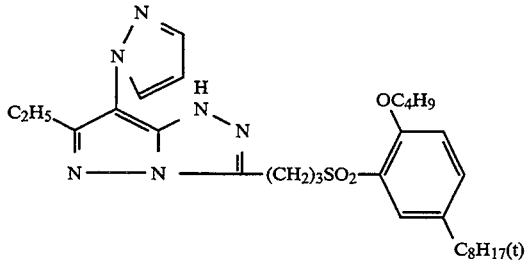
(M-7)
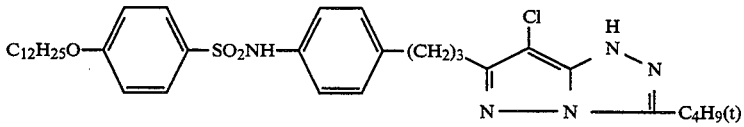
(M-8)
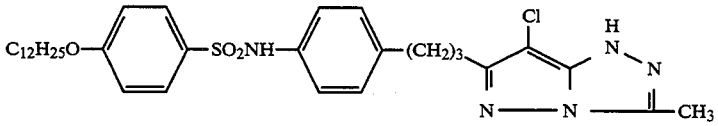
(M-9)
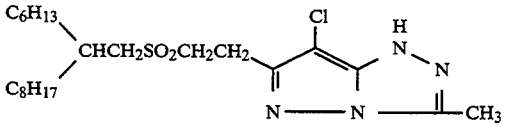
(M-10)
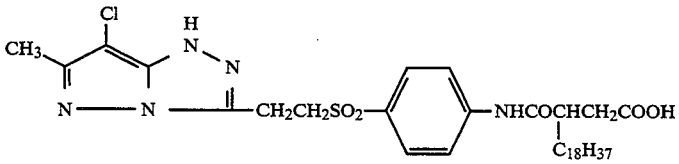
(M-11)
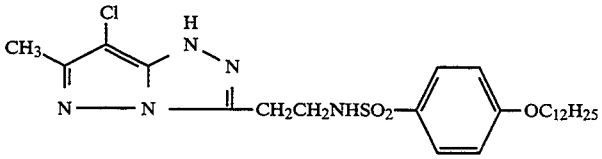
(M-12)
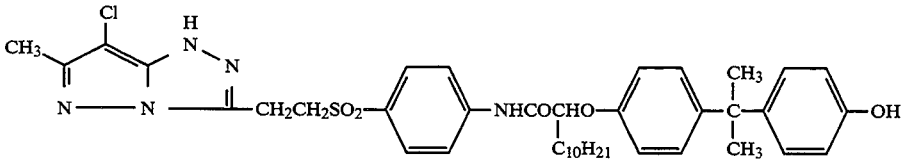
(M-13)
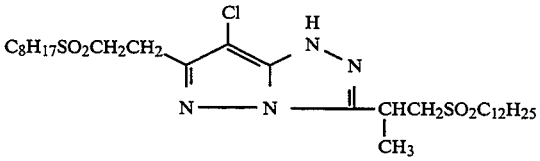
(M-14)
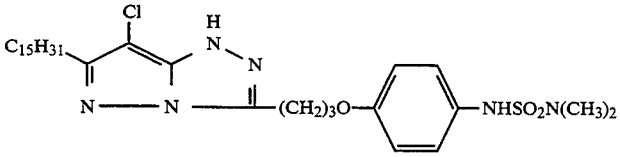

-continued
(M-15)
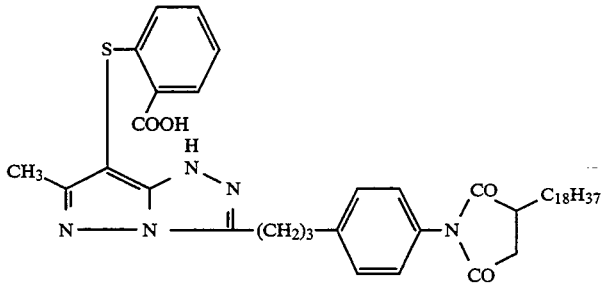
(M-16)
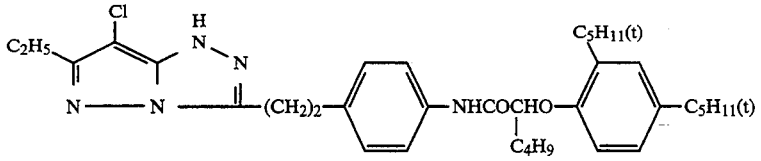
(M-17)
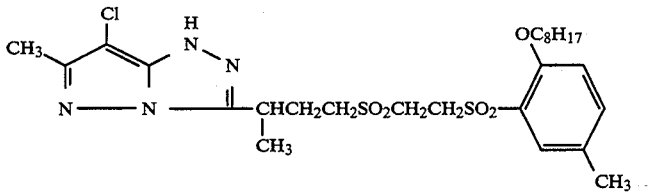
(M-18)
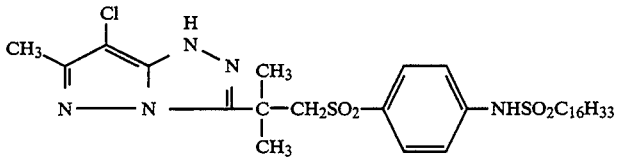
(M-19)
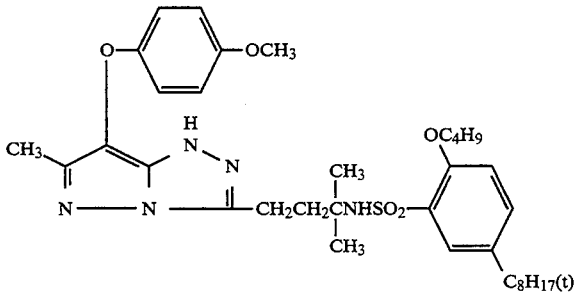
(M-20)
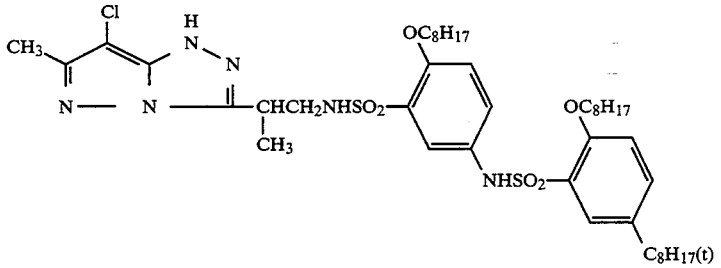
(M-21)
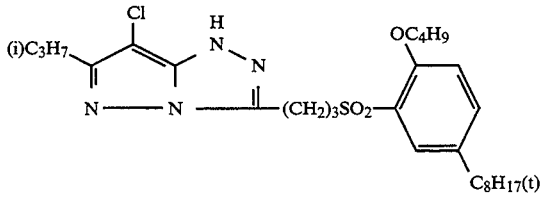

-continued
(M-22)
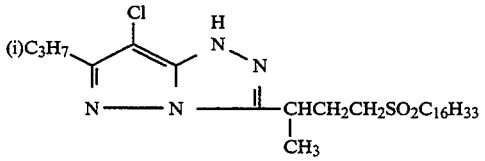
(M-23)
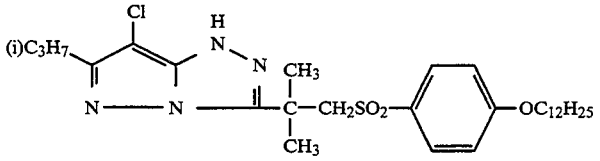
(M-24)
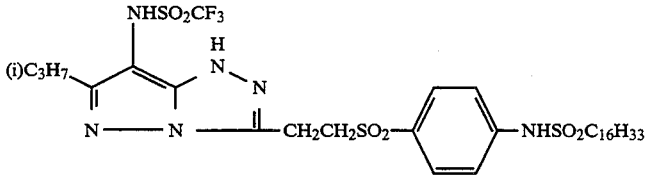
(M-25)
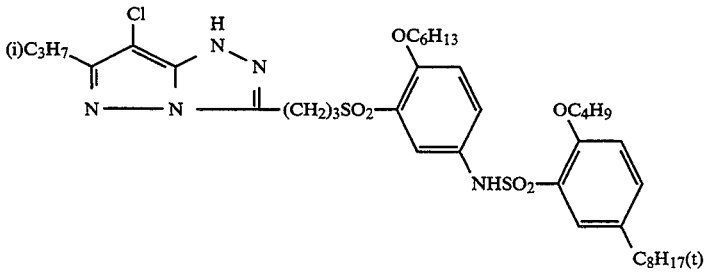
(M-26)
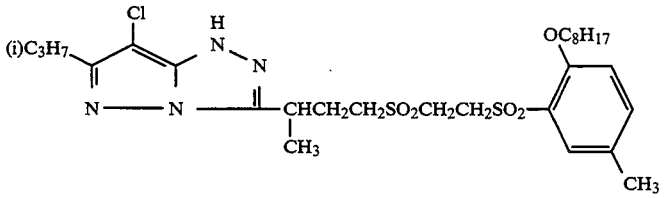
(M-27)
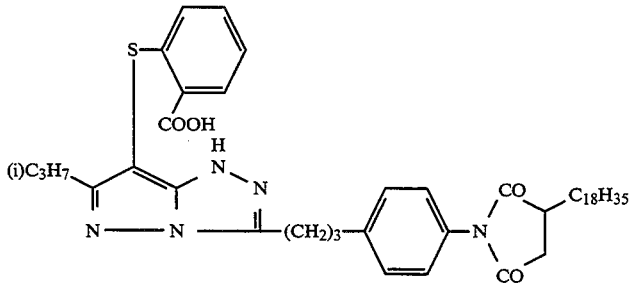
(M-28)
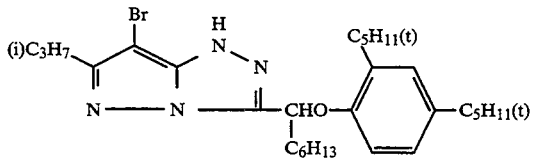
(M-29)
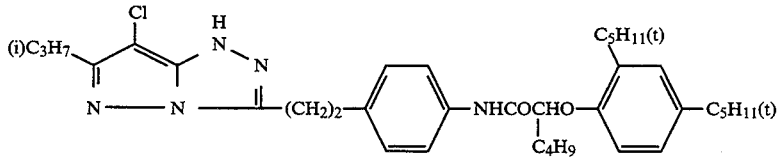

-continued
(M-30)
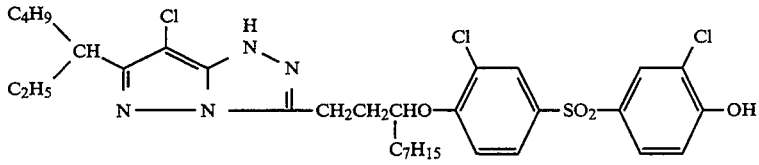
(M-31)
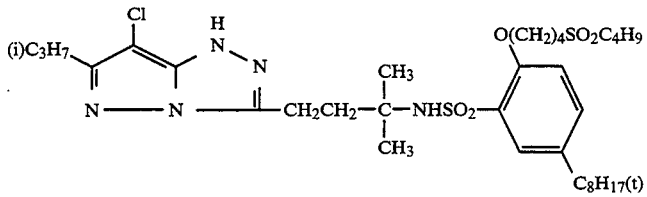
(M-32)
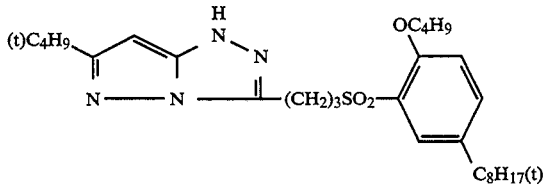
(M-33)
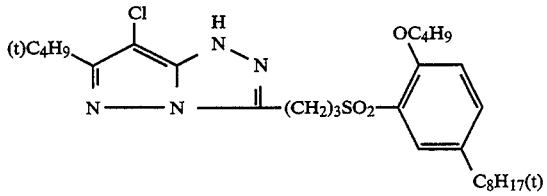
(M-34)
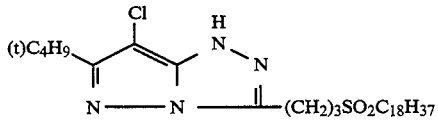
(M-35)
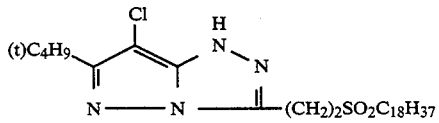
(M-36)
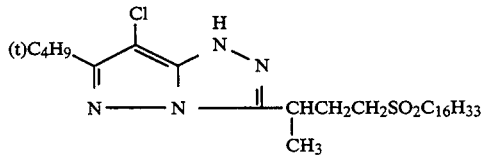
(M-37)
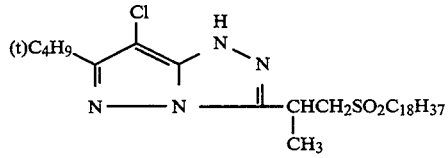
(M-38)
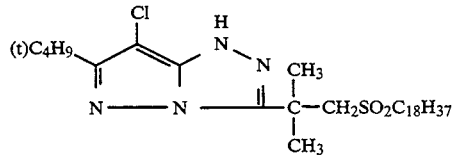

-continued
(M-39)
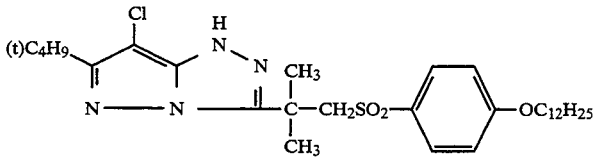
(M-40)
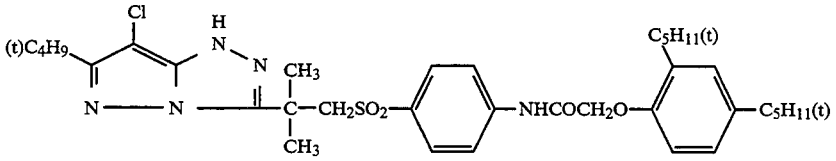
(M-41)
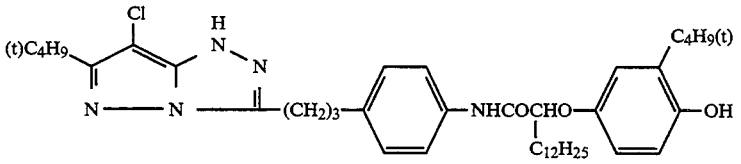
(M-42)
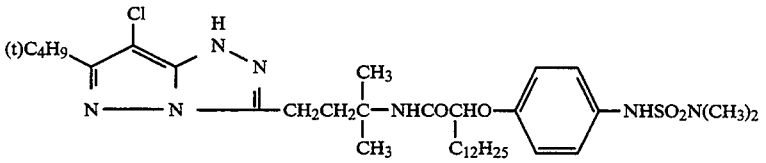
(M-43)
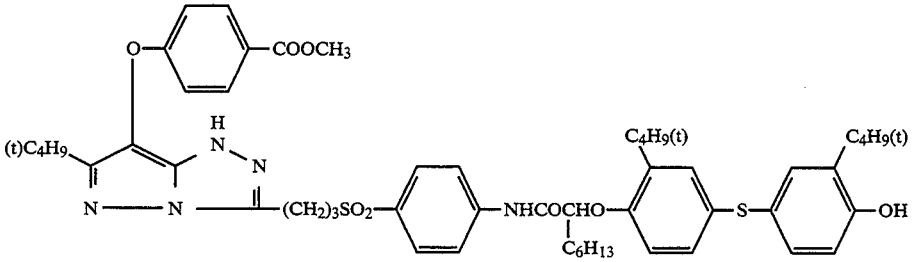
(M-44)
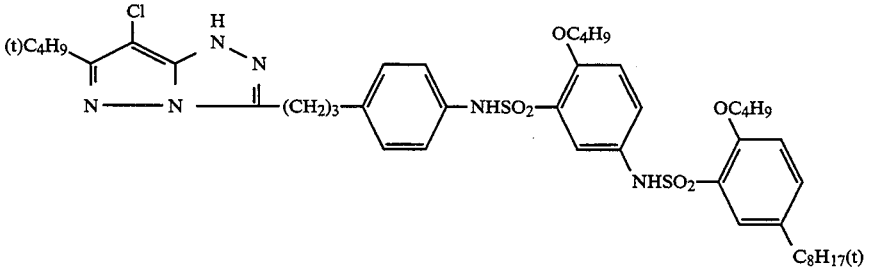
(M-45)
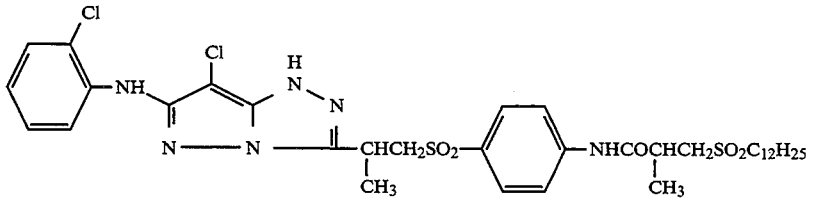
(M-46)
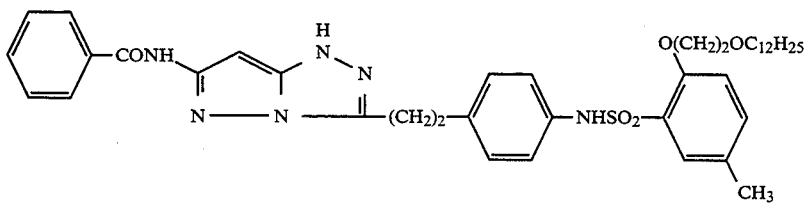

-continued
(M-47)
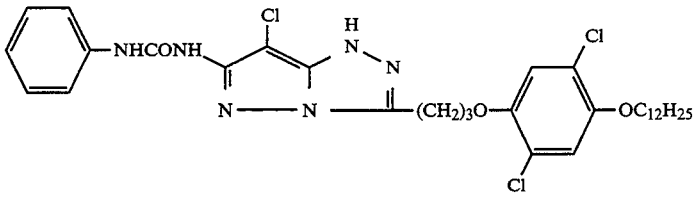
(M-48)
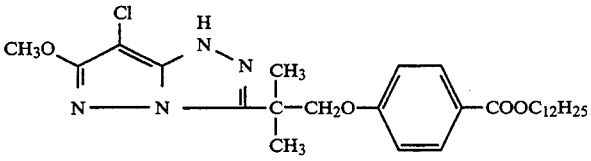
(M-49)
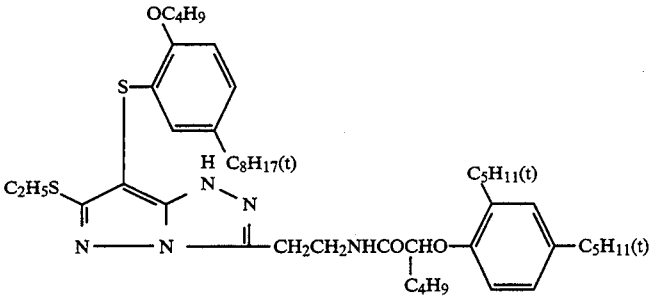
(M-50)
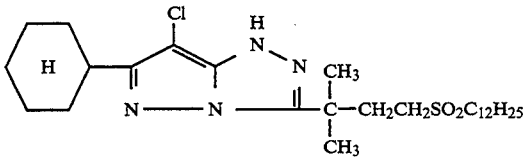
(M-51)
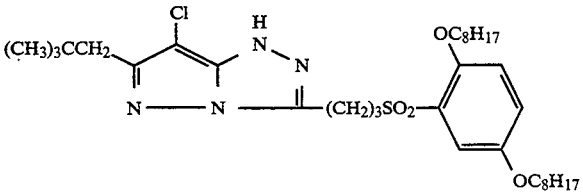
(M-52)
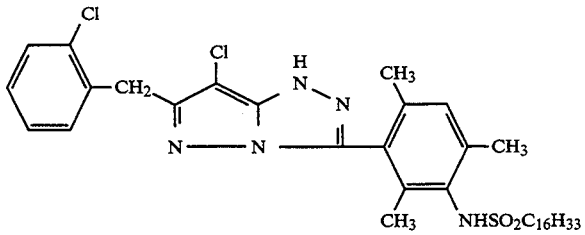
(M-53)
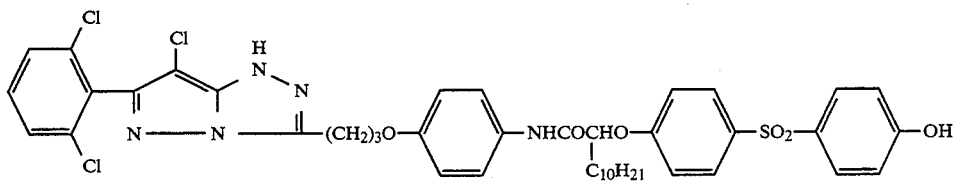

-continued
(M-54)
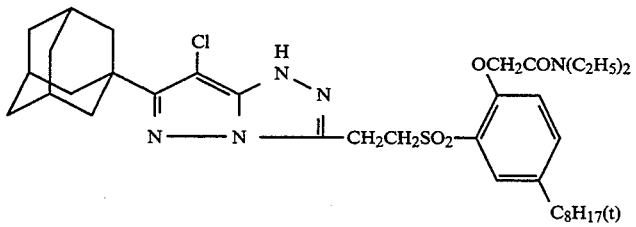
(M-55)
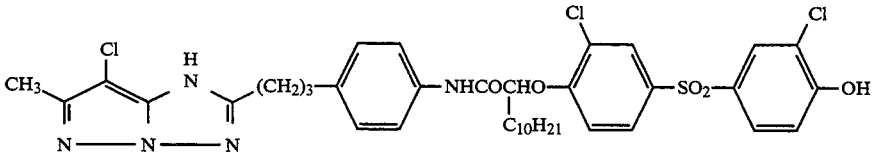
(M-56)
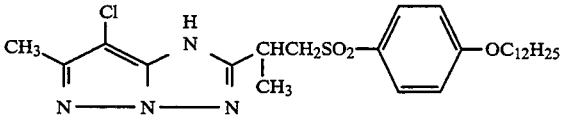
(M-57)
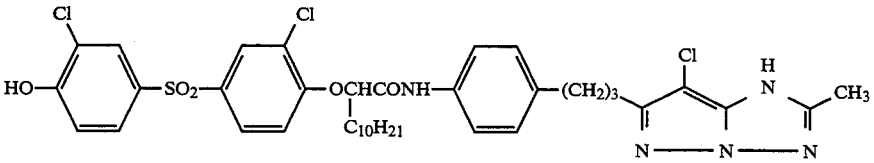
(M-58)
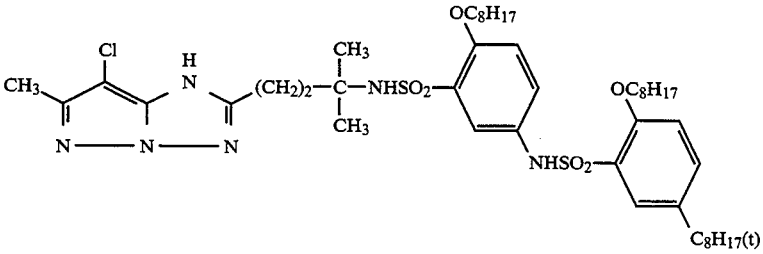
(M-59)
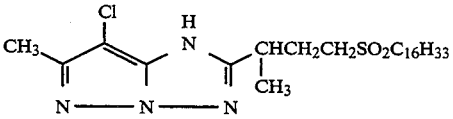
(M-60)
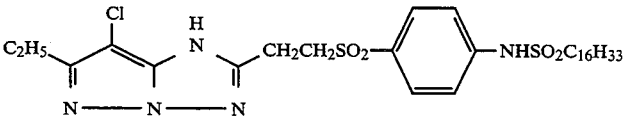
(M-61)
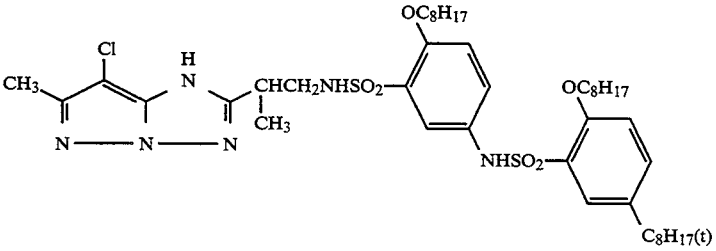
(M-62)
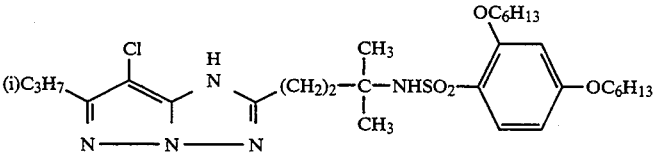

-continued
(M-63)
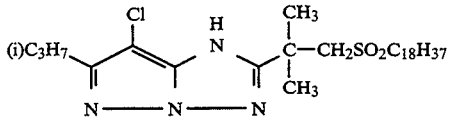
(M-64)
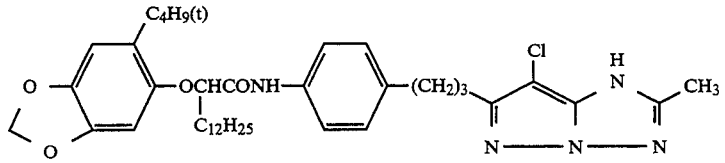
(M-65)
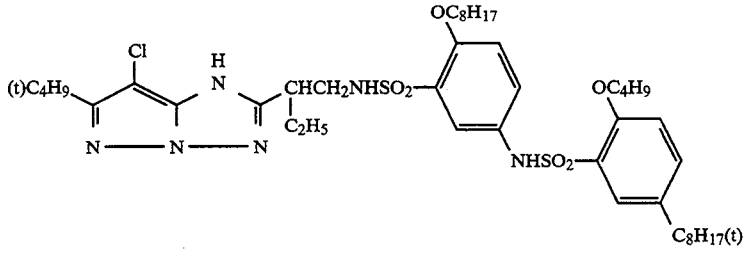
(M-66)
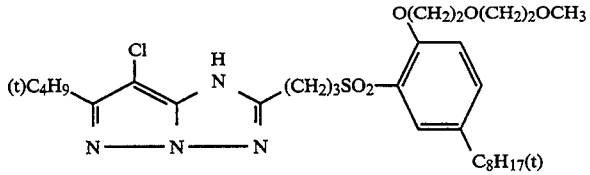
(M-67)
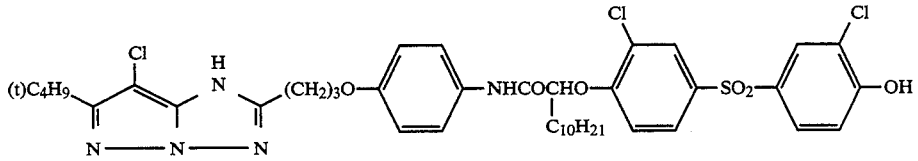
(M-68)
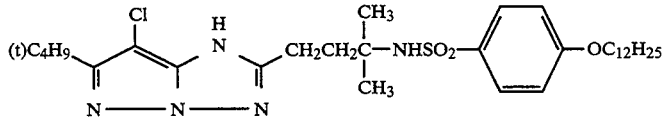
(M-69)
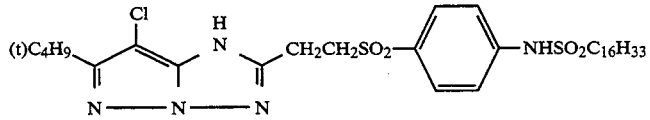
(M-70)
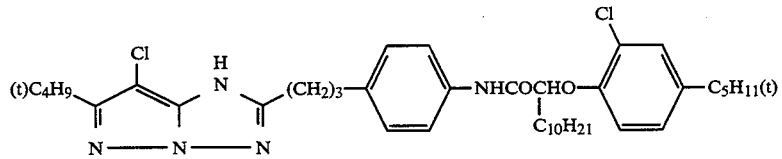
(M-71)
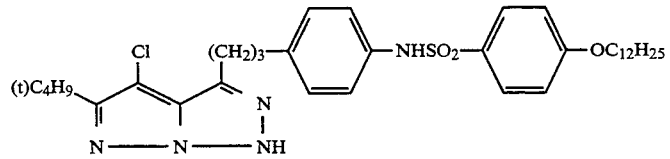

-continued
(M-72)
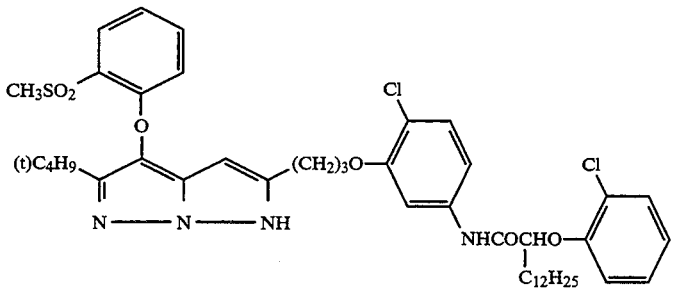
(M-73)
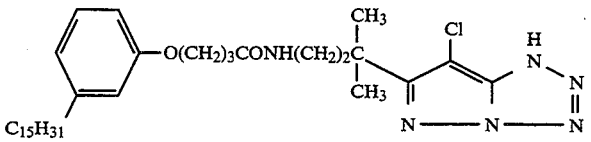
(M-74)
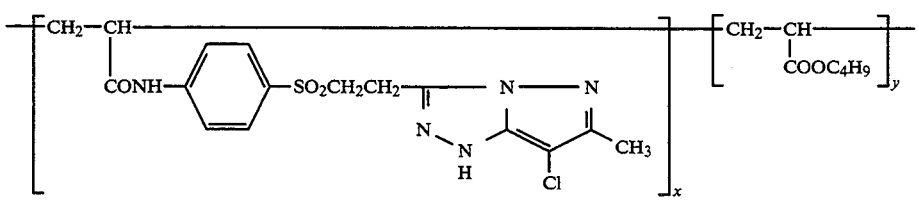
x:y = 50:50
(M-75)
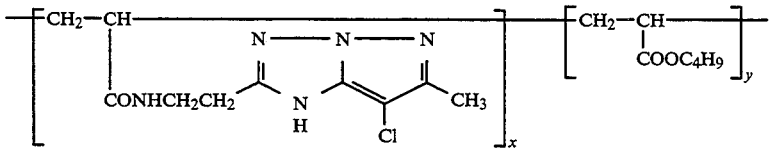
x:y = 50:50
(M-76)
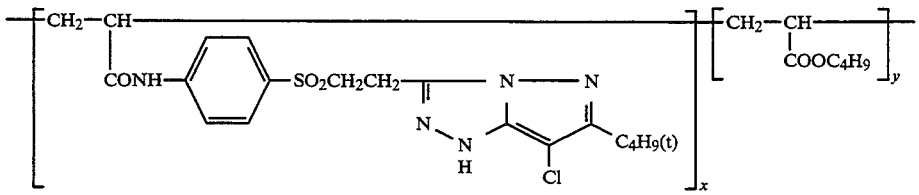
x:y = 50:50
(M-77)
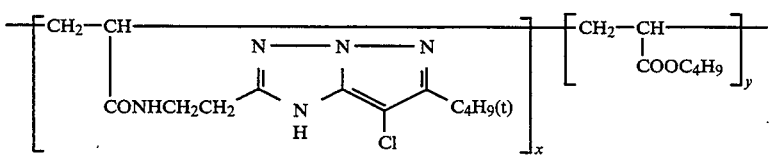
x:y = 50:50
Examples also include Compound Nos. 1–4, 6, 8–17, 19–24, 26–43, 45–59, 61–104, 106–121, 123–162 and 164–223 disclosed in the specification for Japanese Patent O.P.I. Publication No. 166339/1987, pp. 66–122.
The above couplers can be synthesized in accordance with the Journal of the Chemical society, Perkin I (1977), pp. 2047–2052, U.S. Pat. No. 3,725,067, Japanese Patent O.P.I. Publication Nos. 99437/1984, 42045/1983, 162548/1984, 171956/1984, 33552/1985, 43659/1985, 172982/1985 and 190779/1985 and others.

The above couplers and normally used at $1\times10^{-3}$ to 1 mol per mol silver halide, preferably at $1\times10^{-2}$ to $8\times10^{-1}$ mol per mol silver halide.

The above couplers may be used in combination with other magenta couplers.

A preferable yellow coupler to be contained together in the magenta forming layer with the magenta coupler is represented by the following formula (Y-I).

Of the couplers of Formula (Y-I), those having a pka value not lower by 3 or more than that of the coupler of Formula (M-I) used in combination therewith are especially preferable.

In formulas (Z-3) and Z-4), the anti-diffusion represented by $Y_1$ is preferably an aliphatic group containing not less than 10 carbon atoms or an aromatic group having one or more substituents provided that carbon atoms containing said substituents is not less than 10 in total; and the water-solubilizing group represented by $Y_1$ is preferably a carboxyl group, a sulfo group, a hydroxyl group or a sulfonamideo group.

Among the groups represented by the above formulas (Z-3) or (Z-4), the following groups represented by the following formulas (Z-16) through (Z-22) are preferable:

Formula (Z-16)

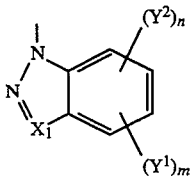

Formula (Z-17)

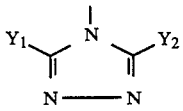

Formula (Z-18)

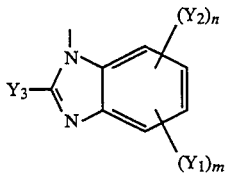

Formula (Z-19)

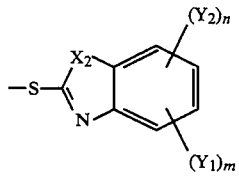

Formula (Z-20)

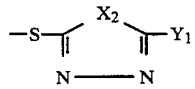

Formula (Z-21)

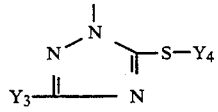

-continued

Formula (Z-22)

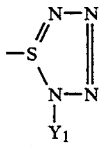

wherein $X_1$ is =N— or a

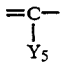

group $X_2$ is an oxygen atom, a sulfur atom or

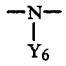

group; $Y_2$, $Y_5$ and $Y_6$ each is a hydrogen atom or a substituent; $Y_3$ and $Y_4$ each s a hydrogen atom or a substituent provided at least one of $Y_3$ and $Y_4$ is an antidifusion group or a solubilizing group; m is an integer of 1 to 4 and n is an integer of zro to 4. Examples of the groups represented by formula (Z-3) or (Z-4) are given below:

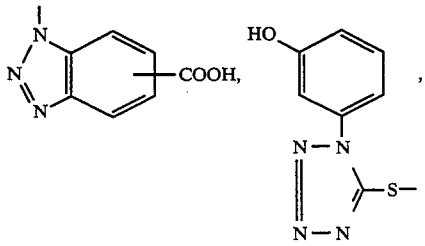

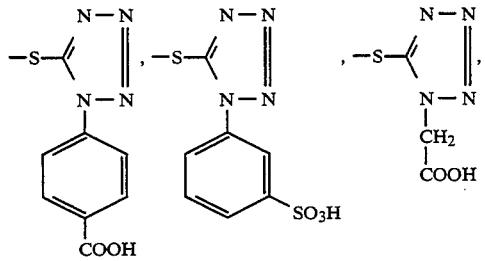

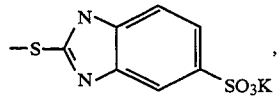

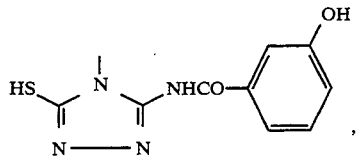

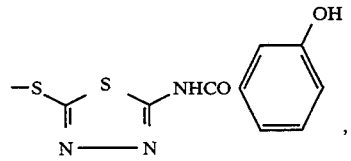

-continued

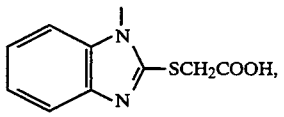

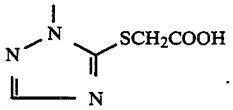

And example of the groups represented by formulas (Z-5) through (Z-11) are as follows:

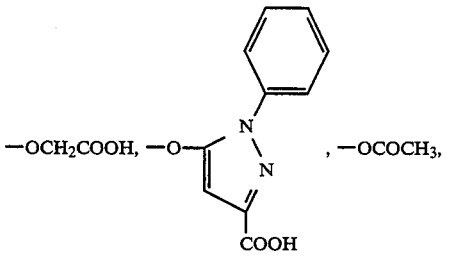

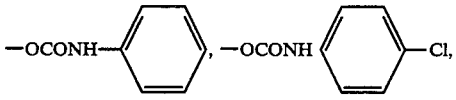

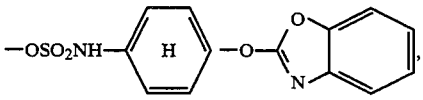

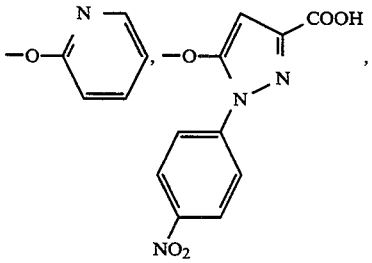

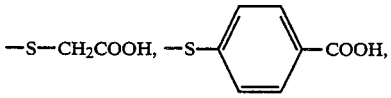

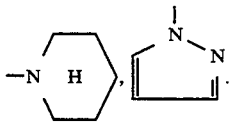

In the above "substantially does not inhibit color development" means that an yellow coupler having a group represented by $Z_2$ has a gamma variation ratio of not more than 0.1. The gamma variation ratio is determined by the following method.

(1) Preparation of the standard sample

Into 150 ml of ethyl acetate 60 g of yellow coupler represented by the following formula (YS) and 20 g of tricresil phosphate are aded and dissolved. The solution is mixed with 1 liter of 5% aqueous solution of gelatin containing 10 ml of 5% aqueous solution of Alkanol B (alkyl naphthalenesulfonate, made by du Pont Co.) and dispersed for making a dispersion using an ultrasonic disperser. The dispersion thus obtained is added to a silver iodobromide emulsion containing 6 mol % of silver iodide so that the amount of the yellow coupler is 0.3 mol per mol of silver in the emulsion. To the emulsion 1.2 g of 1,2-bis(vinylsulfonyl)ethane is added per gram of gelatin as a hardner. The emulsion is coated on a transparent cellulose acetate film in an amount of 2 g per sq. meter in terms of silver.

(YS)

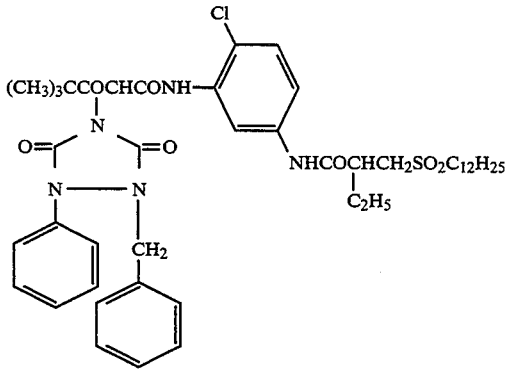

<Processing procedure>

| Processin step (at 38° C.) | Processing time |
|---|---|
| Color development | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |

| | |
|---|---|
| <Color developer> | |
| 4-amino-3-methyl-N-ethyl-N-(β-hydroxyethyl) aniline sulfate | 4.75 g |
| Sodium sulfite, anhydride | 4.25 g |
| Hydroxylamine 1/2 sulfate | 2.0 g |
| Sodium carbonate, anhydride | 37.5 g |
| Potassium bromide | 1.3 g |
| Trisodium nitrilotriacetate, monohydride | 2.5 g |
| Sodium hydroxide | 1.0 g |
| Water to make | 1 liter |
| Adjust pH to 10.0 with sodium hydroxide | |
| <Bleaching solution> | |
| Ferric ammonium ethylenediaminetetraacetate | 100 g |
| Diammonium ethylenediaminetetraacetate | 10 g |
| Potassium bromide | 150 g |
| Glacial acetic acid | 10 ml |
| Wter to make | 1 liter |
| Adjust pH to 6.0 with ammonia water | |
| <Fixing solution> | |
| Sodium thiosulfate, 50% aqueous solution | 162 ml |
| Sodium sulfite, anhydride | 12.4 g |
| Water to make | 1 liter |
| Adjust pH to 6.5 with acetic acid | |
| <Stabilizing solution> | |
| Formalin, 37% aqueous solution | 5.6 ml |
| Koniducks (Product of Konica) | 7.5 ml |
| Water to make | 1 liter |

The processed samples each is subjected to densitometry with red light by Konica Densitometer PDA-65 and a chracteriastics curve thereof is drawn. The gamma value is determined by the gradient of the line connecting the points of the density of 0.3 and 0.8 on the characteristic curve. The gamma variation ratio $\gamma v$ is defined by the following equation, in which $\gamma t$ is the gamma value of the sample containing the coupler to be tested and $\gamma s$ is the gamma value of the standard sample.

$\gamma v=(\gamma t-\gamma s)\gamma s$

The yellow coupler used in the invention should have a γv value of not more than 0.1, preferably not more than 0.02.

Examples of the yellow coupler used for the present invention are given below.

Formula (Y-I)

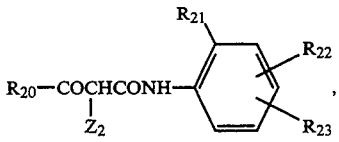

wherein $R_{20}$ is an alkyl group or a phenyl group; $R_{21}$ is a halogen atom or an alkoxy group; $R_{22}$ is a hydrogen atom. A halogen atom or an alkoxy group which is allowed to have a substituent; $R_{23}$ is an acylamino group, an alkoxycarbonyl group, a carbamoyl group, an alkylsulfamoyl group, an arylsulfamoyl group, an arylsulfonamido group, an alkylureido group, an arylureido group, a succinimido group, an alkoxy group or a aryloxy group, provided that these groups are allowed to have substitutent; $Z_2$ is a hydrogen atom, a halogen atom or a substituent which is capable of splitting off upon reaction with the oxidation product of a color developing agent and essentially does not inhibit color development after split off from the coupler. The group represented by $R_{20}$ is preferably a tertiary butyl group.

The substituent represented by $Z_2$ is preferably selected from the groups represented by the following formulas (Z-1), (Z-2), (Z-3), (Z-4), (Z-5), Z-6), (Z-7), (Z-8), (Z-9), (Z-10) and (Z-11).

Formula (Z-1)

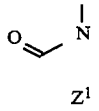

wherein $Z^1$ is a group of non-metal atoms necessary for completing a five- or six-member ring.

Formula (Z-2)

—O—Ar wherein Ar is an aryl group which may have a substituent which substantially dose not inhibit color development.

Formula (Z-3)

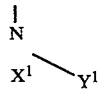

wherein $X^1$ is a nitrogen-containing aromatic heterocyclic ring which may be condensed with a benzene ring and $Y^1$ is an anti-diffusion group or a water-solubilizing group.

Formula (Z-4)

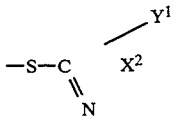

wherein $X^2$ is a nitrogen-containing aromatic heterocyclic ring which may be condensed with a benzene ring and $Y^1$ is an anti-diffusion group or a water-solubilizing group.

The above formulas 3 and 4 the anti-diffusion group is an organic group to increase the volume of the splitting off group so that diffusion of the group after splitting off from the coupler is prevented. The anti-diffusion group is preferably an aliphatic having 10 or more carbon atoms or an aromatic broup having 10 or more carbon atoms including the carbon atoms of a substituent linked to the aromatic group. These organic groups may contain an ether bond, amido bond, ureido bond, thioether bond ester bond or sulfonamido bond. The water solubilizing group is a group to make the splitting off group to water soluble after splitting off from the coupler. Preferable water solubilizing group includes a carboxyl group, sulfo group, hydroxyl group and sulfonamido group.

Formula (Z-5)

$—O—R_{24}$ wherein $R_{24}$ is an alkyl group, a heterocyclic group, an actyl group of a carbamoyl group.

Formula (Z-6)

$—S—R_{25}$ wherein $R_{25}$ is an alkyl group or an aryl group.

Formula (Z-7)

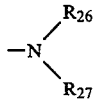

wherein $R_{26}$ is a hydrogen atom, an alkyl group an aryl group or a heterocyclic group; and $R_{27}$ is an alkyl group, an acyl group of a sulfonyl group, $R_{26}$ and $R_{27}$ may be bonded to for a saturated ring.

Formula (Z-8)

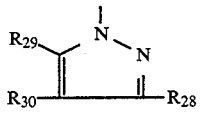

Formula (Z-9)

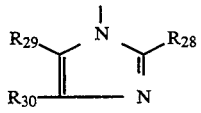

Formula (Z-10)

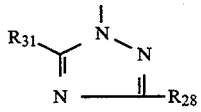

Formula (Z-11)

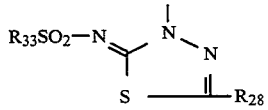

in formulas (Z-8 to (Z-11), $R_{28}$, $R_{29}$ and $R_{30}$ are each a hydrogen atom or a substituent, provided that $R_{29}$ and $R_{30}$ may be bonded with each other for forming a ring, $R_{31}$ is a hydrogen atom, an alkyl group, an aryl group, an acylamino group, a sulfonamide group, or a halogen atom, and $R_{32}$ is an alkyl group, an aryl group or a heterocyclic group.

Among the group represented by formula (Z-1), a group represented by the following formula (Z-12), (Z-13) or (Z-14) is a preferables:

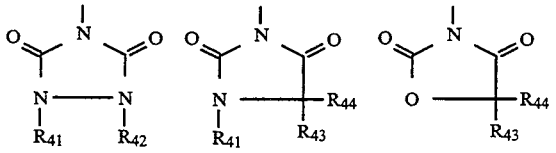

wherein $R_{41}$ and $R_{42}$ are each a hydrogen atom, an alkyl group or an aryl group; and $R_{43}$ and $R_{44}$ are each a hydrogen atom, an alkyl group or an alkoxy group.

The group represented by formula (Z-2) is preferably a group represented by the following formula (Z-15);

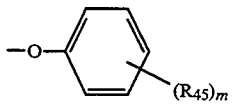

wherein $R_{45}$ is a substituent; and m is an integer of 0 to 5.

As examples of the group represented by the above-mentioned represented by formula (Z-1) or (Z-2), the following groups may be given:

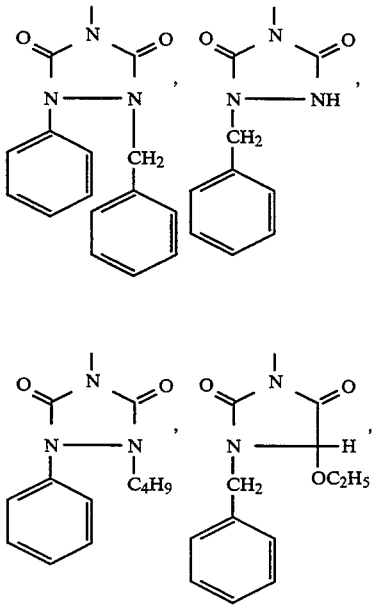

-continued

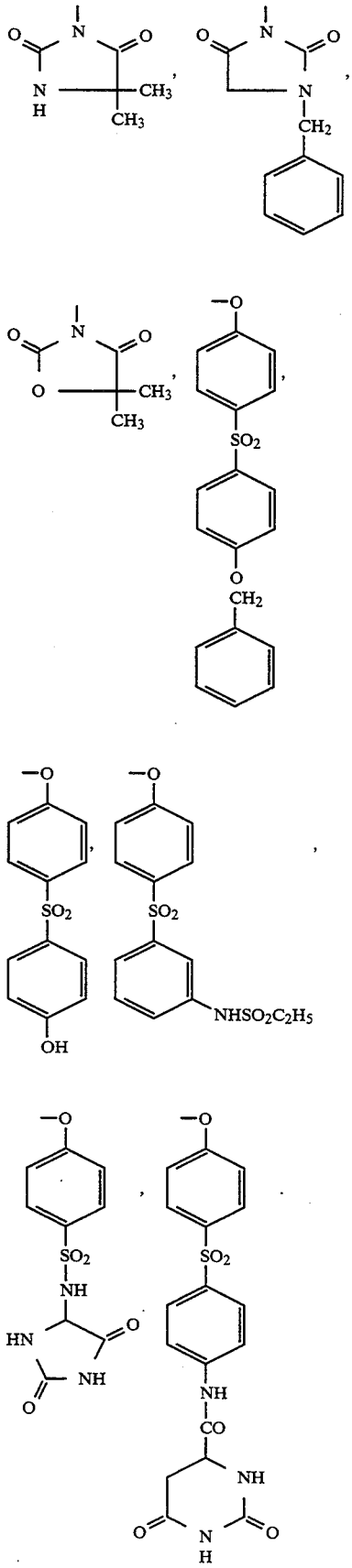

(Y-1)
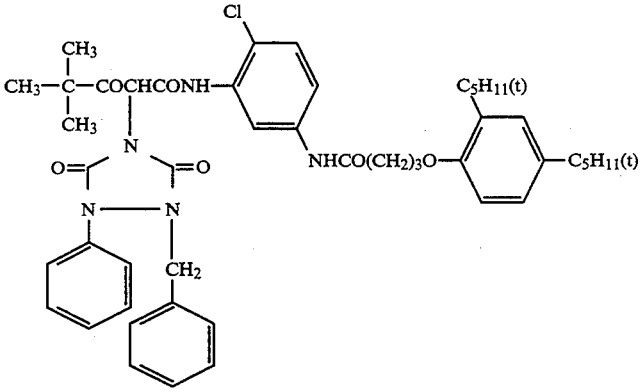
(Y-2)
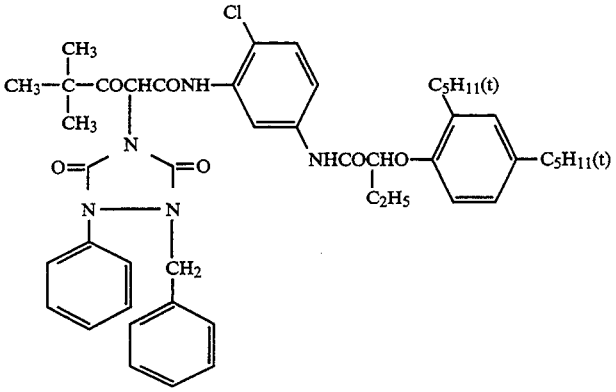
(Y-3)
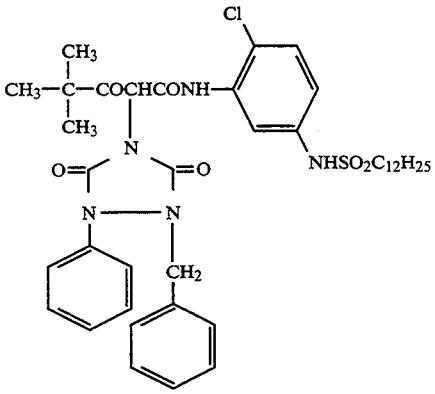
(Y-4)
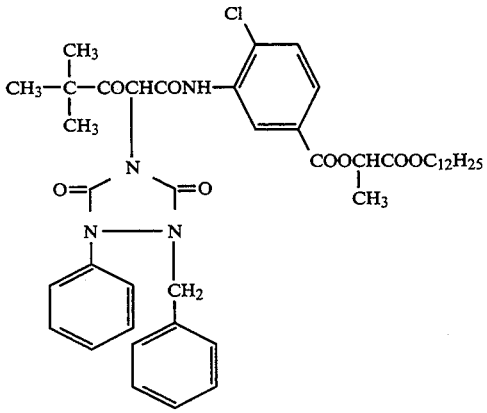

-continued
(Y-5)
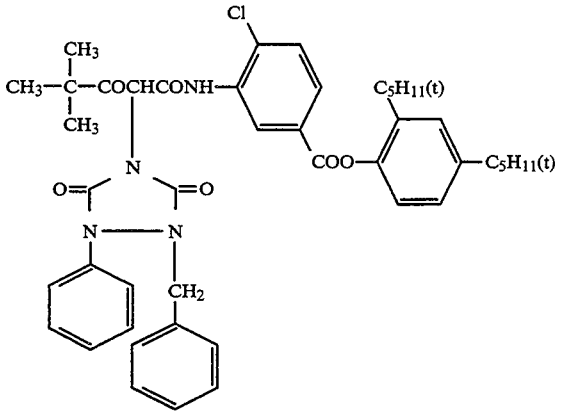
(Y-6)
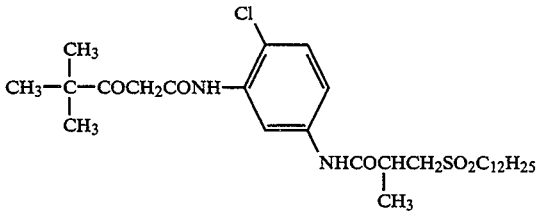
(Y-7)
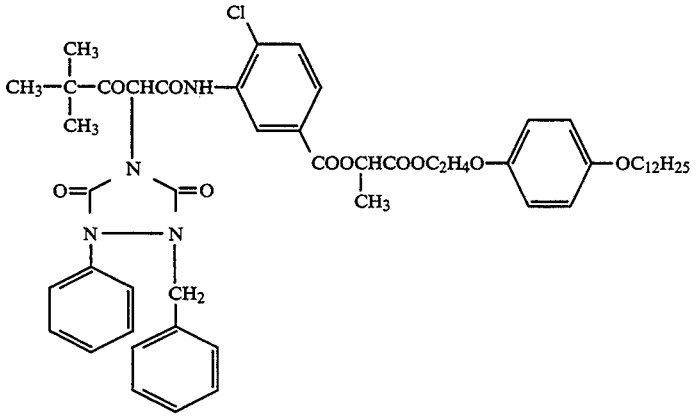
(Y-8)
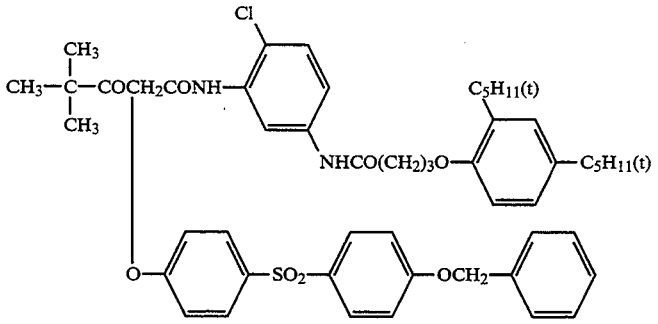
(Y-9)
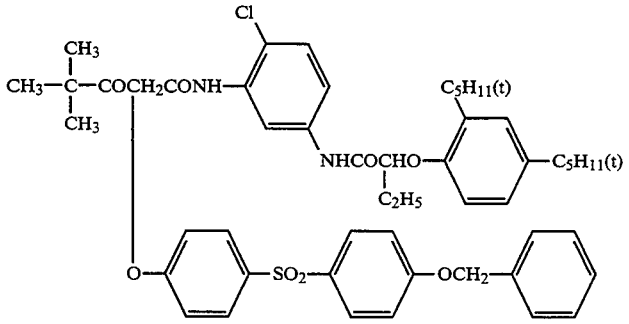

-continued
(Y-10)
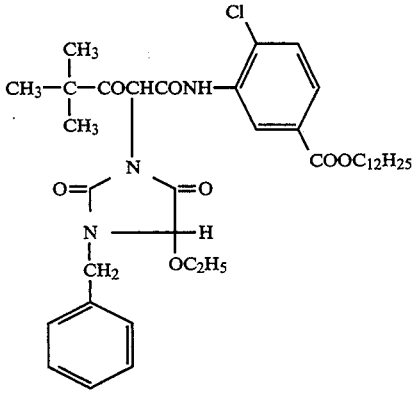
(Y-11)
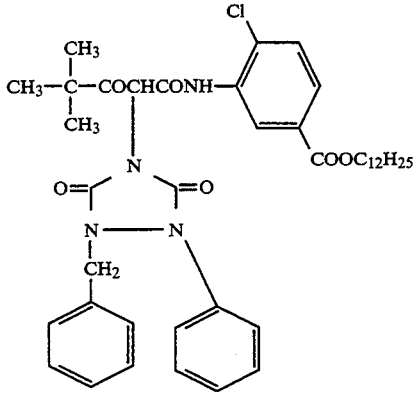
(Y-12)
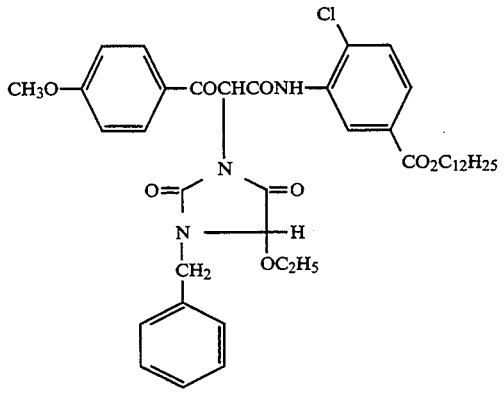
(Y-13)
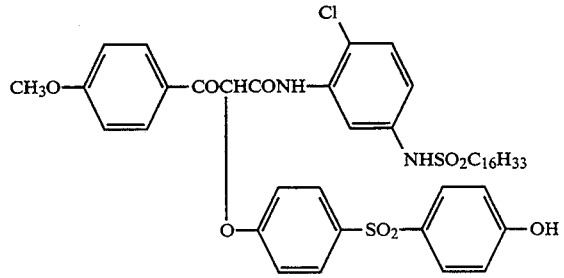

-continued
(Y-14)
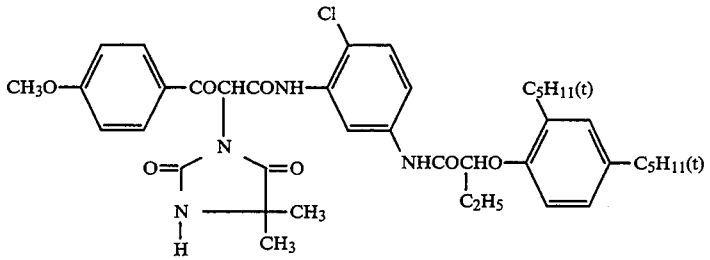
(Y-15)
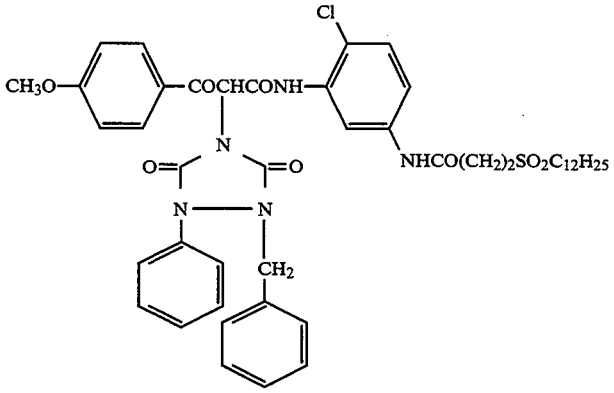
(Y-16)
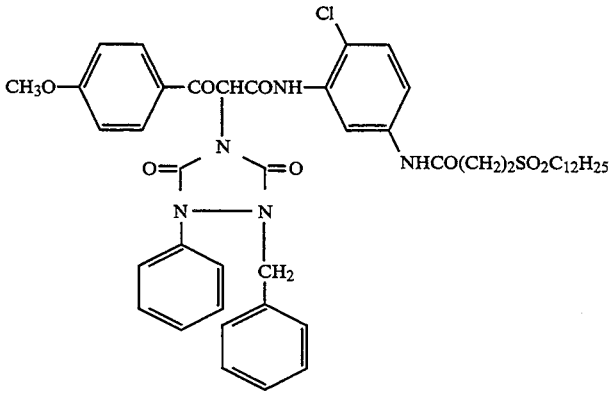
(Y-17)
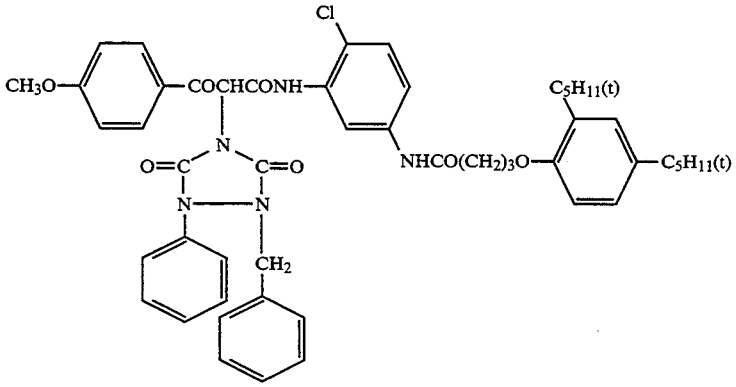

-continued
(Y-18)
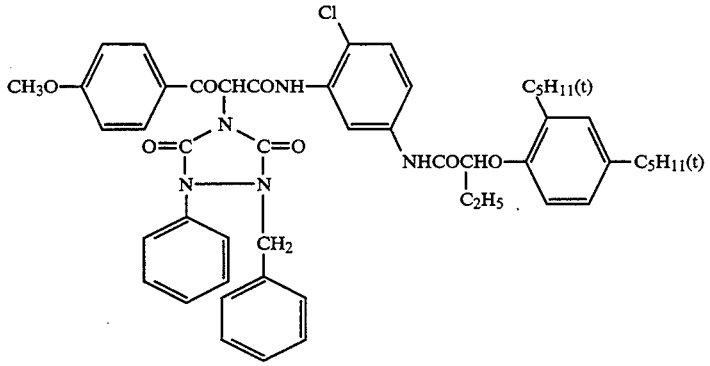
(Y-19)
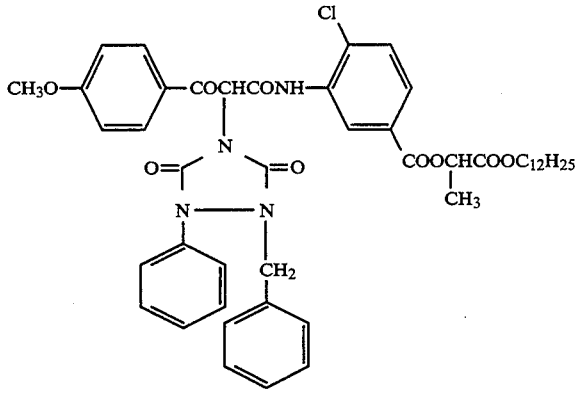
(Y-20)
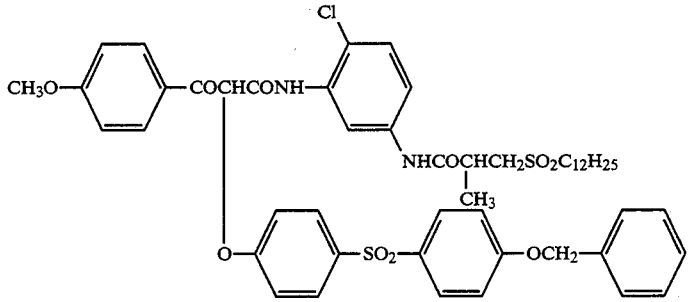
(Y-21)
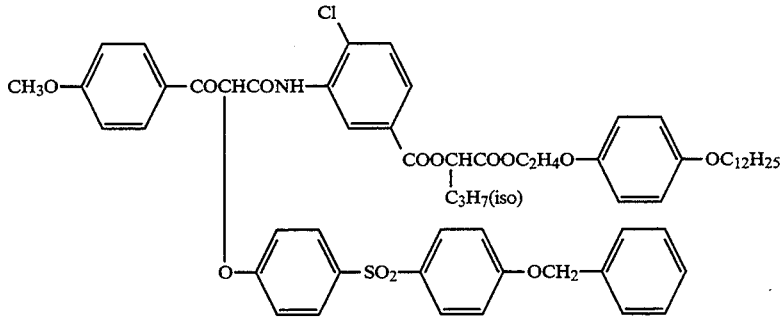
(Y-22)
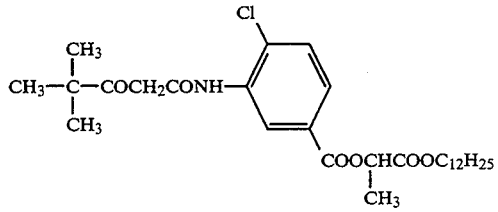

-continued
(Y-23)
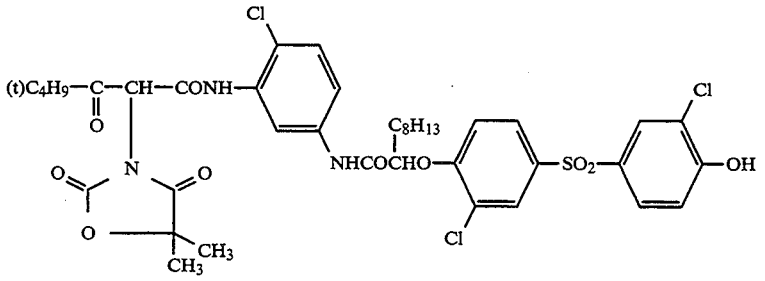
(Y-24)
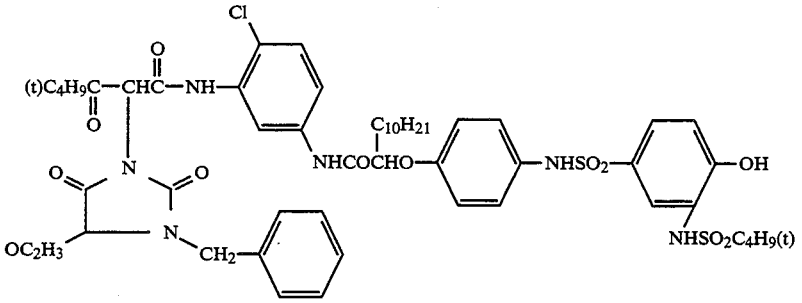
(Y-25)
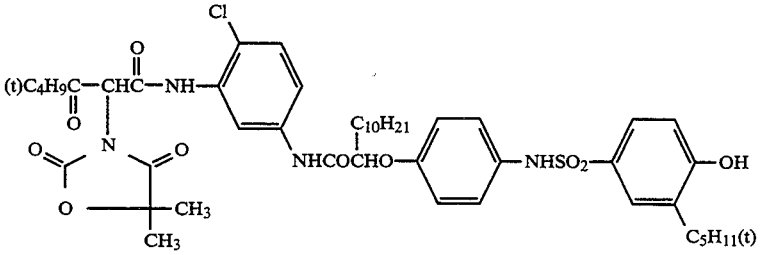
(Y-26)
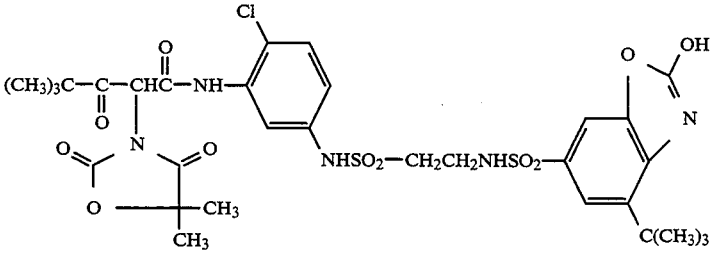
(Y-27)
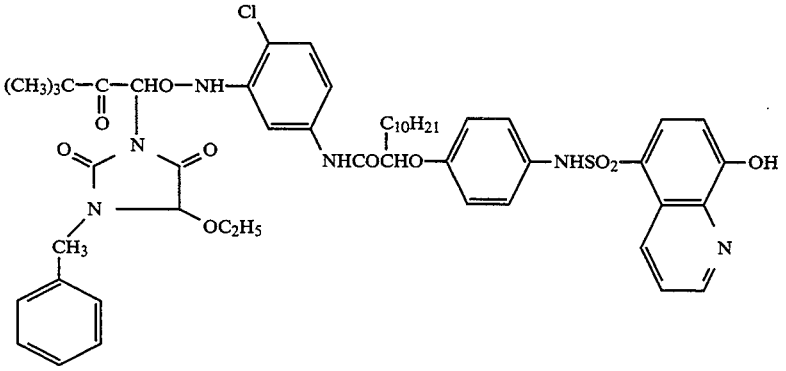

-continued
(Y-28)
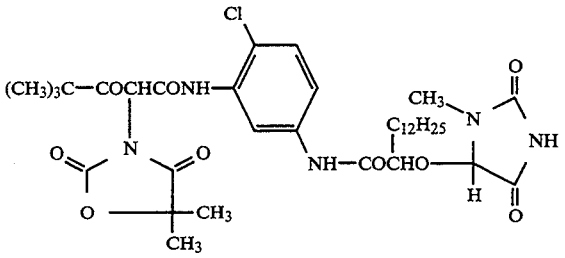
(Y-29)
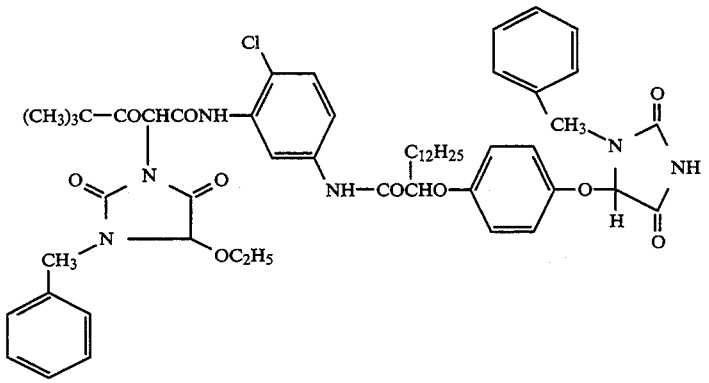
(Y-30)
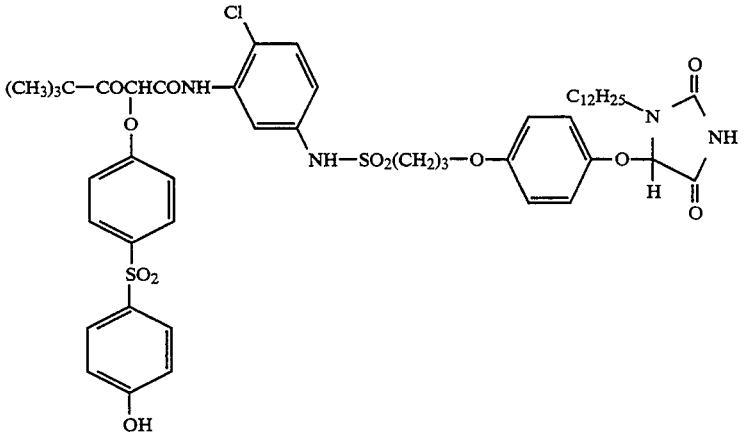
(Y-31)
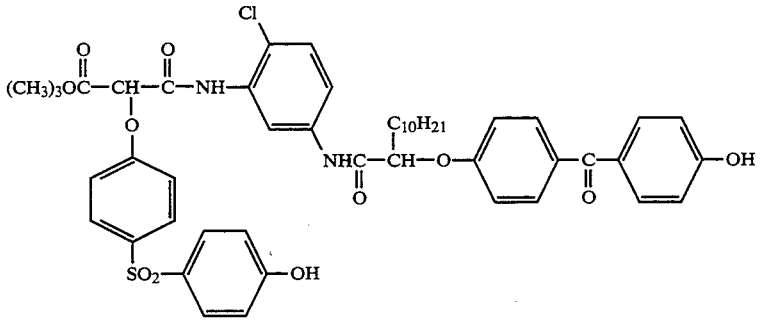
(Y-32)
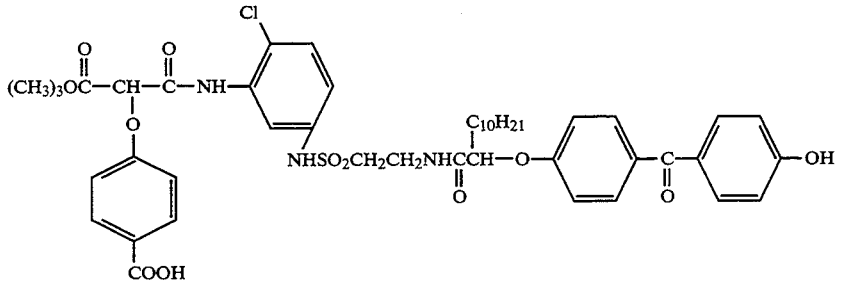

-continued
(Y-33)
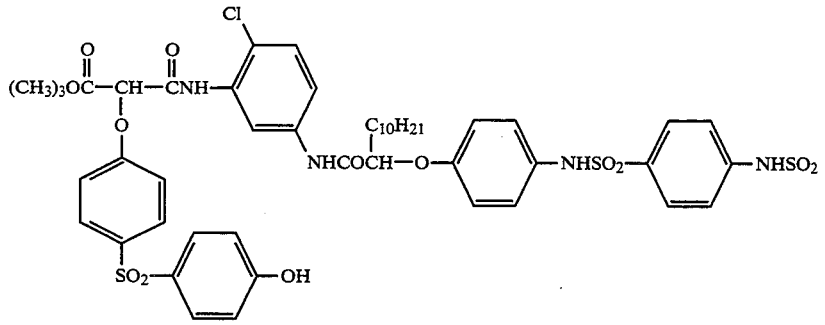
(Y-34)
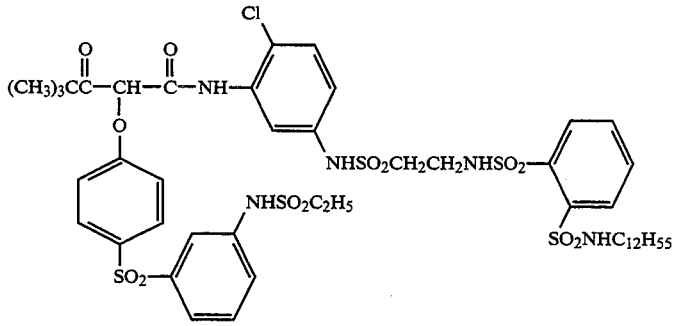
(Y-35)
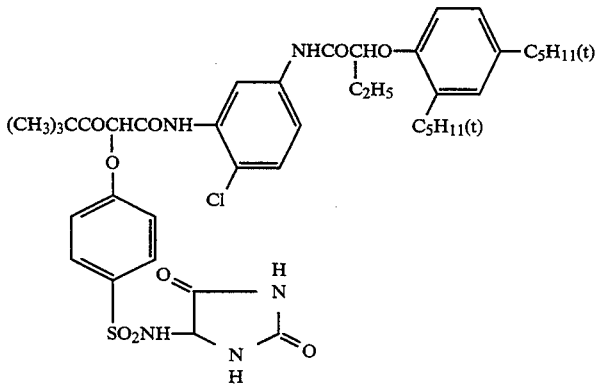
(Y-36)
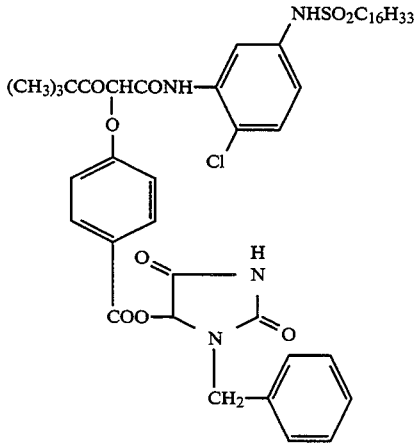

-continued
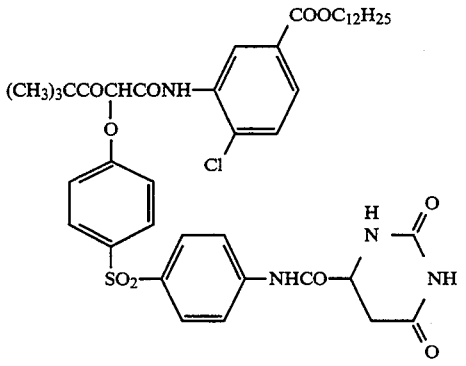
(Y-37)
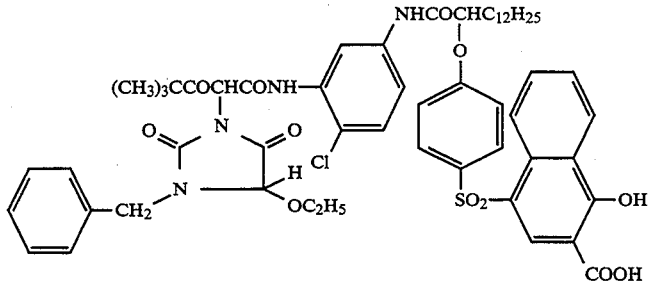
(Y-38)
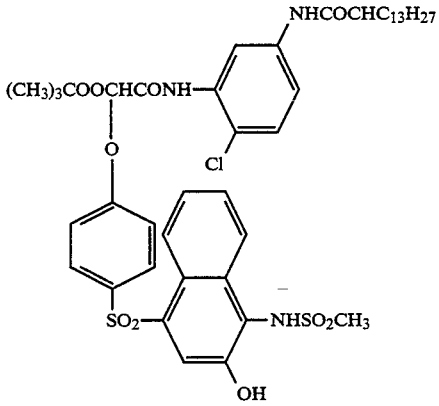
(Y-39)
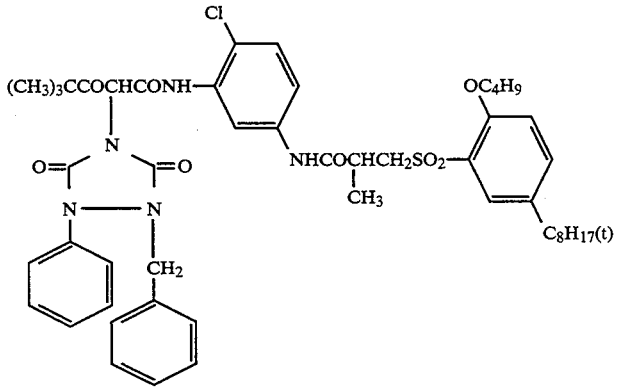
(Y-40)

-continued
(Y-41)
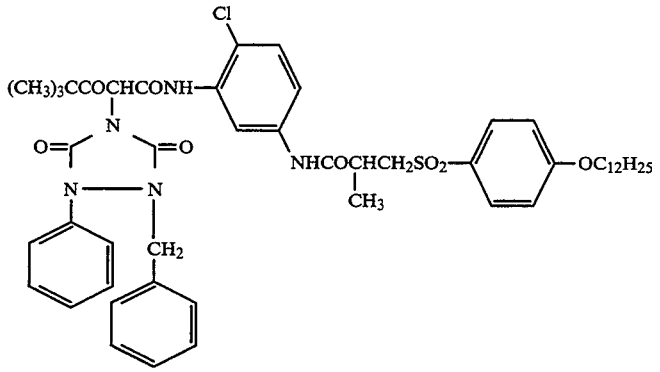
(Y-42)
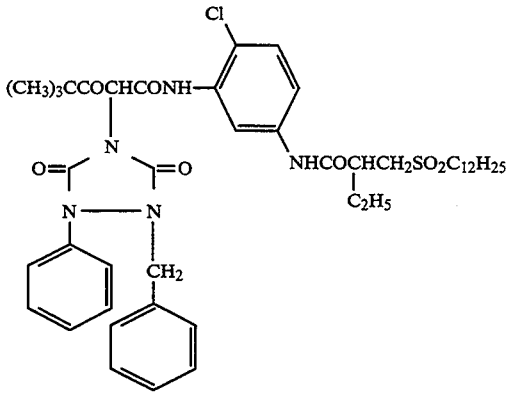
(Y-43)
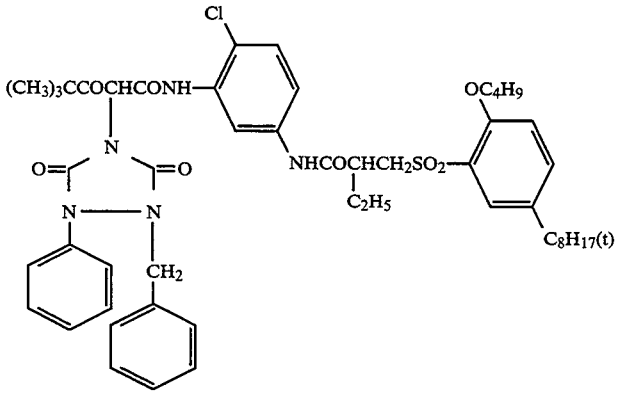
(Y-44)
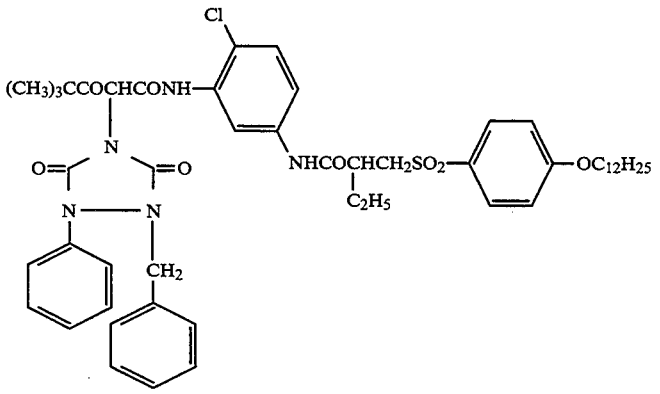

-continued
(Y-45)
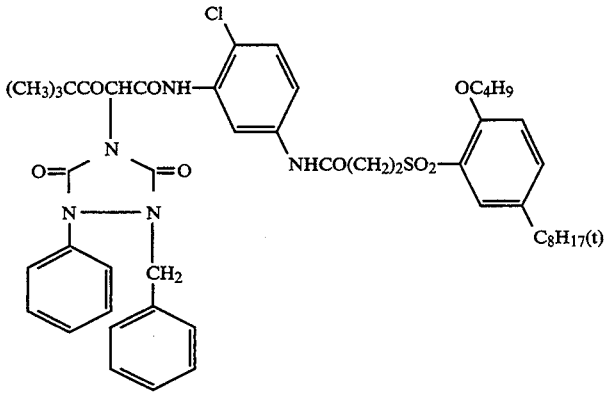
(Y-46)
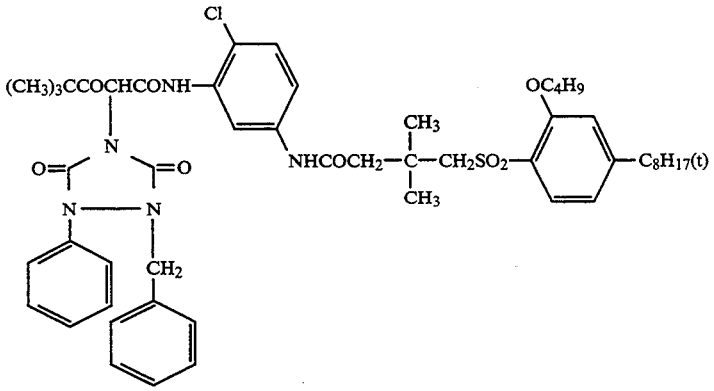
(Y-47)
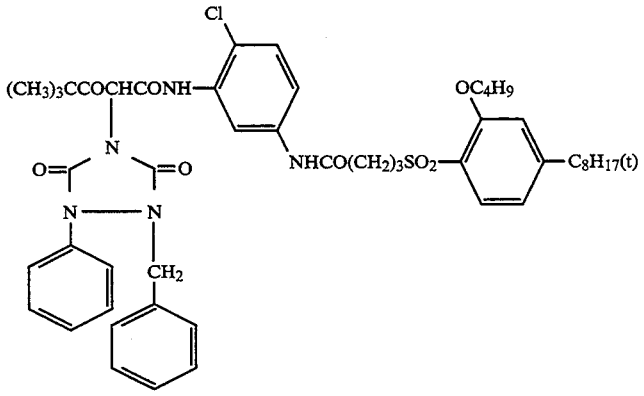
(Y-48)
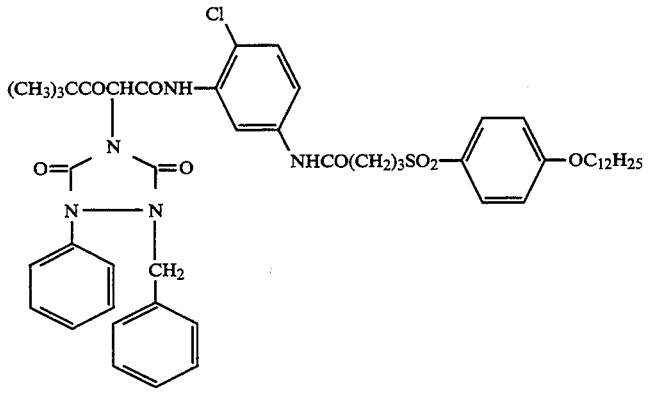

-continued
(Y-49)
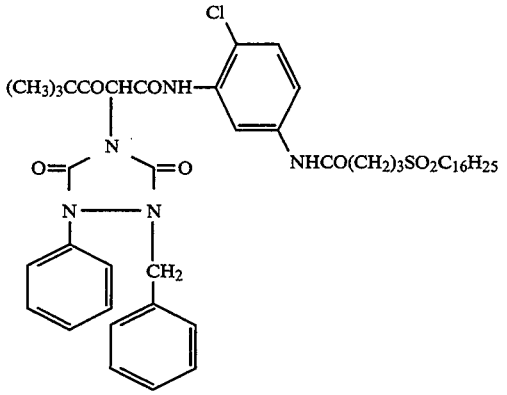
(Y-50)
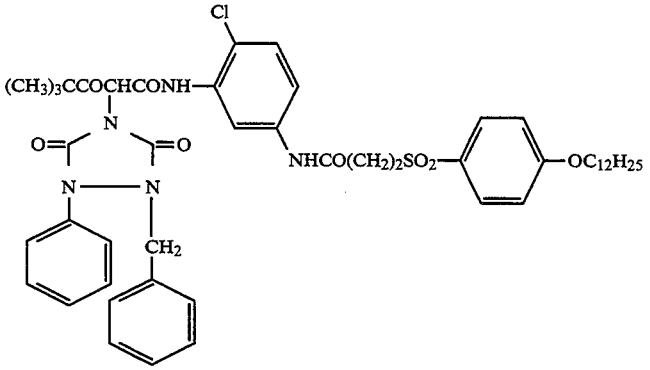
(Y-51)
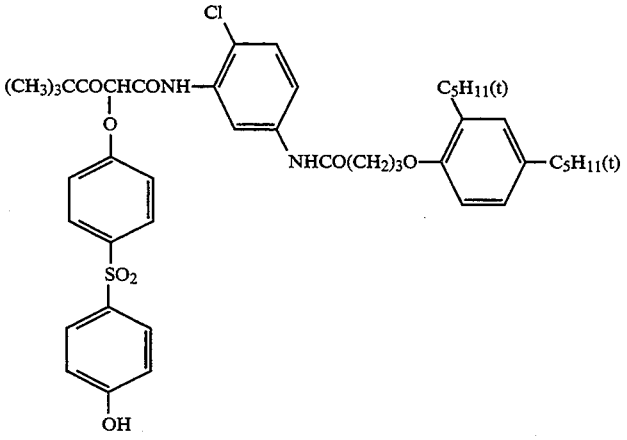
(Y-52)
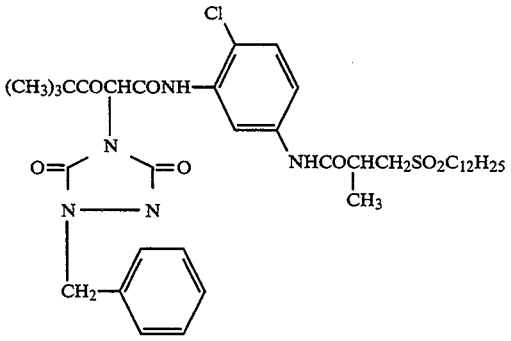

-continued
(Y-53)
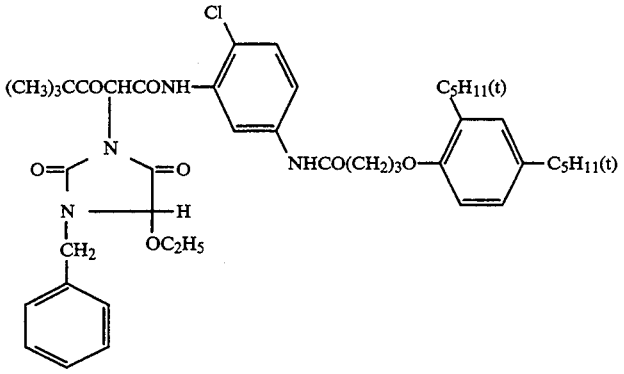
(Y-54)
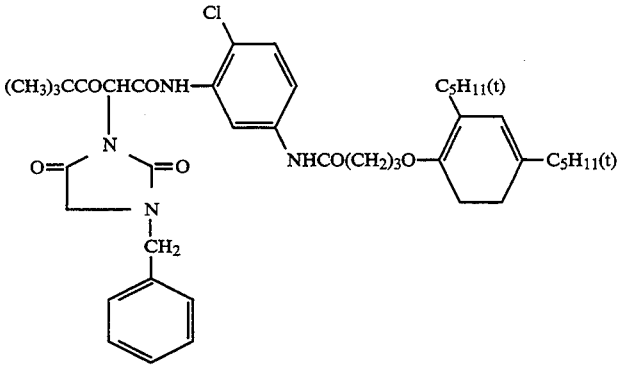
(Y-55)
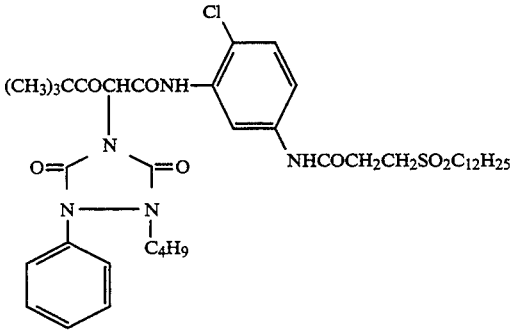
(Y-56)
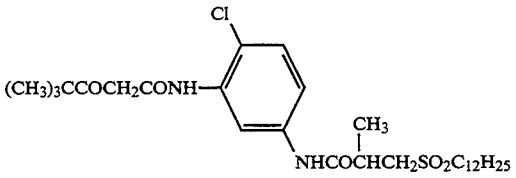
(Y-57)
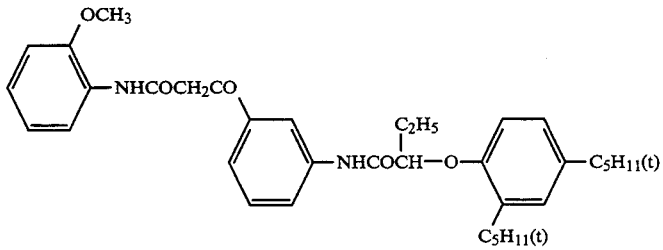

-continued (Y-58)

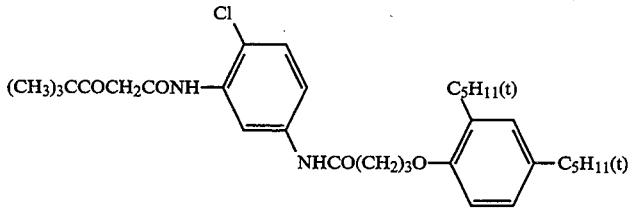

The content of the magenta and yellow couples in the magenta image forming layer of the silver halide color photographic light sensitive material of the present invention may be determined so that the spectral absorption of the dye images obtained by color development of the magenta image forming layer approximates to the spectral absorption of printing images obtained with magenta printing inks. Specifically, it is normally appropriate that the ratio be 0.02 to 0.5 mol yellow coupler per mol magenta coupler.

The above yellow couplers are also preferably used in the yellow image forming layer of the light-sensitive material of the present invention.

In the present invention, as the cyan coupler to be contained in the cyan image forming layer, a phenol- or naphthol-based cyan dye forming coupler is used.

Particularly, a coupler represented by the following formula (C-I) or (C-II) is preferably used.

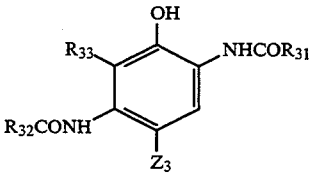

Formula (C-I)

wherein $R_{31}$ represents an aryl group, cycloalkyl group or heterocyclic group. $R_{32}$ represents an alkyl group or phenyl group. R33 represents a hydrogen atom, halogen atom, alkyl group or alkoxy group.

$Z_3$ represents a hydrogen atom or a group capable of splitting off by the reaction with the oxidized product of an aromatic primary amine-based color developing agent.

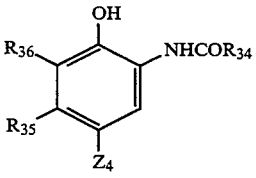

Formula (C-II)

wherein $R_{34}$ represents an alkyl group, e.g. methyl group, ethyl group, propyl group, butyl group, nonyl group. $R_{35}$ represents an alkyl group, e.g. methyl group, ethyl group. $R_{36}$ represents a hydrogen atom, halogen atom, such as fluorine, chlorine, bromine, or alkyl group, such as methyl group, ethyl group. $Z_4$ represents a hydrogen atom or a group capable of splitting off upon reaction with the oxidized product of an aromatic primary amine-based color developing agent.

These cyan couplers are described in the specifications for U.S. Pat. Nos. 2,306,410, 2,356,475, 2,362,596, 2,367,531, 2,369,929, 2,423,730, 2,474,293, 2,476,008, 2,498,466, 2,545,687, 2,728,660, 2,772,162, 2,895,826, 2,976,146, 3,002,836, 3,419,390, 3,446,622, 3,476,563, 3,737,316, 3,758,308 and 3,839,044, British Patent Nos. 478,991, 945,542, 1,084,480, 1,377,233, 1,388,024 and 1,543,040, and Japanese Patent O.P.I. Publication Nos. 37425/1972, 10135/1975, 25228/1975, 112038/1975, 117422/1975, 130441/1975, 6551/1976, 37647/1976, 52828/1976, 108841/1976, 109630/1978, 48237/1979, 66129/1979, 131931/1979, 32071/1980, 146050/1984, 31953/1984 and 117249/1985.

The couplers used for the present invention are normally used at $1\times10^{-3}$ to 1 mol, preferably $1\times10^{-2}$ to $8\times10^{-1}$ mol per mol silver halide in each silver halide emulsion layer.

These couplers may be added to the target hydrophilic colloid layer after being dissolved in a high boiling point organic solvent having a boiling point of over 150° C. in combination with a low boiling point and/or water-soluble organic solvent as needed, and emulsified dispersed in a hydrophilic binder such as an aqueous solution of gelatin using a surfactant. A process may be added to remove the low boiling point organic solvent after or simulateneously dispersion.

In the present invention, it is preferable that the ratio of the high and low boiling point organic solvents be 1:1 to 1:50, more preferably 1:1 to 1:20.

Any high boiling point organic solvent can be preferably used, as long as its dielectric constant is nor more that 6.0. Although there is no particular limitation on the lower limit, it is preferable that the dielectric constant be not less than 1.9. Examples of preferable substances include esters such as phthalates and phosphates having a dielectric constant of not more than 6.0, organic acid amides, ketones, alkylphosphine oxides, and hydrocarbons. Phthalates, alkylphosphine oxides and phosphates are more preferable. And alkylphosphine oxides and phosphates are most preferable. Dihexoxo-(i-propyl)oxophosphrous, docyclohexoxo-(2-ethylhexyl)-oxophosphorous, ethoxo butoxo-(dodecyl)-oxophosphorous, trioctyl phosphine oxide, trihexyl phosphine oxide, trihexyl phosphate, tri-(2-ethylhexyl)-phosphate, diethylhexyl phosphate, diethylhexadecyl phosphate, dihexyl 4-noylphenyl phosphate and trioctyl phosphate, can be cited as examples of these compound.

Silver halide emulsions used in the light sensitive layer of the silver halide color photographic light sensitive material of the present invention are hereinafter described.

The silver halide used in the silver halide emulsion for the present invention may be any one of silver halides used for ordinary silver halide emulsions, such as silver bromide, silver iodobromide, silver iodochloride, silver chlorobromide and silver chloride.

Silver halide grain composition may be uniform from inside to outside, or different between inside and outside. When grain composition differs between inside and outside, the compositional change may be successive or insuccessive. Althought silver halide grain size is not subject to any particular limitation, it is preferable, from the viewpoint of quick processing, sensitivity and other photographic aspects, that the grain size be 0.2 to 1.6 μm, more preferably 0.25 to 1.2 μm.

Silver halide grain size distribution may be mono- or polydispersible.

The silver halide emulsion for the present invention may be obtained by any of the acidic method, neutral method and ammoniacal method. The grains may be grown at a time or after forming a seed grain. The method of forming a seed grain may be identical with the method of growing grains or not.

The reaction of a soluble silver salt and a soluble halide may be carried out by the regular mixing method, reverse mixing method, simultaneous mixing method or a combination thereof. It is also possible to use the pAg controlled oduble jet method, a modification of the simultaneous mixing method described in Japanese Patent O.P.I. Publication No.48521/1979 etc.

A solvent for silver halide such as thioether may be used as needed.

Any silver halide grain shape can be used.

Silver halide grains of the present invention may be grains of the same shape or mixed grains of different shapes.

During formation and/or growth of silver halide grains, the silver halide emulsion used for the present invention may be supplemented with metal ions by means of a cadmium salt, zinc salt, lead salt, thallium salt, iridium salt or complex salt, rhodium salt or complex salt, or iron salt or complex salt to incorporate in and/or on the surface of the grains, and may be provided with a reduction sensitization speck in and/or on the surface of the grains in an appropriate reducing atmosphere.

Unnecessary soluble salts may be removed from, or allowed to ramain in the silver halide emulsion used for the present invention after completion of the growth of silver halide grains. Such salts can be removed in accordance with the method described in Research Disclosure No. 17643.

Silver halide grains used for the present invention may be grains mainly on the surface of which latent images are formed, or those mainly in which latent images are formed.

The silver halide emulsion for the present invention is chemically sensitized by a standard method. Accordingly, sensitization methods such as sulfur sensitization, using a compound containing sulfur capable of reacting with silver ions or active gelatin, selenium sensitization, using a selenium compound, reduction sensitization, using a reducing substance, and precious metal sensitization, using or other precious metal compound, can be used singly or in combination.

In the present invention, chalchogen sensitizers, for instance, can be used for chemical sensitization. Although chalchogen sensitizers generically involve sulfur sensitizers, selenium sensitizers and tellurium sensitizers, it is preferable to use a sulfur or selenium sensitizer. Examples of sulfur sensitizers include thiosulfates, allylthiocarbazides, thiourea, allylisothiocyanate, cystine, p-toluenethiosulfonate, and rhodanine. It is also possible to use the sulfur sensitizers described in U.S. Pat. Nos. 1,574,974, 2,410,689, 2,278,947, 2,728,668, 3,501,313 and 3,656,955, West German OLS Patent No. 1,422,869, Japanese O.P.I. Publication Nos. 24937/1981 and 45016/1980, and other reference.

Although the amount of sulfur sensitizer varies rather widely with various factors such as pH, temperature and silver halide grain size of emulsion, it is preferable that the sulfur sensitizer be added at $10^{-7}$ to $10^{-1}$ mol per mol silver halide.

Selenium sensitizers can be used in place of sulfur sensitizers. Selenium sensitizers which can be used include aliphatic isoselenocyanates such as allylisoselenocyanate; selenoureas, selenoketones; selenoamides; seelnocarboxylic acid salts and esters; selenophosphates; and selenides such as diethylselenide and diethyldiselenide. Specific examples thereof are given in the specifications for U.S. Pat. Nos. 1,574,944, 1,602,592 and 1,623,499.

Reduction sensitization can also be used in combination. Although there is no particular limitation on the choice of a reducing agent, examples include stannous chloride, thiourea dioxide, hydrazine and polyamine.

Compounds of precious metals other than gold, e.g. palaldium compounds can also be used in combination.

When using a direct positive image forming silver halide emulsion, an internal latent image type silver halide emulsion can be used. For example, it is possible to use a conversion type silver halide emulsion based on the conversion method described in U.S. Pat. No. 3,592,250, a silver halide emulsion containing internally chemically sensitized silver halide grains described in U.S. Pat. Nos. 3,206,316, 3,317,322 and 3,367,778, silver halide emulsion containing silver halide grains containing polyvalent metal ions described in U.S. Pat. Nos. 3,271,157, 3,447,927 and 3,531,291, a silver halide emulsion containing dope-containing silver halide grains having weakly chemically sensitized surfaces described in U.S. Pat. No. 3,761,276, a core-shell type silver halide emulsion based on the lamination method described in Japanese Patent O.P.I. Publication Nos. 8524/1975, 38525/1975 and 2408/1978, and a silver halide emulsion described in Japanese Patent O.P.I. Publication Nos. 156614/1977, 127549/1980 and 79940/1982. In this case, it is especially preferable that the internal latent image type silver halide emulsion comprise laminated grains.

Such silver halide grains can be produced in the same manner as with ordinary laminated silver halide grains. Examples of usable methods include the method in which silver chloride grains are converted to silver bromide grains by the addition of bromide and then the silver halide is laminated by addition of halide and silver nitrate, and the method in which silver iodobromide grains are formed in the presence of a small amount of excess halogen, followed by sequential lamination of silver chloride and silver bromide, as described in Japanese Patent O.P. I. Publication Nos. 8524/1975, 38525/1975, 60222/1978 and 1524/1980 and U.S. Pat. No. 3,206,313, and other references.

When using an internal latent image type silver halide emulsion, it may contain a stabilizer normally used to minimize back sensitivity and provide a lower minimum density and higher stability, e.g., a compound having an azaindene ring and a heterocyclic compound having a mercapto group. A preferable compound having an azaindene ring is 4-hydroxy-6-methyl-1,3,3a,7-tetrazaindene. Examples of nitrogen-containing heterocyclic compounds among the heterocyclic compounds having a mercapto group include pyrazole ring, 1,2,4-triazole ring, 1,2,3-triazole ring, 1,2,4-thiadiazole ring, 1,2,3-thiadiazole ring, 1,2,4-thiadiazole ring, 1,2,5-thiadiazole ring, 1,2,3,4-tetrazole ring, pyridazine ring, 1,2,3-triazine ring, 1,2,4-triazine ring and 1,3,5-triazole ring; rings formed by condensation of 2 or 3 of the above rings, such as triazolotriazole ring, diazaindene ring, triazaindene ring, tetrazaindene ring and pentazaindene ring; and phthaladinone ring and imidazole ring. Particularly, 1-phenyl-5-mercaptotetrazole is preferable.

The following sensitizing dyes can be used to form at least three silver halide emulsion layers of different spectral sensitivities in the silver halide color photographic light sensitive material of the present invention.

Examples of the useful sensitizing dyes used in the blue-sensitive silver halide emulsion layer are given in West German Patent No. 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Patent No. 1,242,588, and Japanese Patent Examined Publication Nos. 14030/1969 and 24844/1977. Representative examples of the useful sensitizing dye used in the green-sensitive silver halide emulsion include the cyanine dyes, melocyanine dyes and complex cyanine dyes described in U.S. Pat. Nos. 1,939,201, 2,072,908, 2,739,149 and 2,945,763 and British Patent No. 505,979. As examples of useful sensitizing dyes used in the red, sensitive silver halide emulsion layer, the cyanine dyes, merocyanine dyes and complex cyanine dyes given in U.S. Pat. Nos. 2,269,234, 2,270,378, 2,442,710, 2,454,629, 2,776,280 are cited. Also, the cyanine dyes and complex cyanine dyes described in U.S. Pat. Nos. 2,213,995, 2,493,748 and 2,519,001 and West German Patent No. 929,080 etc. can be used advantageously in the green- or red-sensitive silver halide emulsion.

These sensitizing dyes may be used singly or in combination. A combination of sensitizing dyes is often used for the purpose of supersensitization. Representative examples thereof are given in Japanese Patent Examined Publication Nos. 4932/1968, 4933/1968, 4936/1968, 32753/1968, 25831/1970, 26474/1970, 11627/1971, 18107/1971, 8741/1972, 11114/1972, 25379/1972, 37443/1972, 28293/1973, 38406/1973, 38407/1973, 38408/1973, 41204/1973, 6207/1974, 40662/1975, 12375/1978, 34535/1979 and 1569/1980, Japanese Patent O.P.I. Publication Nos. 33220/1975, 33828/1975, 38526/1975, 107127/1976, 115820/1976, 135528/1976, 151527/1976, 23931/1977, 51932/1977, 104916/1977, 104917/1977, 109925/1977, 110618/1977, 80118/1979, 25728/1981, 1483/1982, 10753/1983, 91445/1983, 153926/1983, 114533/1984, 11645/1984 and 116647/1984 and U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707.

Examples of the dye which itself has no spectrally sensitizing effect or substance which absorbs substantially no visible light and which has a supersensitizing effect, used in combination with sensitizing dyes, include aromatic organic acid formaldehyde condensation products (e.g. those described in U.S. Pat. No. 3,473,510), cadmium salts, azaindene compounds, and aminostyl compounds substituted by a nitrogen-containing heterocyclic ring, e.g. those described in U.S. Pat. Nos. 2,933,390 and 3,635,721. The combinations described in U.S. Pat. Nos. 3,615,613, 3,615,641, 3,617,295 and 3,635,721 are especially useful.

In addition to the above substances, ordinary additives can be used in the silver halide color photographic light sensitive material of the present invention.

Examples of wetting agents include dihydroxyalkane. Examples of appropriate film property improving agents include water-dispersible fine grain high polymers obtained by emulsion polymerization, such as copolymers of alkyl acrylate or alkyl methacrylate and acrylic acid or methacrylic acid, styrene-maleic acid copolymers and styrene-malic anhydride half alkyl ester copolymers. Examples of coating aids include saponine, polyethylene glycol and lauryl ether. Other photographic additives may also be used, including gelatin plastisizers, surfactants, UV absorbents, pH regulators, antioxidants, antistatic agents, thickeners, graininess improving agents, dyes, mordants, brightening agents, developing speed regulators, matting agents and anti-irradiation dyes.

A UV absorbent can also be used to prevent dye image fading due to short wavelength active light. Examples of the UV absorbent include thiazolidone, benzotriazole, acrylonitrile and benzophenone compounds. It is especially advantageous to use singly or in combination Tinuvin PS, Tinuvin 120, 320, 326, 327 and 328 (all produced by Ciba-Geigy AG).

The image forming layer of the present invention may contain an appropriate gelatin including oxidized gelatin and its derivative as desired. Examples of the preferable gelatin derivative include acylated gelatin, guanidylated gelatin, carbamylated gelatin, cyanoethanolized gelatin and esterified gelatin.

In addition to gelatin, the silver halide color photographic light sensitive material of the present invention may contain another hydrophilic binder in its hydrophilic colloid layer.

The hydrophilic binder can be added as desired to photographic structural layers such as emulsion layers, interlayers, protective layers, filter layers and backing layers. The hydrophilic binder may contain an appropriate plastisizer, lubricant ets. as desired.

The silver halide color photographic light sensitive material of the present invention may form various photographic structural layers as needed, such as filter layers, interlayers, protective layers, subbing layers, backing layers and anti-halation layers, as well as emulsion layers constituting image-forming layers on the support. Methods which can be used to coat each layer include dip coating, air doctor coating, extrusion coating, slide hopper coating and curtain flow coating.

Although any support can be used when image forming layers are composed of an internal latent image type silver halide color photographic light sensitive material, representative examples of the support include polyethylene terephthalate films, polycarbonate films, polystyrene films, polypropylene films, cellulose acetate films, baryta paper, polyolefin (e.g. polyethylene) laminated paper, and white-pigment-kneaded polyethylene terephthalate films, which are subbed as needed.

It is preferable that the at least three sensitization layers of different spectral sensitivities of the silver halide color photographic light sensitive material of the present invention each have a spectral sensitivity that makes color mixing unlikely to occur when the light-sensitive material is exposed to light having different spectral distribution through a plurality of black-and-white halfone image; for example, it is preferable that one layer be a blue-sensitive silver halide emulsion layer, another layer a green-sensitive silver halide emulsion layer made to have a maximum sensitivity to green light using a sensitizing dye, and the remaining one layer a red-sensitive silver halide emulsion layer made to have a maximum sensitivity to red light using a sensitizing dye. Examples of preferable layer structures, as well as those of combinations of spectral sensitivity and color of image to be formed, for the above three layers, are given below.

| Spectral sensitivity λmax of yellow image forming layer | Spectral sensitivity λmax of magenta image forming layer | Spectral sensitivity λmax of cyan image forming layer |
|---|---|---|
| 470 nm | 550 nm | 650 nm |
| 470 nm | 550 nm | 700 nm |
| 450 nm | 550 nm | 700 nm |
| 470 nm | 590 nm | 700 nm |
| 550 nm | 470 nm | 660 nm |
| 660 nm | 470 nm | 550 nm |
| 470 nm | 650 nm | 800 nm |

The light sensitive material of the present invention can be exposed using electromagnetic waves of a wavelength in the spectral range in which the emulsion layers constituting the light sensitive material of the invention have a sensitivity. Any known light source can be used, such as natural light (sunlight), tungsten lamps, fluorescent lamps, mercury vapor lamps, xenone arc lamps, carbon arc lamps, xenone electronic flash lamps, cathode ray tube flying spots, layser beams, light emitting diode beams, and light irradiated by a fluorescent substance excited by various rays such as electron rays, X-rays, γ-rays or α-rays.

The silver halide color photographic light sensitive material of the present invention may be prepared so that it has blue-, green- and red-sensitive layers as in ordinary color paper. For such material, color separation filters such as Wratten Nos. 25, 29, 58, 61 and 47B can be used for exposure.

Exposure time of 1 msec to 10 sec, usually used for printers, can of course be used; it is also possible to use exposure time of less than 1 msec, e.g., 100 μsec to 1 msec exposure time is possible using a cathode ray tube or xenon electronic flash lamp; exposure time of more than 10 sec is also possible.

Exposure may be continuous or intermittent.

Color developing agents used in the color developer of the present invention include known ones widely used in various color photographic processes. These developing agents include aminophenol and p-phenylenediamine derivatives. These compounds are normally used in the form of a salt, e.g., hydrochloride or sulfate, to stabilize the free state. These compounds are normally used at concentrations of about 0.1 to 30 g per lcolor developer, preferably about 1 to 15 g per lcolor developer.

Examples of the aminophenol-type developing agent include o-aminophenol, p-aminophenol, 5-amino-2-oxytoluene, 2-amino-3-oxytoluene and 2-oxy-3-amino-1, 4-dimethylbenzene.

The especially useful aromatic primary amine-type color developing agents are N,N-dialkyl-p-phenylenediamine compounds, whether its alkyl group and phenyl group is substituted or not. Examples of especially useful compounds include N,N-diethl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)toluene, N-ehtyl-N-β-methanesulfonamidoethyl-3-methyl-4-aminolniline sulfate, N-ethyl-N-β-hydroxyethylaminoaniline, 4-amino-3-methyl-N,N-diethylaniline and 4-amino-N-(2-methoxyethyl)-N-ethyl-3-methylaniline-p-toluenesulfonate.

To a color developer used to process the silver halide color photographic light sensitive material of the present invention, a known developer component compound can be added, as well as the above-mentioned aromatic primary amine-type color developing agents. Examples of such compounds include alkali agents such as sodium hydroxide, sodium carbonate and potassium carbonate; alkali metal bisulfites, alkali metal thiocyanates, alkali metal halides, benzyl alcohol, water softeners and concentrating agents.

The pH value of the color developer is normally over 7, most generally about 10 to 13.

Color developing temperature is normally over 15° C., generally 20° to 50° C. From the viewpoint of quick processing, color developing should preferably conducted over 30° C. It is preferable that color developing time be 20 to 60 seconds, more preferably 30 to 50 seconds.

The silver halide photographic light sensitive material of the present invention may contain in its hydrophilic colloid layer these color developing agents or precursors thereof and may be processed with an alkaline activation bath. The color developing agent precursors are compounds capable of producing a color developing agent under alkaline conditions, including Shiff base type precursors formed with an aromatic aldehyde derivative, polyvalent metal ion complex precursors, phthalic imide derivative precursors, phosphoric amide derivative precursors, sugar amine reactant precursors and urethane type precursors. These precursors of primary amine-type color developing agents are described in U.S. Pat. Nos. 3,342,599, 2,507,114, 2,695,234 and 3,719,492, British Patent No. 803,783, Japanese Patent O.P.I. Publication Nos. 185628/1978 and 79035/1979, and Research Disclosure Nos. 15159, 12146 and 13924.

Thses aromatic primary amine-type color developing agents or their precursors need to be added in amounts such that they provide sufficient color developing performance when activated. Although the amount of addition varies widely with the type of light sensitive material, they are used at 0.1 to 5 mols, preferably 0.5 to 3 mols per mol of silver halide. These color developing agents or their precursors may be used singly or in combination. For incorporating them into the light sensitive material, they may be added in solution in an appropriate solvent such as water, methanol, ethanol or acetone, or in emulsified dispersion using a high boiling point organic solvent such as dibutyl phthalate, dioctyl phthalate or tricresyl phospahte, or in impregnation in latex polymer as described in Research Disclosure No. 14850.

When using an internal latent image type silver halide emulsion layer, as an image forming layer of the light sensitive material of the present invention to form direct positive images, the main process is generally conducted using the procedure in which an unfogged internal latent image type silver halide photographic light sensitive material is subjected to image exposure and then surface development after or during fogging. In this case, fogging can be achieved by providing entire surface uniform exposure or by the use of a fogging agent. It is preferable that entire surface uniform exposure be conducted after immersing the image-exposed internal latent image type silver halide photographic light sensitive material in the developer or other aqueous solution. For this purpose, any light source can be used, as long as it generates light of a wavelength in the range of light sensitivity wavelength of the internal latent image type silver halide photographic light sensitive material. Also, irradiation of high illuminance light like flash light for a short time is possible, as well as irradiation of weak light for a long time. Entire surface uniform exposure time can be varied widely so that best positive images could be obtained eventually, according to properties of the internal latent image type silver halide photographic light sensitive material, developing conditions and type of light source. Various compounds can be used as the above-mentioned fogging agent. The fogging agent only needs to exist during developing; for example, it may be contained in the internal latent image type silver halide photographic light sensitive material such as silver halide emulsion layer, or in the developer, or in the processing solution used before developing, but it is recommended that the fogging agent be contained in the internal latent image type silver halide photographic light sensitive material, in the silver halide emulsion layer is especially preferable. The amount of its addition can be varied widely according to the purpose; it is preferable to add it at 1 to 1500 mg, more preferably 10 to 1000 mg per tool silver halide when added to the silver halide emulsion layer. When added to a processing solution such as developer, the fogging agent is preferably added at 0.01 to 5 g per l, more preferably 0.08 to 0.15 g per l. Examples of the fogging agent include the hydrazines described in U.S. Pat. Nos. 2,563,785 and 2,588,982, the hydrazide or hydrazone compound described in U.S. Pat. No. 3,227,552, the heterocyclic quaternary nitrogen compounds described in U.S. Pat. Nos. 3,615,615, 3,718,470, 3,719,494, 3,734,738 and 3,759,901, and the acylhydrazinophenylthioureas described in U.S. Pat. No. 4,034,925. These fogging agents can be used in combination; for example, Research Disclosure No. 15162 described a combination use of a nonadsorptive fogging agent and an absorptive fogging agent, which can be applied to the present invention.

Examples of useful fogging agents include hydrazine compounds such as hydrazine hydrochloride, phenylhydrazine hydrochloride, 4-methylphenylhydrazine hydrochloride, 1-formyl-2-(4-methylphenyl)hydrazine, 1-acetyl-2-phenylhydrazine, 1-acetyl-2-(4-acetamidophenyl)hydrazine, 1-methylsulfonyl-2-phenylhydrazine, 1-benzoyl-2-phenylhydrazine, 1-methyluslfonyl-2-(3-phenylsulfonamidophneyl)hydrazine and formaldehyde phenylhydrazine.

When embodying the light sensitive material of the present invention as an internal latent image type silver halide photographic light sensitive material, direct positive images are formed by entire surface exposure or development in the presence of a fogging agent after image exposure; any method can be used to develop the light sensitive material, and the surface developing method is preferable. The surface developing method means developing with a developer containing substantially no solvent for silver halide.

The present invention can be embodied by subjecting an exposed silver halide color photographic light sensitive material to developing and processing with a processing solution capable of fixing to form positive images corresponding to original images.

The above developing process included combinations of black-and-white developing and color developing, such as in reversal color processing, as well as simple color development. Also included are entire surface exposure and development in the presence of a fogging agent, such as in processing internal latent image type silver halide photographic light sensitive materials.

The black-and-white developing solution used for development is a generally known developing solution known as the black-and-white first developing solution, used to process color photographic light sensitive materials, or a developing solution used to process black-and-white photographic light sensitive materials; it may contain various well-known additives generally added to black-and-white developing solutions.

Representative examples of such additives include developing agents such as 1-phenyl-3-pyrazolidone, metol and hydroquinone; preservatives such as sulfites; accelerators comprising an alkali such as sodium hydroxide, sodium carbonate or potassium carbonate; inorganic or organic inhibitors such as potassium bromide, 2-methylbenzimidazole and methylbenzthiazole; hard water softeners such as oplyphosphates; and surface overdevelopment preventing agents comprising a trace amount of iodide or mercapto compound.

The silver halide photographic light sensitive material of the present invention is subjected to bleaching and fixing after color developing. Bleaching may be conducted simultaneously with fixing. A wide variety of compounds are used as bleaching agents. Among them, compounds of polyvalent metals such as iron (III), cobalt (III) and copper (II); particularly, complex salts of these polyvalent metal cations with organic acids, e.g., metal complex salts of aminopolycarboxylic acids such as ethylenediaminetetraacetic acid, nitrilotriacetic acid and N-hydroxyethylethylenediaminediacetic acid, malonic acid, tartaric acid, malic acid, diglycolic acid and dithioglycolic acid, ferricyanates and bichromates, are used singly or in combination.

As the fixing agent, is used a soluble complexing agent that solubilizes silver halide to a complex salt. Examples of the soluble complexing agent include sodium thiosulfate, ammonium thiosulfate, potassium thiocyanate, thiourea and thioether.

Fixing is normally followed by washing. Washing may be replaced with stabilization, and both processes may be conducted. The stabilizing solution for stabilization process may contain pH regulators, chelating agents, antifungal agents etc. Specific conditions for these processes can be chosen in accordance with Japanese Patent O.P.I. Publication No. 134636/1983 etc.

[EXAMPLES]

The typical examples of the invention are hereunder described in detail. However, the scope of the invention is not limited only to these examples.

Example 1

On a paper support having, on its both faces, polyethylene lamination were sequentially coat-formed the following layers to obtain negative-type silver halide color photographic light-sensitive material Sample No. 1 (Comparative).

Layer 1

Layer containing 1.2 g/m$^2$ of gelatin, 0.32 g/m$^2$ (as converted into coating silver weight hereinafter the coating amount of emulsion is given by the same expression) of blue-sensitive silver chlorobromide emulsion having the mean particle size of 0.8 $\mu$m; 0.80 g/m$^2$ of yellow coupler (Y-58) dissolved in 0.50 g/m$^2$ of dioctylphthalate Layer 2

Intermediate layer containing 0.70 g/m$^2$ of gelatin, 8 mg/m$^2$ of anti-irradiation dye (AI-1), and 4 mg/m$^2$ of anti-irradiation dye (AI-2)

Layer 3

Layer containing 1.25 g/m$^2$ of gelatin, 0.20 g/m$^2$ of green-sensitive silver chlorobromide emulsion containing 70 mol% silver bromide; 0.62 g/m$^2$ of magenta coupler (MC-1) dissolved in 0.30 g/m$^2$ of dioctylphthalate Layer 4

Intermediate layer containing 1.20 g/m$^2$ of gelatin

Layer 5

Layer containing 1.20 g/m$^2$ of gelatin, 0.30 g/m$^2$ of red-sensitive silver chlorobromide emulsion containing 70 mol % of silber bromide; 0.45 g/m$^2$ of cyan coupler (CC-1) dissolved in 0.20 g/m$^2$ of dioctylphthalate Layer 6

Layer containing 1.00 g/m$^2$gelatin; 0.30 g/m$^2$ of ultraviolet absorbent dissolved in 0.20 g/m$^2$ of dioctylphthalate Layer 7

(MC-1)

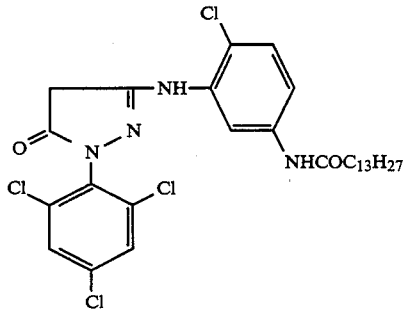

(CC-1)

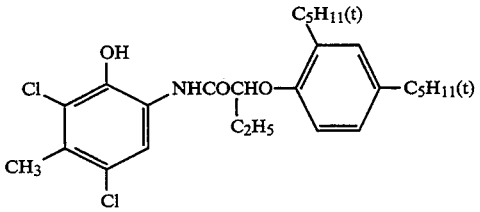

(AI-1)

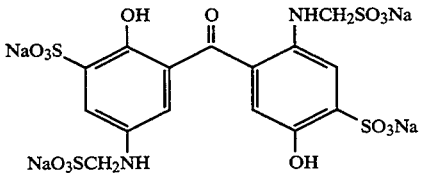

(AI-2)

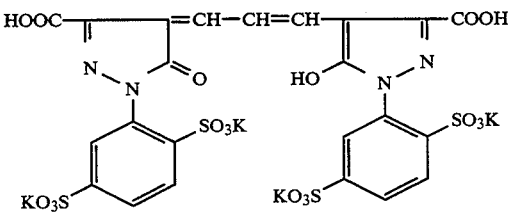

-continued (UV-1)

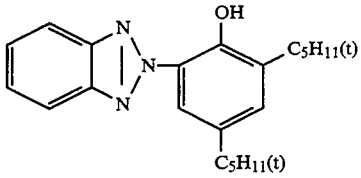

Layer containing 0.50 g/m$^2$ of gelatin 0.017 g of sodium salt of 2,4-dichloro-6-hydroxy-s-triazine as a hardener was added, per gram gelatin, to each of Layers 2, 4, and 7.

By changing the coupler in Layer 3 as specified in Table 1, silver halide color photographic light-sensitive material Samples No. 2 (Comparative), No. 3 through No. 14 (Invention) were prepared in a manner similar to that of Sample No. 1.

On each of the above-mentioned Comparative Samples No. 1 and No. 2, a black-and-white transparent halftone negative whose 175 lines comprising dot areas varying from 0 to 100% was tightly placed, thereby a sheet of each sample was irradiated with green light of a controlled intensity and another sheet of each sample was irradiated with blue light of a controlled intensity so that the reflected density observed on the 100% dot area of the image formed on each sample sheet was 1.6 in terms of green density, 0.6 in terms of blue density.

With Samples No. 3 through No.-14, the amount of yellow coupler in Layer 3 (ortho layer) was adjusted, and each samples was exposed with green light so that the reflected blue density on the 100% dot area of the formed image was 0.5 to 0.7, while the reflected green density at the same area was 1.6.

These sensitive material Samples No. 1 through No. 14 were treated by the processing steps specified below.

| Processing steps (35° C.) | | |
|---|---|---|
| Color developing | | 2 min. 30 sec. |
| Bleach-fixing | | 1 min. |
| Washing | | 1 min. |
| Drying | 60–80° C. | 2 min. |

The compositions of the processing solutions used are as follows.

| (Color developer A) | |
|---|---|
| Pure water | 800 ml |
| Hydroxylamine sulfate | 2.0 g |
| Potassium bromide | 1.5 g |
| Sodium chloride | 1.0 g |
| Potassium sulfite | 2.0 g |
| Triethanolamine | 2.0 g |
| N-ethyl-N-β-methanesulfonamidoethyl-methyl-4-aminoaniline sulfate | 8.0 g |
| 1-hydroxyethylidene-1,1'-diphosphoric acid (60% aqueous solution) | 1.5 ml |
| Potassium carbonate | 32 g |
| Whitex BB (50% aqueous solution) (fluorescent brightening agent, Sumitomo Chemical Co., Ltd.) | 2 ml |

Pure water was added to 1 liter, and the pH was adjusted to 11.2 with 20% potassium hydroxide or with 10% sulfuric acid.

| (Bleach-fixer) | |
|---|---|
| Pure water | 550 ml |
| Iron (III) ammonium ethylenediaminetetraacetate | 65 g |
| Ammonium thiosulfate | 85 g |
| Sodium hydrogensulfite | 10 g |
| Sodium metabisulfite | 2 g |
| Disodium ethylenediaminetetraacetate | 20 g |
| Potassium bromide | 10 g |

Pure water was added to 1 liter, and the pH was adjusted to 7.0 with aqueous ammonium or diluted sulfuric acid.

Once the above-mentioned processing is complete, each sample was evaluated for $D_B$ (blue density) and $D_G$ (green density) of dot images on both 10% and 100% dot areas, by using the PDA-65 (Konica Corporation), thereby the difference between $D_B/D_G$ of 10% and 100% dot areas. Table 1 summarizes the results obtained.

TABLE 1

| | Coupler in Layer 3 | | | | | |
|---|---|---|---|---|---|---|
| | Yellow coupler | | Magenta coupler | | | |
| Sample No. | Type | pKa | Type | pKa | Amount (g/m²) | $D_B/D_G$(10%) − $D_B/D_G$(100%) |
| 1 (Comparative) | — | | MC-1 | *10.07 | 0.62 | 0.15 |
| 2 (same as above) | — | | M-10 | 9.73 | 0.62 | 0.20 |
| 3 (Invention) | Y-6 | 9.80 | M-10 | 10.24 | 0.62 | 0.04 |
| 4 (same as above) | Y-21 | 7.95 | M-1 | 10.24 | 0.50 | 0.07 |
| 5 (same as above) | Y-4 | *6.86 | MC-1 | *10.07 | 0.62 | 0.13 |
| 6 (same as above) | Y-8 | 8.60 | M-4 | 9.11 | 0.42 | 0.03 |
| 7 (same as above) | Y-22 | 9.60 | M-9 | 9.18 | 0.50 | 0.03 |
| 8 (same as above) | Y-6 | 9.80 | M-12 | 9.71 | 0.62 | 0.02 |
| 9 (same as above) | Y-3 | 5.90 | M-22 | 9.70 | 0.62 | 0.11 |
| 10 (same as above) | Y-4 | 6.15 | M-26 | 9.68 | 0.62 | 0.10 |
| 11 (same as above) | Y-42 | 6.50 | M-44 | 10.80 | 0.75 | 0.11 |
| 12 (same as above) | Y-49 | 6.54 | M-33 | 10.39 | 0.75 | 0.09 |
| 13 (same as above) | Y-57 | 8.80 | M-16 | 10.30 | 0.50 | 0.06 |
| 14 (same as above) | Y-57 | 8.75 | M-49 | 9.43 | 0.62 | 0.05 |

In Table 1, pKa values with asterisks are values measured by the neutralization-titration method. The other valves without asterisk are measured by the spectrophotometric method.

It is apparent from the results in Table 1 that color proof preparation with a negative silver halide color photographic light-sensitive material of the invention results in smaller tone difference between larger dots and smaller dots on a halftone color image. Such effect is considerable in the samples each containing the magenta coupler represented by Formula (M-1) and more considerable when the difference of the pKa values between the magenta coupler and the yellow coupler is within −0.2 to 0.2.

Example 2

Preparation of Emulsion S 750 ml of 2.0% inactive gelatin solution was maintained at 50° C., and while the solution was stirred, solution A1 and solution B were simultaneously added in 3 minutes. After 25 minutes of ripening, excess salts were removed by a flocculation washing method, and the remaining was redispersed, and solution C1 and solution D1 were added. Ten minutes after, excess water soluble salts were removed, and then, a little amount of gelatin was added in order to disperse silver halide grains.

Preparation of Emulsion L 750 ml of 1.5% inactive gelatin solution was maintained at 60° C., and while the solution was stirred, solution A2 and solution B each specified below were simultaneously added in 15 minutes. After 40 minutes of ripening, excess salts were removed by a flocculation washing method, and the remaining was redispersed, and 10 mg of sodium thiosulfate was added, and then solution C2 and solution D2 were added. Ten minutes after, excess water soluble salts were removed, and then, a little amount of gelatin was added in order to disperse silver halide grains.

Preparation of Emulsion M 750 ml of 2.0% inactive gelatin solution was maintained at 50° C., and while the solution was stirred, solution A3 specified below and solution B were simultaneously added in 5 minutes. After 25 minutes of ripening, excess salts were removed by a flocculation washing method, and the remaining was redispersed, and solution C1 and solution D2 were added. Ten minutes after, excess water soluble salts were removed, and then, a little amount of gelatin was added in order to disperse silver halide grains.

| | | |
|---|---|---|
| Solution A1 | Pure water | 2000 ml |
| | NaCl | 35 g |
| | $NH_4Br$ | 109.6 g |
| | KI | 0.8 g |
| Solution A2 | Pure mater | 1000 ml |
| | NaCl | 26.3 g |
| | $NH_4Br$ | 109.6 g |
| | KI | 0.8 g |
| Solution A3 | Pure mater | 1000 ml |
| | NaCl | 38.8 g |
| | KBr | 12 g |
| Solution B | Pure mater | 1200 ml |
| | $AgNO_3$ | 170 g |
| Solution C1 | Pure mater | 1000 ml |
| | NaCl | 60 g |
| | $NH_4Br$ | 6.9 g |
| Solution C2 | Pure mate | 1000 ml |
| | NaCl | 31.6 g |
| Solution D1 | Pure mater | 1000 ml |
| | $AgNO_3$ | 70 g |
| Solution D2 | Pure mater | 1000 ml |
| | $AgNo_3$ | 80 g |

As specified below, sensitizing dyes, couplers and the like were added to the so-prepared three emulsions in order to prepare a multilayerd color sensitive material.

Red-sensitive Emulsion Layer (Layer 1)

To a mixture emulsion comprising 0.2 mol of silver halide of Emulsion S and 0.8 mol of silver halide of Emulsion M were added Sensitizing Dyes (D-3) and (D-4), Stabilizers (T-1) and (T-2), Surfactant (S-2); and also added was a coupler solution undergone protect dispersing and containing dibutylphthalate, ethyl acetate, Surfactant (S-2), 2,5-dioctylhydroquinone, Cyan Couplers (CC-2) and (cc-3).

1st Intermediate Layer (Layer 2)

A gelatin solution comprising a solution undergone protective dispersing and having dioctylphthalate, 2,5-dioctylhydroquinone, ultraviolet absorbent Tinuvin 328 (Ciba-Geigy AG), Surfactant (S-1) was prepared and was applied so that the coating Tinuvin weight was 0.15 g/m$^2$.

Green-sensitive Emulsion Layer (Layer 3)

To a mixture emulsion comprising 0.2 mol of silver halide of Emulsion S and 0.8 mol of silver halide of Emulsion M were added Sensitizing Dye (D-2), Stabilizers (T-1) and (T-2), Surfactant (S-2); and also added was a coupler solution undergone protect dispersing and containing dibutylphthalate, ethyl acetate, Surfactant (S-2), 2,5-dioctylhydroquinone, Magenta Coupler (MC-1), Surfactant (S-2).

Gelatin was added, and Hardener (H-1) was also added to obtain a coating solution.

2nd Intermediate Layer (Layer 4)

This layer had a composition identical to that of 1st Intermediate Layer, while the coating weight of Tinuvin 328 was 0.2 g/m$^2$.

Yellow Filter Layer (Layer 5)

A coating solution was prepared by adding yellow colloidal silver that was obtained in the presence of a weak alkali-reducing agent (after neutralizing, the weak reducing agent was removed by noodle washing technique); also added were dioctylphthalate, ethyl acetate, Surfactant (S-1), 2,5-dioctylhydroquinone solution, Surfactant (S-2), and Hardener (H-1); the coating weight of colloidal silver was 0.15 g/m$^2$.

3rd Intermediate Layer (Layer 6)

Identical to 1st Intermediate Layer.

Blue-sensitive Emulsion Layer (Layer 7)

To a mixture emulsion comprising 0.7 mol of silver halide of Emulsion L and 0.3 mol of silver halide of Emulsion M were added Sensitizing Dye (D-1), Stabilizers (T-1) and (T-3), Surfactant (S-2); and also added was a coupler solution undergone protect dispersing and containing dibutylphthalate, ethyl acetate, Surfactant (S-1), and Yellow Coupler (Y-54).

Gelatin was added, and Hardener (H-1) was also added to obtain a coating solution.

3rd Intermediate Layer (Layer 8)

This layer had a composition identical to that of 1st Intermediate Layer, while the coating weight of Tinuvin 328 was 0.35 g/m$^2$.

Protective Layer (Layer 9)

A gelatin solution containing colloidal silica, Surfactant (S-2), Hardeners (H-1) and (H-2) was used as a coating solution at a coating gelatin weight of 1.0 g/m$^2$.

By the simultaneous coating method, Layers 1 through 9 were formed and dried on a polyethylene-laminated paper support whose surface being pretreated.

(D-1)

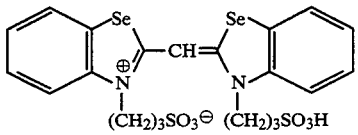

(D-2)

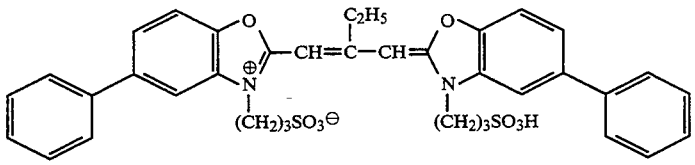

(D-3)

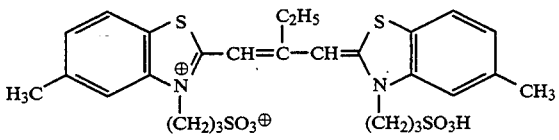

(D-4)

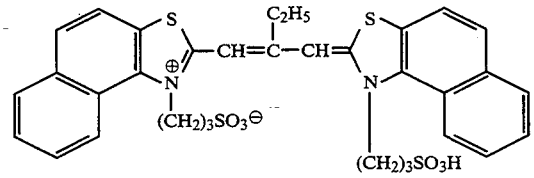

-continued (T-1)

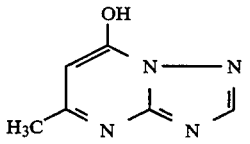

(T-2)

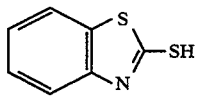

(T-3)

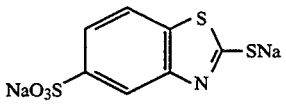

(S-1)

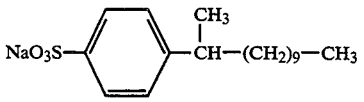

(S-2)

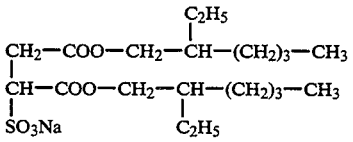

(H-1)

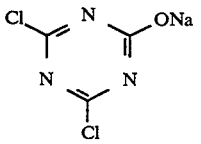

(H-2)

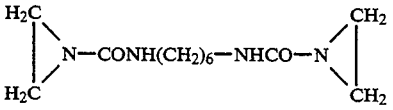

(H-3)

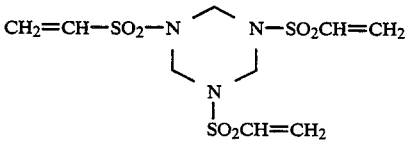

(CC-2)

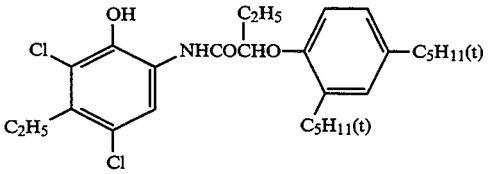

(CC-3)

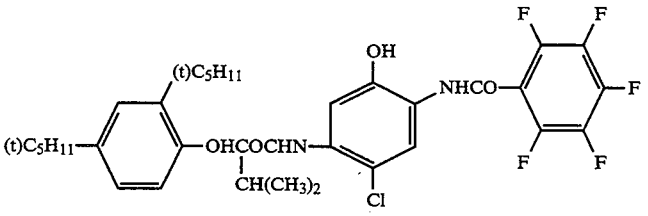

A black-and-white transparent halftone positive film whose 175 lines comprising dot areas varying from 0 to 100% was tightly placed on a 100 μm thick polyester film, and then both films were placed on the so-prepared internal-image type direct positive silver halide color light-sensitive material sample, thereby the sample was irradiated with green light of a minimum intensity so that post-processing green density on the 0% dot area of the image was the minimum density, and then, the black-and-white transparent halftone positive film was removed, and, next, the overall surface were uniformly irradiated with blue light and red light of minimum intensities so that the resultant yellow and cyan densities were minimum. Furthermore, the overall surface of the sample was uniformly irradiated with green light so that the resultant green reflected density was 1.6 at the 100% dot area of the image. The so-exposed sample was processed by the processing steps specified below, in order to obtain Sample No. 15.

Likewise, a black-and-white transparent positive film whose 175 lines comprising dot areas varying from 0 to 100% was tightly placed on a 100 μm thick polyester film, and then, both films were placed on the same photographic material sample, thereby the sample was exposed with green light while blue light is irradiated. The intensity of the green light was controlled to minimum so that it combined with the intensity of the uniform exposing performed later would ensure the minimum density at the 0% dot area of the image. Furthermore, like in the case of Sample No. 15, the overall surface of this sample was uniformly irradiated with red light, and then the overall surface was exposed with green light and red light, wherein each light intensity was controlled so that the resultant green density at the 100% dot area was 1.6 and the resultant blue density at the same area was 0.6. Thus Sample No. 16 was obtained. At the same time, Samples No. 17 through 25 were obtained in which, as summarized in Table 2, the magenta coupler in the previously mentioned green-sensitive emulsion layer was replaced and a yellow coupler was added to the same layer. The amount of the yellow coupler added was controlled so that the resultant blue density at the 100% dot area was 1.6 relative to the green density of 0.5 to 0.7 at the same dot area when these samples were exposed and processed in a manner identical to that of Sample No. 15.

| Processing steps (temperature and duration) | | |
|---|---|---|
| (1) Immersing (color developer) | 38° C. | 8 sec. |
| (2) Fog-exposing | — | 10 sec. at 1 lux. |
| (3) Color developing | 38° C. | 2 min. |
| (4) Bleach-fixing | 35° C. | 60 sec. |
| (5) Stabilizing | 25–30° C. | 1 min. 30 sec. |
| (6) Drying | 75–80° C. | 1 min. |

| Compositions of processing solutions (Color developer) | |
|---|---|
| Benzyl alcohol | 10 ml |
| Ethylene glycol | 15 ml |
| Potassium sulfite | 2.0 g |
| Potassium bromide | 1.5 g |
| Sodium chloride | 0.2 g |
| Potassium carbonate | 30.0 g |
| Hydroxylamine sulfate | 3.0 g |
| Polyphosphoric acid (TPPS) | 2.5 g |
| 3-methyl-4-amino-N-ethyl-N-(β-methanesulfonamidoethyl) aniline sulfate | 5.5 g |
| Fluorescent brightening agent (4,4'-diaminostylbenzosulfonate derivative) | 1.0 g |
| Potassium hydroxide | 2.0 g |

Water was added to 1 liter, and the pH was adjusted to 10.20.

| (Bleach-fixer) | |
|---|---|
| Iron (III) ammonium ethylenediaminetetraacetate dihydrate | 60 g |
| Ethylenediaminetetraacetic acid | 3 g |
| Ammonium thiosulfate (70% solution) | 100 ml |
| Ammonium sulfite (40% solution) | 27.5 ml |

The pH was adjusted to 7.1 using potassium carbonate or glacial acetic acid, and water was added to 1 liter.

| (Stabilizer) | |
|---|---|
| 5-chloro-2-methyl-4-isothiazoline-3-one | 1.0 g |
| Ethylene glycol | 10 g |
| 1-hydoxyethylidene-1,1'-diphosphonic acid | 2.5 g |
| Bismuth chloride | 0.2 g |
| Magnesium chloride | 0.1 g |
| Ammonium hydroxide (28% aqueous solution) | 2.0 g |
| Sodium nitrilotriacetate | 1.0 g |

Water was added to 1 liter, and the pH was adjusted to 7.0 using ammonium hydroxide or sulfuric acid.

Stabilizing was performed according to the two-bath counter flow system.

In a manner identical to that of Example 1, the so-processed samples were evaluated for the difference in $D_B/D_G$ (10% dot image) ratio and $D_B/D_G$ (100% dot image) ratio. Table 2 summarizes the results obtained.

TABLE 2

| | Coupler in Layer 3 | | | | | |
|---|---|---|---|---|---|---|
| | Yellow coupler | | Magenta coupler | | | |
| Sample No. | Type | pKa | Type | pKa | Amount (g/m²) | $D_B/D_G$(10%) − $D_B/D_G$(100%) |
| 15 (Comparative) | — | | MC-1 | *10.07 | 0.70 | — |
| 16 (same as above) | — | | MC-1 | *10.07 | 0.70 | 0.27 |
| 17 (Invention) | Y-54 | *7.48 | MC-1 | *10.07 | 0.70 | 0.16 |
| 18 (same as above) | Y-6 | 9.80 | M-1 | 10.24 | 0.60 | 0.05 |
| 19 (same as above) | Y-8 | 8.60 | M-3 | 8.99 | 0.60 | 0.07 |
| 20 (same as above) | Y-22 | 9.60 | M-10 | 9.01 | 0.70 | 0.02 |
| 21 (same as above) | Y-58 | 9.80 | M-26 | 9.68 | 0.80 | 0.03 |
| 22 (same as above) | Y-54 | 6.80 | M-21 | 10.07 | 0.80 | 0.12 |
| 23 (same as above) | Y-56 | 9.75 | M-40 | 9.90 | 0.80 | 0.06 |
| 24 (same as above) | Y-57 | 8.75 | M-16 | 10.30 | 0.60 | 0.08 |
| 25 (same as above) | Y-6 | *10.50 | MC-1 | *10.07 | 0.70 | 0.12 |

Asterisks in Table 2 have the same mean as in Table 1.

The tone of Sample No. 15 was bluer, and whose every dot area showed significant difference between the image of printing ink and the tone on the sample. The results in Table 2 indicate that in contrast with Sample No. 16 whose tone difference is greater between the 100% area and the 10% area, Sample No. 17 through Sample 25 had smaller tone difference, and, accordingly, that the samples of the invention achieved the intended improvement. The improvement is considerable in the samples containing the magenta couplers represented by Formula (M-1), and more considerable when the difference of pKa value between the magenta coupler and yellow coupler contained in the magenta image forming layer of the sample.

Example 3

On a paper support having, on its both faces, polyethylene lamination were sequentially formed the following Layers 1 through 12 to obtain color reversal sensitive material Sample No. 26. The coating weight is indicated in g/m$^2$, where that of silver halide is indicated in silver converted coating weight.

| | |
|---|---|
| Layer 1 (gelatin layer) | |
| Gelatin | 1.40 |
| Layer 2 (anti-halation layer) | |
| Black colloidal silver | 0.10 |
| Gelatin | 0.60 |
| Layer 3 (1st red-sensitive layer) | |
| Cyan coupler CC-3 | 0.14 |
| Cyan coupler CC-1 | 0.07 |
| High-boiling solvent (O-1) | 0.06 |
| Silver iodobromide emulsion (containing 3.0 mol % of AgI; mean grain size 0.4 μm) spectrally sensitized with Red-sensitizing Dyes (D-5, D-6) | 0.14 |
| Gelatin | 1.0 |
| Layer 4 (2nd red-sensitive layer) | |
| Cyan coupler CC-3 | 0.20 |
| Cyan coupler CC-1 | 0.10 |
| High-boiling solvent (O-1) | 0.10 |
| Silver iodobromide emulsion (containing 3.0 mol % of AgI; mean grain size 0.8 μm) spectrally sensitized with Red-sensitizing Dyes (S-5, S-6) | 0.16 |
| Gelatin | 1.0 |
| Layer 5 (1st intermediate layer) | |
| Gelatin | 1.0 |
| Anti-stain agent (A-1) | 0.08 |
| Layer 6 (1st green-sensitive layer) | |
| Magenta coupler (MC-2) | 0.14 |
| High-boiling solvent (O-2) | 0.15 |
| AgBrI emulsion (containing 3.0 mol % of AgI; mean grain size 0.4 μm) spectrally sensitized with Green-sensitizing Dye (D-7) | 0.15 |
| Gelatin | 1.0 |
| Layer 7 (2nd green-sensitive layer) | |
| Magenta coupler (MC-2) | 0.14 |
| High-boiling solvent (O-2) | 0.15 |
| Silver iodobromide emulsion (containing 3.0 mol % of AgI; mean grain size 0.7 μm) spectrally sensitized with Green-sensitizing Dye (D-7) | 0.15 |
| Gelatin | 1.0 |
| Layer 8 (2nd intermediate layer) | |
| Yellow colloidal silver | 0.15 |
| Anti-stain agent (A-1) | 0.08 |
| Gelatin | 1.0 |
| Layer 9 (1st blue-sensitive layer) | |
| Yellow coupler (Y-1) | 0.40 |
| High-boiling solvent (O-2) | 0.10 |
| Silver iodobromide emulsion (containing 3.0 mol % of AgI; mean grain size 0.4 μm) spectrally sensitized with Green-sensitizing Dye (D-7) | 0.15 |
| Gelatin | 0.70 |
| Layer 10 (2nd blue-sensitive layer) | |
| Yellow coupler (Y-1) | 0.80 |
| High-boiling solvent (O-2) | 0.20 |
| AgBrI emulsion (containing 3.0 mol % of AgI; mean grain size 0.8 μm) spectrally sensitized with Green-sensitizing Dye (D-8) | 0.15 |
| Gelatin | 1.3 |
| Layer 11 (ultraviolet absorbing layer) | |
| Ultraviolet absorbent UV-1 | 0.2 |
| Ultraviolet absorbent UV-2 | 0.2 |
| Ultraviolet absorbent UV-3 | 0.2 |
| Ultraviolet absorbent UV-4 | 0.2 |
| Gelatin | 2.0 |
| Layer 12 (protective layer) | |
| Gelatin | 1.0 |

Other than the above-mentioned components, the material contained an anti-fading agent, surfactant, hardener (H-1), and anti-irradiation dye.

(MC-2)

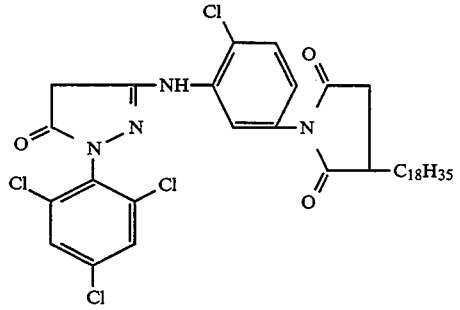

(O-1)

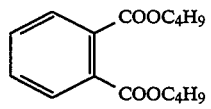

(O-2)

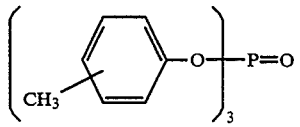

(D-5)

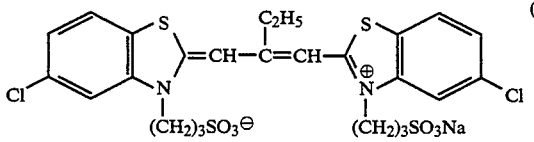

(D-6)

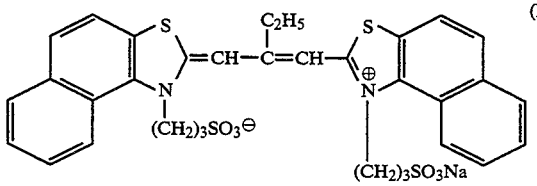

(D-7)

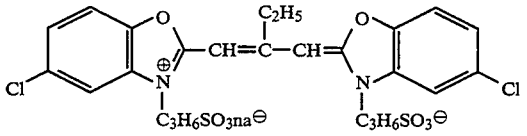

(D-8)

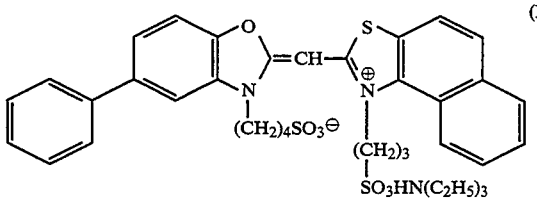

Ultraviolet absorbent

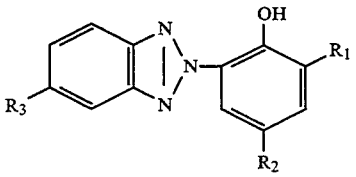

| $R_1$ | $R_2$ | $R_3$ |
|---|---|---|

-continued

| | | | |
|---|---|---|---|
| (UV-2) | (t)$C_4H_9$ | (t)$C_4H_9$ | H |
| (UV-3) | (t)$C_4H_9$ | $CH_3$ | Cl |
| (UV-4) | (t)$C_4H_9$ | (t)$C_4H_9$ | Cl |

Anti-stain agent (A-1)

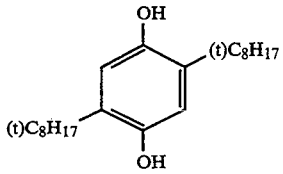

Next, the magenta coupler in Layers 6 and 7 was replaced with a combination of couplers specified in Table 3, where the amount of yellow coupler to be added was determined in a method identical to that of Example 2, thereby $D_B/D_G$(10%)-$D_B/D_G$(100%) was measured based on the exposing method same as in Example 2.

However, Samples No. 26 and No. 27 were evaluated based on the exposing method for Sample No. 16.

With Samples No. 28 through No. 31, the amounts of magenta coupler and yellow coupler in Layer 6 were identical to those in Layer 7.

Each piece of these Samples No. 26 through No. 31 was subjected to white exposing through an optical wedge, and another sheet of each the samples was subjected to magenta exposing through an optical wedge using a filter CC-90 (Eastman Kodak Co.), and then, each sample piece was subjected to the processing steps specified below.

| | | | |
|---|---|---|---|
| Primary developing (monochromatic developing) | 1 min. | 15 sec. | (38° C.) |
| Washing | 1 min. | 30 sec. | |
| Light-fogging | 100 lux | not less that 1 sec. | |
| Secondary developing (color developing) | 2 min. | 15 sec. | (38° C.) |
| Washing | | 45 sec. | |
| Bleach-fixing | 2 min. | | (38° C.) |
| Washing | 2 min. | 15 sec. | |

| | |
|---|---|
| (Primary developer) | |
| Potassium sulfite | 3.0 g |
| Sodium thiocyanate | 1.0 g |
| Sodium bromide | 2.4 g |
| Potassium iodide | 8.0 mg |
| Potassium hydroxide (48%) | 6.2 ml |
| Potassium carbonate | 14 g |
| Potassium hydrogen carbonate | 12 g |
| 1-phenyl-4-methyl-4-hydroxymethyl-3-pyrazolidone | 1.5 g |
| Hydroquinone monosulfonate | 23.3 g |
| Water to | 1.0 l |
| (pH = 9.65) | |
| (Color developer) | |
| Benzyl alcohol | 14.6 ml |
| Ethylene glycol | 12.6 ml |
| Potassium carbonate (anhydride) | 26 g |
| Sodium hydroxide | 1.6 g |
| Sodium sulfite | 1.6 g |
| 3,6-dithiaoctane-1,8-diol | 0.24 g |
| Hydroxyethylamine sulfate | 2.6 g |
| 4-N-ethyl-N-β-(methanesulfonamidoethyl)-2-methyl-p-phenylenediaminesesquisulfate | 5.0 g |
| Water to | 1.0 l |
| (Bleach-fixer) | |
| 1.56 mol solution of Iron (III) ammonium ethylenediaminetetraacetate | 115 ml |
| Sodium methabisulfite | 15.4 g |
| Ammonium thiosulfate (58%) | 126 ml |
| 1,2,4-triazole-3-thiol | 0.4 g |
| Water to | 1.0 l |
| (pH = 6.5) | |

In a manner identical to that of Example 1, the so-processed samples were evaluated for the difference in $D_B/D_G$ (10% dot image) ratio and $D_B/D_G$ (100% dot image) ratio. Table 3 summarizes the results obtained.

TABLE 3

| | Coupler in Green-sensitive Layer | | | | |
|---|---|---|---|---|---|
| | | Magenta coupler | | | |
| | | | Amount (g/m²) | | |
| Sample No. | Yellow coupler | Type | Layer 6 | Layer 7 | $D_B/D_G$(10%) − $D_B/D_G$(100%) |
| 26 (Comparative) | — | MC-2 | 0.14 | 0.14 | 0.12 |
| 27 (same as above) | — | M-10 | 0.14 | 0.14 | 0.14 |
| 28 (Invention) | Y-54 | MC-2 | 0.12 | 0.12 | 0.09 |
| 29 (same as above) | Y-57 | M-10 | 0.14 | 0.14 | 0.06 |
| 30 (same as above) | Y-6 | M-1 | 0.12 | 0.12 | 0.06 |
| 31 (same as above) | Y-1 | M-16 | 0.14 | 0.14 | 0.09 |

It is apparent from the results in Table 3 that the invention is useful in the color reversal system.

Example 4

Equivalent mols of aqueous silver nitrite solution and aqueous potassium bromide were added to gelatin solution of 50° C., in 50 minutes according to the double jet precipitation method, in order to obtain an emulsion comprising cubic silver bromide grains whose mean size being 0.3 μm.

To this emulsion were added 6.5 mg, per mol silver, of sodium thiosulfate, and 3 mg, per mol silver, of potassium chloroaurate, and the emulsion was heated for 70 minutes at 70° C. in order to perform chemical ripening. Furthermore, to the emulsion were simultaneously added aqueous silver nitrite solution, and a mixture solution of sodium chloride and potassium bromide (molar ratio 1:1) in order to obtain a cubic core/shell emulsion whose grains (mean size 0.45 μm) individually comprising a silver bromide core and a silver chlorobromide shell. Once desalination by washing was complete, to the emulsion was added 2.0 mg, per mol silver, of sodium thiosulfate, and 1.0 mg, per mol silver, of potassium chloroaurate, and the emulsion was subjected to chemical ripening for 50 minutes at 60° C., in order to obtain direct positive silver halide emulsion Em-1.

Preparation of Blue-sensitive Emulsion EM-B

EM-1 was spectrally sensitized with Sensitizing Dye D-10, and then, 600 mg of T-1 was added per mol silver. Next, 8×10 mol of FA-1 per mol silver and 5×10 mol of FA-2 per mol silver were added, in order to obtain the blue-sensitive emulsion.

Preparation of Green-sensitive Emulsion EM-G

A green-sensitive emulsion was obtained in a manner identical to that of the above-mentioned blue-sensitive emulsion, except that Sensitizing Dye D-9 was added for spectral sensitization.

Preparation of Red-sensitive Emulsion EM-R

A red-sensitive emulsion was obtained in a manner identical to that of the above-mentioned blue-sensitive emulsion, except that Sensitizing Dyes D-4 and D-5 were added for spectral sensitization.

Using the so-obtained EM-B, EM-G, and EM-R, a silver halide color light-sensitive material whose constitution specified in Table 4 was prepared.

TABLE 4

| Layer | Composition | Coating weight (mg/dm$^2$*) |
|---|---|---|
| Layer 10 (UV absorbing layer) | Gelatin | 7.8 |
| | Ultraviolet Absorbent (UV-1) | 0.65 |
| | Ultraviolet Absorbent (UV-2) | 1.95 |
| | Solvent (SO-3) | 1.0 |
| | Colloidal silica | 0.30 |
| Layer 9 (Blue-sensitive layer) | Gelatin | 14.3 |
| | Blue-sensitive Emulsion EM-B (coating silver weight) | 5.0 |
| | Yellow Coupler (YC-1) | 8.2 |
| | Anti-stain Agent (AS-2) | 0.25 |
| | Solvent (SO-1) | 8.2 |
| | Inhibitors (ST-1, ST-2, T-1) | |
| Layer 8 (Intermediate layer) | Gelatin | 5.4 |
| | Anti-stain agent (AS-1) | 0.55 |
| | Solvent (SO-2) | 0.72 |
| Layer 7 (Yellow colloidal silver layer) | Gelatin | 4.2 |
| | Anti-stain agent (AS-1) | 1.0 |
| | Yellow colloidal silver | |
| | Anti-stain agent (AS-1) | 0.40 |
| | Solvent (SO-2) | 0.49 |
| | Polyvinyl pyrolidone (PVP) | 0.47 |
| Layer 6 (Intermediate layer) | Gelatin | 5.4 |
| | Anti-stain agent (AS-1) | 0.55 |
| | Solvent (SO-2) | 0.72 |
| Layer 5 (Green-sensitive layer) | Gelatin | 13.0 |
| | Green-sensitive Emulsion EM-G (coating silver weight) | 4.0 |
| | Magenta coupler | Table 5 |
| | Yellow coupler | Table 5 |
| | Anti-stain Agent (AS-2) | 0.19 |
| | Solvent (SO-1) | 3.1 |
| | Anti-irradiation Dye (AI-3) | 0.35 |
| | Inhibitors (ST-1, ST-2, T-2, T-1) | |
| Layer 4 (Intermediate layer) | Gelatin | 7.5 |
| | Anti-stain agent (AS-1) | 0.55 |
| | Solvent (SO-2) | 0.72 |
| Layer 3 (Red-sensitive layer) | Gelatin | 13.8 |
| | Red-sensitive Emulsion EM-R (coating silver weight) | 3.0 |
| | Cyan coupler (CC-3) | 4.4 |
| | Tone controller (A-1) | 2.2 |
| | Anti-stain Agent (AS-2) | 0.15 |
| | Anti-irradiation Dye (AI-4) | 0.25 |
| | Inhibitors (ST-1, ST-2, T-2, T-1) | |
| Layer 2 (Intermediate layer) | Gelatin | 5.4 |
| | Anti-stain agent (AS-1) | 0.55 |
| | Solvent (SO-2) | 0.72 |
| Layer 1 (Anti-halation layer) | Gelatin | 6.0 |
| | Black colloidal silver | 1.0 |

*Coating weight is as converted into metal silver.

(D-9)

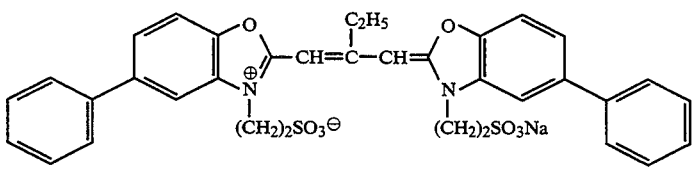

(D-10)

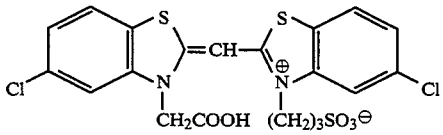

(YC-1)

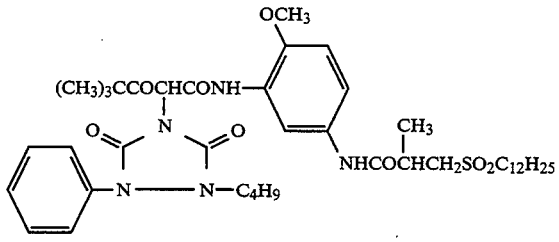

(SO-1)

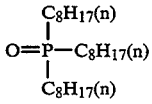

(SO-2)

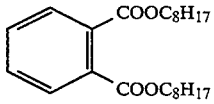

-continued
(AS-1)
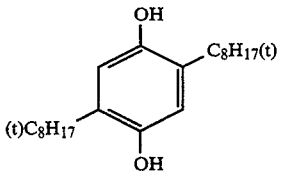
(AS-2)
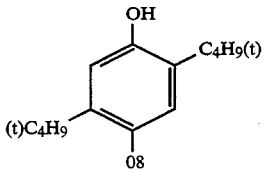
(A-1)
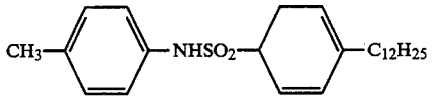
(AI-3)
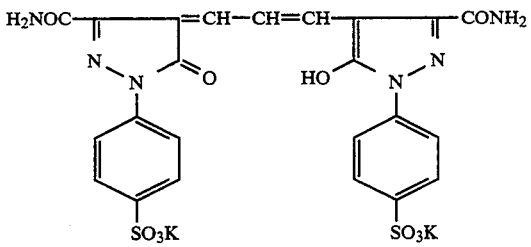
(AI-4)
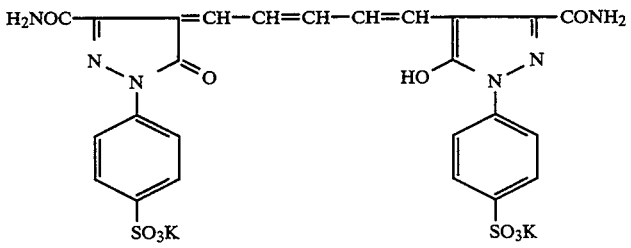
ST-1
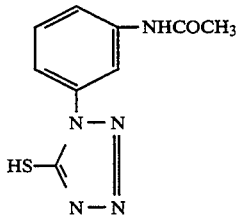
(ST-2)
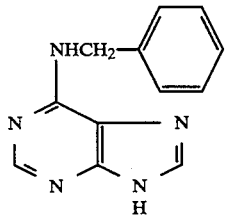
(FA-1)
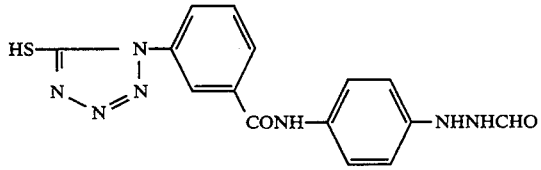

-continued

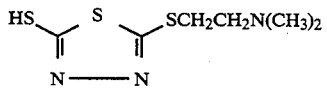

(FA-2)

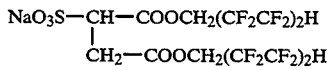

(SA-2)

On a support having, on its both faces, polyethylene lamination were sequentially formed the following Layers 1 through 10 each having the composition specified in Table 4. The coating auxiliaries used were S-2 and SA-2, and the hardeners used were H-1 and H-2.

Sample No. 32 was subjected to exposing identical to that for Sample No. 16 in Example 2, and Samples No. 33 through No. 36 were subjected to exposing identical to that for Samples No. 17 through No. 25 in Example 2. Then, each sample was subjected to developing specified below.

| Processing steps (temperature and duration) | | |
|---|---|---|
| (1) Color developing | 35° C. | 2 min. 30 sec. |
| (2) Bleach-fixing | 35° C. | 1 min. |
| (3) Stabilizing | 25–30° C. | 1 min. 30 sec. |
| (4) Drying | 78–80° C. | 1 min. |

| Compositions of processing solutions | |
|---|---|
| (Color developer) | |
| Benzyl alcohol | 15 ml |
| Cerium sulfate | 0.015 g |
| Ethylene glycol | 8 ml |
| Potassium sulfite | 2.5 g |
| Potassium bromide | 0.8 g |
| Sodium chloride | 0.2 g |
| Potassium carbonate | 25.0 g |
| T-1 | 0.1 g |
| Hydroxylamine sulfate | 5.0 g |
| Diethylenetriamine pentaacetate | 2 g |
| 4-anilino-N-ethyl-N-(βhydroxylethyl)aniline sulfate | 4.5 g |
| Fluorescent brightening agent (4,4'- | 1.0 g |

-continued

| | |
|---|---|
| diaminostylbenzosulfonate derivative) | |
| Potassium hydroxide | 2.0 g |
| Diethylene glycol | 15 ml |
| Potassium phosphate | 8 g |

Water was added to 1 liter, and the pH was adjusted to 10.50.

The bleach-fixer and the stabilizer used were identical to those in Example 2.

In a manner identical to that of Example 1, the so-processed samples were evaluated for the difference in $D_B/D_G$ (10% dot image) ratio and $D_B/D_G$ (100% dot image) ratio. Table 5 summarizes the results obtained.

TABLE 5

| Sample No. | Amount of magenta coupler (mol/m$^2$) | Amount of yellow coupler (mol/m$^2$) | $D_B/D_G$(10%) − $D_B/D_G$(100%) |
|---|---|---|---|
| 32 (Comparative) | MC-1(4.4 × $10^{-4}$) | — | 0.31 |
| 33 (Invention) | MC-1(4.4 × $10^{-4}$) | Y-11(1.1 × $10^{-4}$) | 0.18 |
| 34 (same as above) | MC-2(4.4 × $10^{-4}$) | Y-4(1.1 × $10^{-4}$) | 0.22 |
| 35 (same as above) | M-3(4.4 × $10^{-4}$) | Y-58(1.1 × $10^{-4}$) | 0.09 |
| 36 (same as above) | M-58(4.4 × $10^{-4}$) | Y-6(1.1 × $10^{-4}$) | 0.15 |

It is apparent from the results in Table 5 that color proof preparation with a direct positive silver halide color photographic light-sensitive material of the invention too results in smaller tone difference between larger dots and smaller dots on a halftone color image.

Example 5

Samples of positive light-sensitive material No. 41 to 49 were prepared in the same manner as in Sample 18 of Example 2 of the specification except that yellow coupler Y-8 was replaced by the the following comparative or inventive couplers. On the other hand, the gamma variation rate γv of the couplers were determined the foregoing method.

The tested couplers had the following same chemical structure except splitting off group $Z_2$.

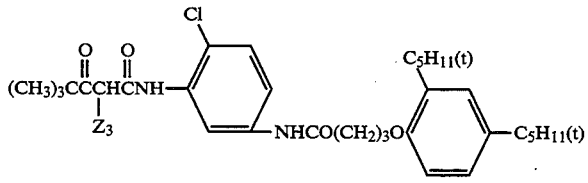

Comparative Coupler CY-1

CY-2

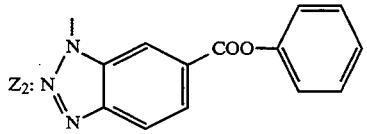

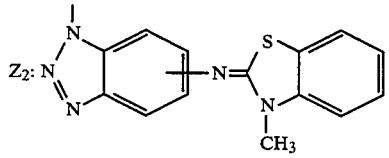

Inventive Coupler

-continued

Y-1

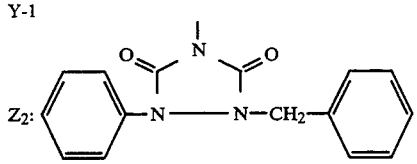

Y-8

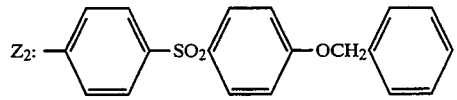

Y-61

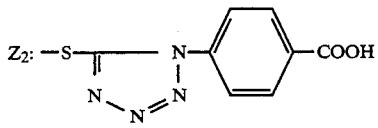

Y-62

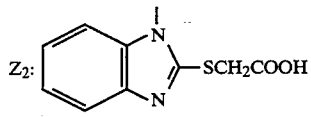

Y-63

$Z_2$: —$OCH_2COOH$

Y-64

$Z_2$: —$SCH_2COOH$

Y-65

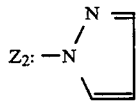

Among the above comparative couplers, CY-2 is a DIR yellow coupler the same as the couplers C4, C5 and ExY-11 set forth in U.S. Pat. No. 4,596,764 to Ishimaru, U.S. Pat. No. 4,680,252 to Shibahara, and U.S. Pat. No. 4,853,322 to Makino, respectively, and CY-1 is another sample of yellow DIR coupler.

Exposing conditions to form a red image for evaluating red color reproducing ability suitable for proof use of the sample were determined for every sample to be tested.

Determination of blue light exposure condition

Each of the samples was uniformly exposed to green light and red light of minimum quantities so that the resultant densities of magenta image and cyan image were minimum. Then the sample was exposed to blue light through an optical wedge and processed in the same manner sa in Example 2. Thus obtained wedgeweise yellow image was subjected to colorimetric measurement by a color analyser and a exposing condition to obtain an yellow image which have 84.6 of L* value on the chromaticity coordinate L*a*b* was determined.

Determination of green light exposure condition

Each of the samples was uniformly exposed to blue light and red light of minimum quantities so that the resultant densities of yellow image and cyan image were minimum. Then the sample was exposed to green light through an optical wedge and processed in the same manner as in Example 2. Thus obtained wedgeweise magenta image was subjected to colorimetric measurement by a color analyser and a exposing condition to obtain an yellow image which have 48.4 of L* value on the chromaticity coordinate L*a*b* was determined.

Formation of red mage to be evaluated

Each of the samples was uniformly exposed to red light of minimum quantities so that the resultant density of cyan image was minimum. The the sample was uniformly to bule light and green light with the conditions determined as above, respectively, and processed in the same manner as in Example 2 to obtaine the sample having red image.

Evaluation

Color of the red image formed on each sample was visualy compared with a printed solid red image using TK-V series yellow and magenta printing inks (manufactured by Toyo Ink Co.). The L* values of these yellow and magenta inks were 84.6 and 48.6 respectively.

Test results are listed in the following table.

| Sample No. | Yellow coupler | Magent coupler | γ v | Color of red image* |
|---|---|---|---|---|
| 41 | CY-1 | M-3 | −0.30 | Not good |
| 42 | CY-2 | M-3 | −0.37 | Not good |
| 43 | Y-1 | M-3 | 0 | Good |
| 44 | Y-8 | M-3 | 0 | Good |
| 45 | Y-61 | M-3 | 0 | Good |
| 46 | Y-62 | M-3 | 0 | Good |
| 47 | Y-63 | M-3 | 0 | Good |
| 48 | Y-64 | M-3 | 0 | Good |
| 49 | Y-65 | M-3 | 0 | Good |

*In the column of color image, "Not good" means the color of the red image formed on the sample is not acceptable for color proofing use because the color is considerably bluish compareed with that of the red image printed by the inks and "Good" means the color of the red image the sample is almost the same as that of the pring image by the inks and suficient for color proofing use.

As is shown in the above table, the red color almost the same as the color produced by the magenta and yellow printing inks is obtained only by the use of yellow coupler and magenta coupler of the invention. In the case of the comparative samples containing DIR coupler which have a gamma variation ratio of more than 1.0, red color of the obtained image is not acceptable for color proofing by reason that the image is more bluish than the of the printing inks.

What is claimed is:

1. A method for making a color image for proof comprising the steps of sequentially exposing a silver halide color photographic material to different lights, each light having different spectral distribution, through each of a plurality of black-and-white halftone images prepared by color separation of a color original, respectively, and developing said silver halide color photographic material with a color developer, wherein said silver halide photographic light-sensitive material comprises a yellow image forming light-sensitive layer, a magenta image forming light-sensitive layer and a cyan image forming light-sensitive layer which are different from each other in spectral sensitivity, wherein said magenta image forming layer contains a magenta coupler and a yellow coupler represented by the following formula Y-1;

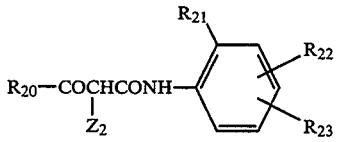

(Y-1)

wherein $R_{20}$ an alkyl group or a phenyl group; $R_{21}$ is a halogen atom or an alkoxy group; $R_{22}$ is a hydrogen atom, a halogen atom or an alkoxy group which is allowed to have a substituent; $R_{23}$ is an acylamino group, an alkoxycarbonyl group, a carbamoyl group, an alkylsulfamoyl group, an arylsulfamoyl group, an arylsulfonamido group, an alkylureido group, an arylureido group, a succinimido group, an alkoxy group or an aryloxy group, provided that these groups are allowed to have a substituent; and $Z_2$ is a hydrogen atom, a halogen atom or a substituent represented by (Z-1), (Z-3), (Z-4), (Z-5), (Z-6), (Z-7), (Z-8), (Z-9), (Z-10) or (Z-11) shown below, which is capable of splitting off upon a reaction with the oxidation product of a color developing agent and substantially does not inhibit color development after split off from the yellow coupler;

Formula (Z-1)

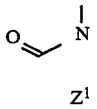

wherein $Z^1$ is a group of non-metal atoms necessary for completing a five- or six-member ring;

Formula (Z-3)

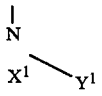

wherein $X^1$ is a nitrogen-containing aromatic heterocyclic ring which may be condensed with a benzene ring and $Y^1$ is selected from the group consisting of a carboxyl group, a sulfo group, a hydroxy group, a sulfonamido group, an aliphatic group containing not less than 10 carbon atoms, or an aromatic group having a substituent which contains not less than 10 carbon atoms in total Formula (Z-4)

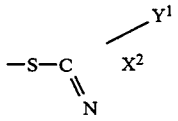

wherein $X^2$ is a nitrogen-containing aromatic heterocyclic ring which may be condensed with a benzene ring and Y' is an anti-diffusion group or a water-solubilizing group;

$$-O-R_{24} \quad \text{(Z-5)}$$

wherein $R_{24}$ is an alkyl group, a heterocyclic group, an acyl group or a carbamoyl group;

$$-S-R_{25} \quad \text{(Z-6)}$$

wherein $R_{25}$ is an alkyl group or an aryl group;

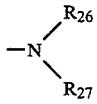

(Z-7)

wherein $R_{26}$ is a hydrogen atom, an alkyl group, an aryl group or a heterocyclic group; and $R_{27}$ is an alkyl group, an acyl group or a sulfonyl group, provided, $R_{26}$ and $R_{27}$ may be bonded to form a saturated ring;

Formula (Z-8)

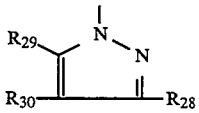

Formula (Z-9)

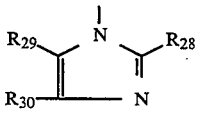

Formula (Z-10)

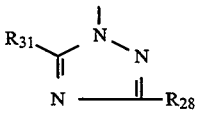

Formula (Z-11)

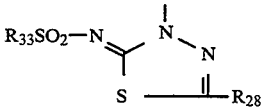

in formulas (Z-8) to (Z-11), $R_{28}$, $R_{29}$, $R_{30}$, and $R_{31}$ are each a hydrogen atom, an alkyl group, an aryl group, an acylamino group, a sulfonamido group, a halogen atom, an alkoxy group, an alkylthio group, an arylthio group, a carbamoyl group, a sulfamoyl group, an amino group, an acyloxy group, an alkoxycarbonyl group, a sufonyl group, an alkenyl group, an alkynyl group or an acyl group; $R_{31}$ is a hydrogen atom, an alkyl group, an aryl group, an acylamino group, a sulfonamido group, a halogen atom, an alkoxy group, a carbamoyl group, a sulfamoyl group, an amino group, an acyloxy group, an alkoxycarbonyl group, a sulfonyl group, an alkenyl group, an alkynyl group or an acyl group; and $R_{32}$ is an alkyl group or a heterocyclic group.

2. The method of claim 1, wherein said material comprises a paper support having polyethylene laminated on both surfaces.

3. The method of claim 1, wherein said magenta coupler is represented by the following formula (M-I):

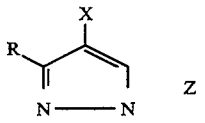

(M-I)

wherein Z is a group of non-metal atoms necessary for forming a nitrogen-containing heterocyclic ring which is allowed to have a substituent; X is a hydrogen atom or a group capable of being split off upon reaction with the oxidation product of a color developing agent; and R is a hydrogen atom or a substituent.

4. The method of claim 3, said magenta coupler is represented by one of the following Formulas (M-II) through (M-VII):

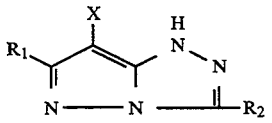

(M-II)

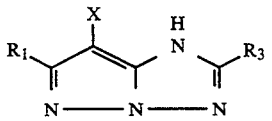

(M-III)

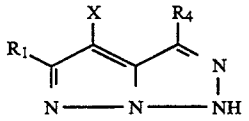

(M-IV)

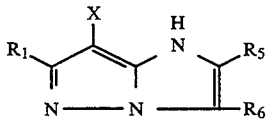

(M-V)

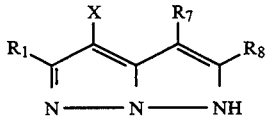

(M-VI)

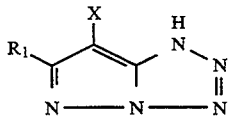

(M-VII)

wherein $R_1$ through $R_8$ and X are each identical to R and X defined in Formula (M-I), respectively.

5. The method of claim 4, wherein an atom which is contained in the group represented by R, and directly bound to the heterocyclic ring, is a carbon atom.

6. The method of claim 5, wherein said carbon atom is bonded with no or one hydrogen atoms.

7. The method of claim 6, wherein all bonds between said carbon atom and atoms adjoining to said carbon atom are single bonds.

8. The method of claim 4 said magenta coupler is represented by Formula (M-II) or (M-III).

9. The method of claim 4, wherein X is a halogen atom, an alkoxy group, an aryloxy group, a heterocyclic oxy group, an acyloxy group, a sulfonyloxy group, an alkoxycarbonyloxy group, an aryloxycarbonyloxy group, an alkyloxalyloxy group, an alkoxyoxalyloxy group, an alkylthio group, an arylthio group, a heterocyclic thio group, an alkyloxythiocarbonylthio group, an acylamino group, a sulfonamido group, a nitrogen-containing heterocyclic group linked through a nitrogen atom, an alkyloxycarbonylamino group, an aryloxycarbonylamino group,

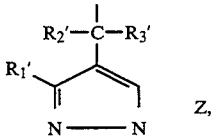

wherein $R_1'$ and Z' are identical to R and Z defined in Formula (M-I), respectively; and $R_2'$ and $R_3'$ are each a hydrogen atom, an aryl group, an an alkyl group or a heterocyclic group.

10. The method of claim 9, wherein said X is a halogen atom.

11. The method of claim 10, wherein said X is a chlorine atom.

12. The method of claim 4, wherein said $R_2$ through $R_4$, at least one of $R_5$ and $R_6$, and at least one of $R_7$ and $R_8$ are a group represented by Formula (M-X):

$$-R^1-SO_2-R^2 \qquad \text{(M-X)}$$

wherein $R^1$ is an alkylene group; and $R^2$ is an alkyl group, a cycloalkyl group or an aryl group.

13. The method of claim 1, wherein said $R_{20}$ is a tertiary butyl group.

14. The method of claim 1, wherein said group represented by formula (Z-1) is a group represented by the following formula (Z-12), (Z-13) or (Z-14)

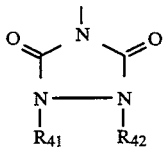

(Z-12)

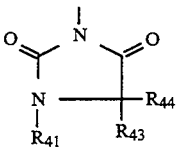

(Z-13)

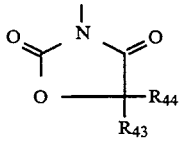

(Z-14)

wherein $R_{41}$ and $R_{42}$ are each a hydrogen atom, an alkyl group or an aryl group; and $R_{43}$ and $R_{44}$ are each a hydrogen atom, an alkyl group or an alkoxy group.

15. The method of claim 1, wherein said magenta image forming layer comprises an alkylphosphine oxide or a phosphoric acid ester with said magenta coupler and yellow coupler as a high-boiling solvent.

16. The method of claim 1, wherein a magenta dye formed from said magenta coupler and a yellow dye formed from said yellow coupler are different from each other by not less than 30 nm in the maximum spectral absorptions of their methanol solutions.

17. The method of claim 16, wherein said magenta dye and said yellow dye are different from each other by not less than 60 nm in the maximum spectral absorptions of their methanol solutions.

18. The method of claim 1, wherein said yellow coupler is contained in said magenta image forming layer in an amount of from 0.02 mol to 0.5 mol per mol of said magenta dye-forming coupler contained in said magenta image forming layer.

19. The method of claim 1, wherein said silver halide color photographic light-sensitive material is a direct-positive type silver halide color photographic light-sensitive material.

20. The material of claim 1, wherein said silver halide color photographic light-sensitive material is a reversal type silver halide color photographic light-sensitive material.

21. The method of claim 1, wherein a pKa value of said magenta coupler, $pKa_1$, and that of said yellow coupler, $pKa_2$, have a relationship satisfying the following Expression (1):

$$-2.0 < pKa_1 - pKa_2 < +2.0 \quad (1).$$

22. The method of claim 21, wherein said relationship between $pKa_1$ and $pKa_2$ satisfies the following expression:

$$-1.5 < pKa_1 - pKa_2 < +1.5.$$

23. A method for making a color image for proof comprising the steps of sequentially exposing a silver halide color photographic material to different lights, each light having different spectral distribution, through each of a plurality of black-and-white halftone images prepared by color separation of a color original, respectively, and developing said silver halide color photographic material with a color developer, wherein said silver halide photographic light-sensitive material comprises a yellow image forming light-sensitive layer, a magenta image forming light-sensitive layer and a cyan image forming light-sensitive layer which are different from each other in spectral sensitivity, wherein said magenta image forming layer contains a magenta coupler and a yellow coupler represented by the following formula Y-1';

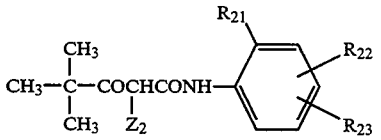

(Y-1')

wherein $R_{21}$ is a halogen atom or an alkoxy group; $R_{22}$ is a hydrogen atom, a halogen atom, or an alkoxy group which is allowed to have a substituent; $R_{23}$ is an acylamino group, an alkoxycrabonyl group, an alkylsulfamoyl group, an arylsulfamoyl group, an arylsulfonamido group, an alkylureido group, an arylureido group, a succinimido group, an alkoxy group or a aryloxy group, provided that these groups are allowed to have a substituent; $Z_2$ is a hydrogen atom, a halogen-atom or a substituent represented by the following formula (Z-21), (Z-22), (Z-23) or (Z-24);

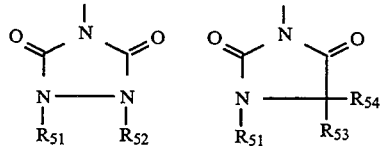

(Z-21) (Z-22)

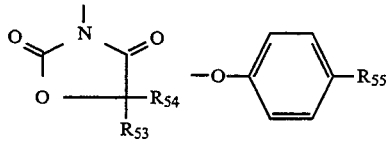

(Z-23) (Z-24)

wherein $R_{51}$ and $R_{52}$ are each a hydrogen atom, an alkyl group, or an aryl group; $R_{53}$ and $R_{54}$ are each a hydrogen atom, an alkyl group or an alkoxy group; and $R_{55}$ is a carboxy group, a carbonyl group or a sulfo group provided that $R_{51}$, $R_{52}$, $R_{53}$, $R_{54}$ and $R_{55}$ are optionally substituted.

24. The method of claim 23, wherein said material comprises a paper support having polyethylene laminated on both surfaces.

25. The method of claim 23, wherein said substituent represented by formula (Z-21), (Z-22), (Z-23) or (Z-24) is selected from the following groups;

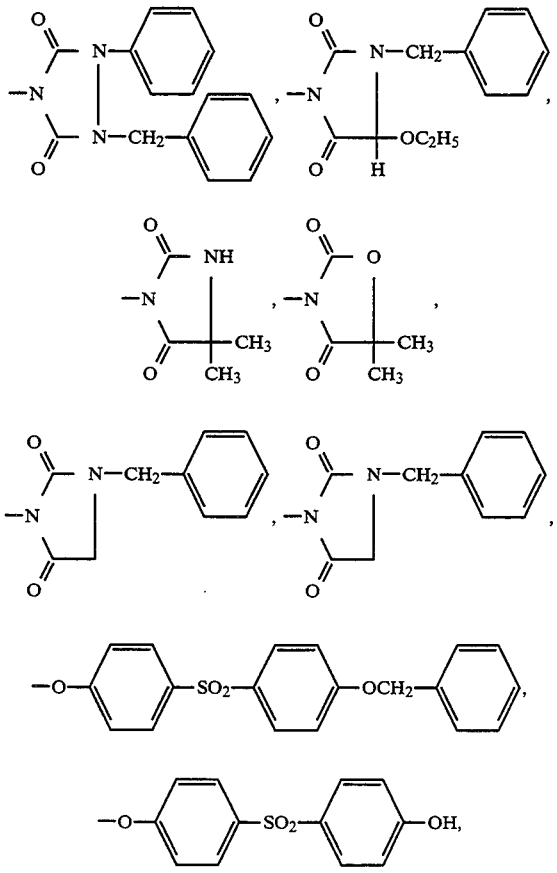

-continued

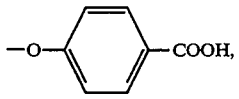

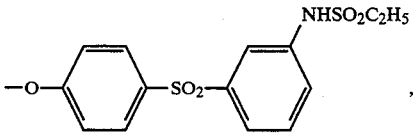

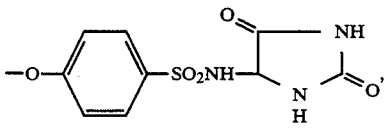

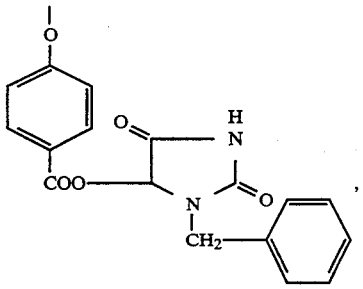

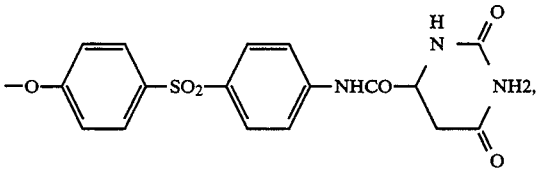

and

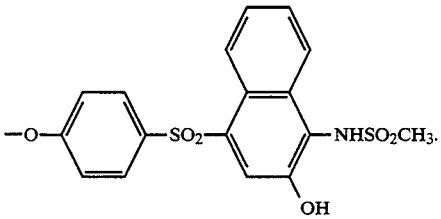

26. The method of claim 23, wherein said magenta coupler is represented by the following formula (M-I):

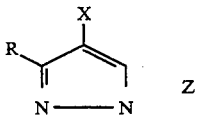

(M-I)

wherein Z is a group of non-metal atoms necessary for forming a nitrogen-containing heterocyclic ring which is allowed to have a substituent; X is a hydrogen atom or a group capable of being split off upon reaction with the oxidation product of a color developing agent; and R is a hydrogen atom or a substituent.

27. The method of claim 26, said magenta coupler is represented by one of the following Formulas (M-II) through (M-VII):

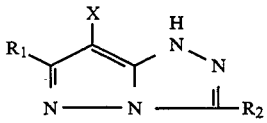

(M-II)

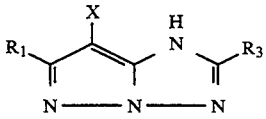

(M-III)

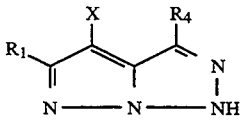

(M-IV)

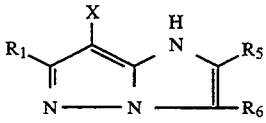

(M-V)

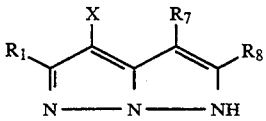

(M-VI)

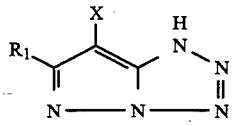

(M-VII)

wherein $R_1$ through $R_8$ and X are each identical to R and X defined in Formula (M-I), respectively.

28. The method of claim 27, wherein an atom which is contained in the group represented by R, and directly bound to the heterocyclic ring, is a carbon atom.

29. The method of claim 28 wherein said carbon atom is bonded to no or one hydrogen atoms.

30. The method of claim 29, wherein all bonds between said carbon atom and atoms adjoining to said carbon atom are single bonds.

31. The method of claim 27, said magenta coupler is represented by Formula (M-II) or (M-III).

32. The method of claim 27, wherein X is a halogen atom, an alkoxy group, an aryloxy group, a heterocyclic oxy group, an acyloxy group, a sulfonyloxy group, an alkoxycarbonyloxy group, an aryloxycarbonyloxy group, an alkyloxalyloxy group, an alkoxyoxalyloxy group, an alkylthio group, an arylthio group, a heterocyclic thio group, an alkyloxythiocarbonylthio group, an acylamino group, a sulfonamido group, a nitrogen-containing heterocyclic group linked through a nitrogen atom, an alkyloxycarbonylamino group, an aryloxycarbonylamino group,

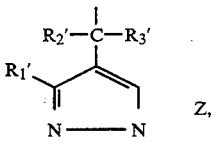

Z, wherein $R_1'$ and Z' are identical to R and Z defined in Formula (M-I), respectively; and $R_2'$ and $R_3'$ are each a hydrogen atom, an aryl group, an an alkyl group or a heterocyclic group.

33. The method of claim 32, wherein X is a halogen atom.

34. The method of claim 33, wherein said X is a chlorine atom.

35. The method of claim 27, wherein said $R_2$ through $R_4$, at least one of $R_5$ and $\%_6$, and at least one of $R_7$ and $R_8$ are a group represented by Formula (M-X):

$$-R^1-SO_2-R^2 \qquad \text{(M-X)}$$

wherein $R^1$ is an alkylene group; and $R^2$ is an alkyl group, a cycloalkyl group or an aryl group.

36. The method of claim 23, wherein said magenta image forming layer comprises an alkylphosphine oxide or a phosphoric acid ester with said magenta coupler and yellow coupler as a high-boiling solvent.

37. The method of claim 23, wherein a magenta dye formed from said magenta coupler and yellow dye formed from said yellow coupler are different form each other by not less than 30 nm in the maximum spectral absorptions of their methanol solutions.

38. The method of claim 37, wherein said magenta dye and said yellow dye are different from each other by not less than 60 nm in the maximum spectral absorptions of their methanol solutions.

39. The method of claim 23, wherein a pKa value of said magenta coupler, $pKa_1$, and that of said yellow coupler, $pKa_2$, have a relationship satisfying the following Expression (1):

$$-2.0 < pKa_1 - pKa_2 < +2.0 \qquad (1).$$

40. A method for making a color image for proof comprising the steps of sequentially exposing a silver halide color photographic material to different lights, each light having different spectral distribution, through each of a plurality of black-and-while halftone images prepared by color separation of a color original, respectively, and developing said silver halide color photographic material with a color developer, wherein said silver halide photographic light-sensitive material comprises a yellow image forming light-sensitive layer, a magenta image forming light-sensitive layer and a cyan image forming light-sensitive layer which are different from each other in spectral sensitivity, wherein said magenta image forming layer contains a magenta coupler and a yellow coupler represented by the following formula Y-1;

(Y-1)

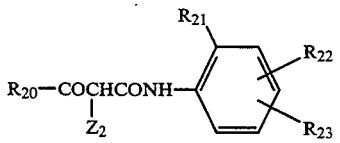

wherein $R_{20}$ is an alkyl group or a phenyl group; $R_{21}$ is a halogen atom or an alkoxy group; $R_{22}$ is a hydrogen atom, a halogen atom or an alkoxy group which is allowed to have a substituent; $R_{23}$ is an acylamino group, an alkoxycarbonyl group, a carbamoyl group, an alkylsulfamoyl group, an arylsulfamoyl group, an arylsulfonamido group, an alkylureido group, an arylureido group, a succinimido group, an alkoxy group or an aryloxy group, provided that these groups are allowed to have a substituent; and $Z_2$ is a substituent represented by the following formula (Z-1)

Formula (Z-1)

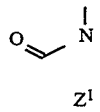

wherein $Z^1$ is a group of non-metal atoms necessary for completing a five-or six-member ring.

41. The method of claim 40, wherein said magenta coupler is represented by the following formula (M-I):

(M-I)

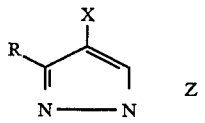

wherein Z is a group of non-metal atoms necessary for forming a nitrogen-containing heterocyclic ring which is allowed to have a substituent; X is a hydrogen atom or a group capable of being split off upon reaction with the oxidation product of a color developing agent; and R is a hydrogen atom or a substituent.

42. The method of claim 41, wherein said magenta coupler is represented by one of the following Formulas (M-II) through (M-VII):

(M-II)

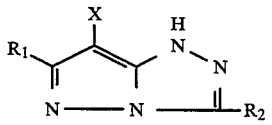

(M-III)

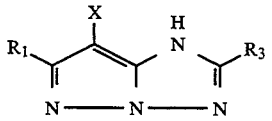

(M-IV)

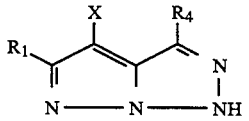

(M-V)

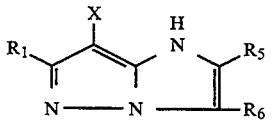

(M-VI)

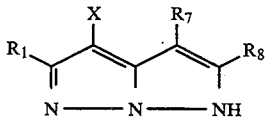

(M-VII)

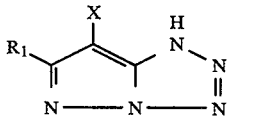

wherein $R_1$ and $R_8$ are each identical to R and X defined in Formula (M-I), respectively.

43. The method of claim 42, wherein said $R_2$ through $R_4$, at least one of $R_5$ and $R_6$, and at least one of $R_7$ and $R_8$ are a group represented by Formula (M-X):

$$-R^1-SO_2-R^2 \quad \text{(M-X)}$$

wherein $R^1$ represents an alkylene group; $R^2$ represents an alkyl group, cycloalkyl group or aryl group.

44. The method of claim 42, wherein X is a halogen atom, alkoxy group, an aryloxy group, a heterocyclic oxy group, an an alkoxyoxalyloxy group, an alkylthio group, an arylthic group, an acylamino group, a sulfonamido group, a nitrogen-containing heterocyclic group linked through a nitrogen atom, an alkyloxycarbonylamino group, an aryloxycarbonylamino group,

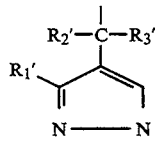

Z, wherein $R_1'$ and Z' are identical to R and Z defined in Formula (M-I), respectively; and $R_2'$ and $R_3'$ are each a hydrogen atom, an aryl group, an an alkyl group or a heterocyclic group.

45. The method of claim 42, wherein said magenta coupler is represented by Formula (M-II) or (M-III) .

46. The method of claim 40, wherein said magenta image forming layer comprises an alkylphosphine oxide or a phosphoric acid ester with said magenta coupler and yellow coupler as a high-boiling solvent.

47. The method of claim 40, wherein a magenta dye formed from said magenta coupler and a yellow dye formed from said yellow coupler are different from each other by not less than 30 nm in the maximum spectral absorptions of their methanol solutions.

48. The method of claim 47, wherein said magenta dye and said yellow dye are different from each other by not less than 60 nm in the maximum spectral absorptions of their methanol solutions.

49. The method of claim 40, wherein said yellow coupler is contained in said magenta image forming layer in an amount of from 0.02 mol to 0.5 mol per tool of said magenta dye-forming coupler contained in said magenta image forming layer.

50. The method of claim 40, wherein said silver halide color photographic light-sensitive material is a direct-positive type silver halide color photographic light-sensitive material.

51. The method of claim 40, wherein said silver halide color photographic light-sensitive material is a reversal type silver halide color photographic light-sensitive material.

52. The method of claim 40, wherein said material comprises a paper support having polyethylene laminated on both surfaces.

53. The material of claim 40, wherein a pKa value of said magenta coupler, $pKa_1$, and that of said yellow coupler, $pKa_2$, have a relationship satisfying the following Expression (1):

$$-2.0 < pKa_1 - pKa_2 < +2.0 \quad (1).$$

54. The method of claim 53, wherein said relationship between $pKa_1$ and $pKa_2$ satisfies the following expression:

$$-1.5 < pKa_1 - pKa_2 < +1.5.$$

55. A method for making a color image for proof comprising the steps of sequentially exposing a silver halide color photographic material to different lights, each light having different spectral distribution, through each of a plurality of black-and-white halftone images prepared by color separation of a color original, respectively, and developing said silver halide color photographic material with a color developer, wherein said silver halide photographic light-sensitive material comprises a yellow image forming light sensitive layer, a magenta image forming light-sensitive layer and a cyan image forming light-sensitive layer which are different from each other in spectral sensitivity, wherein said magenta image forming layer contains a magenta coupler and a yellow coupler represented by the following formula Y-1;

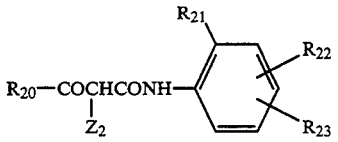

(Y-1)

wherein $R_{20}$ an alkyl group or a phenyl group; $R_{21}$ is a halogen atom or an alkoxy group; $R_{22}$ is a hydrogen atom, a halogen atom or an alkoxy group which is allowed to have a substituent; $R_{23}$ is an acylamino group, an alkoxycarbonyl group, a carbamoyl group, an alkylsulfamoyl group, an arylsulfamoyl group, an arylsulfonamido group, an alkylureido group, an arylureido group, a succinimido group, an alkoxy group or an aryloxy group, provided that these groups are allowed to have a substituent; and $Z_2$ is a substituent represented by the following formula (Z-5), $$-O-R_{24} \quad \text{(Z-5)}$$

wherein $R_{24}$ is an alkyl group, a heterocyclic group, an acyl group or a carbamoyl group.

56. The method of claim 55, wherein said material comprises a paper having polyethylene laminated on both surfaces.

57. A method for making a color image for proof comprising the steps of sequentially exposing a silver halide color photographic material to different lights, each of light having different spectral distribution, through each of a plurality of black-and-white halftone images prepared by color separation of a color original, respectively, and developing said silver halide color photographic material with a color developer, wherein said silver halide photographic light-sensitive material comprises a yellow image forming light sensitive layer, a magenta image forming light-sensitive layer and a cyan image forming light-sensitive layer which are different from each other in spectral sensitivity, wherein said magenta image forming layer contains a magenta coupler and a yellow coupler represented by the following formula Y-1;

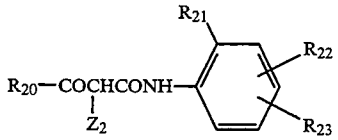

(Y-1)

wherein $R_{20}$ an alkyl group or a phenyl group; $R_{21}$ is a halogen atom or an alkoxy group; $R_{22}$ is a hydrogen atom, a halogen atom or an alkoxy group which is allowed to have a substituent; $R_{23}$ is an acylamino group, an alkoxycarbonyl group, a carbamoyl group, an alkylsulfamoyl group, an arylsulfamoyl group, an arylsulfonamide group, an alkylureido group, an arylureido group, a succinimido group, an alkoxy group or an aryloxy group, provided that these groups are allowed to have a substituent; and $Z_2$ is a substituent represented by the following formula (Z-7),

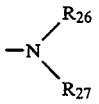

(Z-7)

wherein $R_{26}$ is a hydrogen atom, an alkyl group, an aryl group or a heterocyclic group; and $R_{27}$ is an alkyl group, an acyl group or a sulfonyl group, provided, $R_{26}$ and $R_{27}$ may be bonded to form a saturated ring.

58. The method of claim 57, wherein said material comprises a paper support having polyethylene laminated on both surfaces.

59. A silver halide color photographic light-sensitive material for color proofs comprising a paper support having polyethylene laminated on both sides, and on said support, a yellow image forming light-sensitive layer, a magenta image forming light-sensitive layer and a cyan image forming light-sensitive layer which are different from each other in spectral sensitivity, wherein said magenta image forming layer contains a magenta coupler and a yellow coupler represented by the following formula (Y-1);

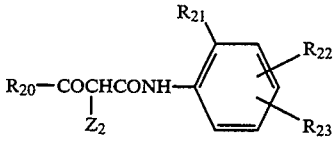

(Y-1)

wherein $R_{20}$ is an alkyl group or a phenyl group; $R_{21}$ is a halogen atom or an alkoxy group; $R_{22}$ is a hydrogen atom, a halogen atom or an alkoxy group which is allowed to have a substituent; $R_{23}$ is an acylamino group, an alkoxycarbonyl group, a carbamoyl group, an alkylsulfamoyl group, an arylsulfamoyl group, an arylsulfonamido group, an alkylureido group, an arylureido group, a succinimido group, an alkoxy group or an aryloxy group, provided that these groups are allowed to have a substituent; and $Z_2$ is a substituent represented by the following formula (Z-1)

Formula (Z-1)

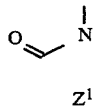

wherein $Z^1$ is a group of non-metal atoms necessary for completing a five-or six-member ring.

* * * * *